US010595602B2

(12) United States Patent
Sirichai

(10) Patent No.: US 10,595,602 B2
(45) Date of Patent: Mar. 24, 2020

(54) CASE ASSEMBLY FOR AN ELECTRONIC DEVICE

(71) Applicant: World Richman Manufacturing Corporation, Elgin, IL (US)

(72) Inventor: Saharut Sirichai, Bangkok (TH)

(73) Assignee: World Richman Manufacturing Corporation, Elgin, IL (US)

( * ) Notice: Subject to any disclaimer, the term of this patent is extended or adjusted under 35 U.S.C. 154(b) by 107 days.

(21) Appl. No.: 15/356,633

(22) Filed: Nov. 20, 2016

(65) Prior Publication Data

US 2017/0143088 A1 May 25, 2017

Related U.S. Application Data

(60) Provisional application No. 62/258,247, filed on Nov. 20, 2015.

(51) Int. Cl.
*A45C 11/00* (2006.01)

(52) U.S. Cl.
CPC ..... *A45C 11/00* (2013.01); *A45C 2011/002* (2013.01); *A45C 2011/003* (2013.01); *A45C 2200/15* (2013.01)

(58) Field of Classification Search
CPC ..... A45C 2011/003; A45C 2011/002; A45C 2011/001; B65D 81/02
USPC ..... 206/45.23, 45.2, 320
See application file for complete search history.

(56) References Cited

U.S. PATENT DOCUMENTS

| | | | | |
|---|---|---|---|---|
| 8,359,078 | B2 | 1/2013 | Hung | |
| 8,640,864 | B2 | 2/2014 | Chen et al. | |
| 8,640,868 | B2 * | 2/2014 | O'Dowd | G06F 1/1628 206/320 |
| 8,731,626 | B2 | 5/2014 | Hung | |
| 8,887,910 | B2 * | 11/2014 | Ashley | A45C 11/00 206/320 |
| 9,010,529 | B2 | 4/2015 | Chen et al. | |
| 9,101,188 | B2 * | 8/2015 | Magness | G06F 1/1656 |
| 2010/0294909 | A1 * | 11/2010 | Hauser | A47B 23/043 248/456 |
| 2015/0041341 | A1 * | 2/2015 | Marshall | A45C 11/00 206/45.2 |
| 2015/0272303 | A1 | 10/2015 | Brown et al. | |

(Continued)

*Primary Examiner* — Robert Poon
(74) *Attorney, Agent, or Firm* — Christopher J. Scott

(57) ABSTRACT

A sleeve and case assembly selectively encase and protect an electronic device such as a tablet computer or smart phone. Each of the sleeve and case assemblies is constructed from materials having high impact resistance or toughness qualities. The sleeve assemblies comprise two substantially identical half shells each of which are constructed from the impact-resistant material and are internally configured or contoured to together define a device-receiving volume operable to simultaneously prevent internal device shift or movement while providing the impact-resistant casing. The case assemblies each provide an impact resistant device-encircling material usable in combination with a device-receiving and positioning cradle to cooperably and selectively display an electronic device when in an open case configuration and protect the electronic device when in a closed case configuration. The posterior cradle and cover portions of each case assembly face in opposite directions when in the closed case configuration.

11 Claims, 49 Drawing Sheets

(56) References Cited

U.S. PATENT DOCUMENTS

| | | | | |
|---|---|---|---|---|
| 2016/0084614 | A1* | 3/2016 | Ellingson | A45C 11/24<br>224/243 |
| 2016/0294433 | A1* | 10/2016 | Ahee | H04B 1/3888 |

* cited by examiner 10
100
12
14
18
15
101

10
102
17
17
28
28
26
12
12

10
17
17
28
28
25
12
12

102
10
100
26
12
14
18
15
25
101

32
39
42
45
40
38
"45B"
50
55
44
"45A"
51
53

75

75

75

76

76

76

76

66
73
72

73
72
74

66'
73
72

73
72
74'

101
82
85
84
120
100
102
67
92
66
78
49
73
43

CASE ASSEMBLY FOR AN ELECTRONIC DEVICE

PRIOR HISTORY

This patent application claims the benefit of U.S. Provisional Patent Application No. 62/258,247 filed in the United States Patent and Trademark Office on 20 Nov. 2015.

BACKGROUND OF THE INVENTION

Field of the Invention

The disclosed invention generally relates to a sleeve and case construction for encasing an electronic device such as a laptop type computer, tablet type computer, mobile phone or similar other mobile communications device. More particularly, the disclosed invention provides a device-holding sleeve and case construction constructed from or comprising certain impact-resistant materials and particularly configured to protect the electronic device as received within a volume defined by internal surfacing of the sleeve or case.

Brief Description of the Prior Art

Case constructions for use in combination with electronic devices such as tablet type computers, smart phones and the like are well known in this field of art. While the basic function of a case construction is to protect and/or enclose the device it encases, the art continues to develop with an eye toward enhancing the device-protective aspects of the protection mechanism while simultaneously enhancing functionality of the case constructions so as to provide the user with various means of manipulating and/or re-positioning the devices for use and display. Several of the more pertinent prior art patent-related disclosures relating to case constructions and the like for holding and enabling display of the devices they hold are described hereinafter.

U.S. Pat. No. 8,359,078 ('078 patent) and U.S. Pat. No. 8,731,626 ('626 patent), issued to Hung and owned by Belkin International, Inc. of Playa Vista Calif., disclose a Mobile Media Device Enclosure, Method of Use of Mobile Media Device Enclosure, and Method of Providing a Mobile Media Device Enclosure. The '078 and '626 patents each describe certain mobile media device enclosures or cradles having an interior, an exterior, a top side, a bottom side, a right side, and a left side wherein the interior is configured to form a cavity sized and shaped to retain a mobile media device.

The enclosures further include both a vertical boundary and a horizontal boundary. The vertical boundary is configured to substantially bisect the mobile media device enclosure from the top side to the bottom side, and the horizontal boundary is configured to substantially bisect the mobile media device enclosure from the left side to the right side. The vertical and horizontal boundaries are thus configured to substantially divide the mobile media device enclosure into four sections, each of which is flexibly and elastically coupled to two other sections of the four sections, and each of which four sections may be temporarily removed from the electronic device.

U.S. Pat. No. 8,640,864 ('864 patent) and U.S. Pat. No. 9,010,529 ('529 patent), issued to Chen et al. and assigned to ASUSTeK Computer Inc. of Taipei, Taiwan, disclose certain Foldable Covers. The '864 and '529 patents describe foldable covers for protecting or supporting a portable electronic device comprising a supporting unit and a fixing unit. The supporting unit comprises a plurality of first separations, a convergent part and a plurality of first slab-shaped parts. Each first separation is connected to the convergent part. The fixing unit is connected to the supporting unit to fix the portable electronic device. When the first slab-shaped parts are located at the same surface, the supporting unit covers the portable electronic device. When a three dimensional structure is formed by the first separations, the convergent part and the first slab-shaped parts, the supporting unit supports the portable electronic device.

United States Patent Application Publication No. 2015/0272303 ('303 Publication), authored by Brown et al. on behalf of Incase Designs Corp. of Chino Calif., discloses a Hybrid Frame Sleeve Case. The '303 Publication describes a sleeve case for protecting a portable electronic device (e.g., laptop computer or electronic tablet device) and includes neoprene or fabric panels attached to an elastic polymer frame, preferably constructed from or comprising Ethylene Vinyl Acetate or EVA for its toughness characteristics. The elastic polymer frame extends around a perimeter of the sleeve to provide cushioning or padding for side edges of the sleeve. A magnetic or other latching mechanism is used to secure an opening on one side of the sleeve.

From a review of the foregoing citations in particular, and from a consideration of the prior art in general, it will be seen that the prior art perceives a need for a sleeve assembly that prevents internal movement of a sleeve-received electronic device by way of flange-based, device-engaging movement prevention means and dorsal-to-ventral sleeve venting. Further, it will be seen that the prior art perceives a need for a case assembly that operates to anteriorly receive a cradle-held electronic device thereby covering and support the device posteriorly, but further enables the user to display the cradle-held device by way of the same structure that operates to posteriorly cover and support the cradle-held device.

SUMMARY OF THE INVENTION

Among the many objectives of this invention is the basic provision of a sleeve assembly for protectively encasing an electronic device and case assembly for selectively encasing and/or displaying an electronic device. The sleeve assembly according to the present invention is believed to essentially and preferably comprise a first sleeve half shell and a second sleeve half shell. The first sleeve half shell comprises a first dorsal section, a first ventral section, a first internal sleeve contour, and a first external sleeve contour. The first ventral section is pivotally attached to the first dorsal section.

The first internal sleeve contour is shaped to receive an outer first half of the electronic device. The first external sleeve contour comprises a first exterior surface plane. The second sleeve half shell similarly comprises a second dorsal section, a second ventral section, a second internal sleeve contour, and a second external sleeve contour. The second ventral section is pivotally attached to the second dorsal section. The second internal sleeve contour is shaped to receive an outer second half of the electronic device. The second external sleeve contour comprises a second exterior surface plane.

The first dorsal section is preferably fixedly or permanently attached to the second dorsal section while the first ventral section is separably attachable to the second ventral section. The first and second exterior surface planes are preferably and substantially parallel to one another when the first and second ventral sections are separably attached to one another. The first and second internal sleeve contours together define a fixed device-receiving dorsal volume within the first and second dorsal sections, and the first and second internal sleeve contours together define a device-receiving ventral volume within the first and second ventral sections when the first and second ventral sections are separably attached to one another.

A dorsal portion of the electronic device is thus receivable in the device-receiving dorsal volume by way of the first and second ventral sections when the first and the second ventral sections are separated from one another. The ventral portion of the electronic device is receivable in the device-receiving ventral volume when the first and the second ventral sections are separably attached to one another. Received in a device-receiving volume summed by the dorsal and ventral volumes, the electronic device as exemplified by a tablet computer or smart phone, is thus selectively covered and protected by the sleeve assembly according to the present invention.

The first and second dorsal sections may each further preferably comprise an outer dorsal section flange and the first and second ventral sections may each further comprise an outer ventral section flange. The outer dorsal section flanges are fixedly attached to one another and the outer ventral section flanges are preferably and separably attachable to one another. The outer dorsal and ventral flange sections are coplanar and extend in an outer flange plane when the outer ventral section flanges are separably attached to one another.

The first and second ventral sections of the sleeve assembly are preferably pivotally attached to the first and second dorsal sections at opposed flange junctions, which opposed flange junctions extend in opposed junction planes parallel to and intermediate the first and second exterior surface planes when the outer ventral section flanges are separably attached to one another. The opposed flange junctions extend in the opposed junction planes for resiliently contacting opposite sides of the electronic device as received in the device-receiving dorsal and ventral volumes. The opposed flange junctions thus further function to prevent movement of the electronic device within the device-receiving dorsal and ventral volumes.

The opposed flange junctions of the sleeve assembly may preferably extend in a first bi-direction, and each of the first and second sleeve half shells preferably comprise at least one secondary device support flange that extends in a second bi-direction orthogonal to the first bi-direction. Each secondary device support flange is preferably coplanar with a respective junction plane when the outer ventral section flanges are separably attached to one another for resiliently further contacting opposite sides of the electronic device as received in the device-receiving dorsal and ventral volumes. The secondary device support flanges may thus further prevent movement of the electronic device within the device-receiving dorsal and ventral volumes.

Other features of the sleeve assembly according to the present invention include certain ventral section retention means cooperably associated with the outer ventral section flanges for cooperably retaining the first and second ventral sections separably attached to one another. Further, the first and second dorsal sections and the first and second ventral sections may each preferably comprise a substantially uniform maximum section width while the opposed flange junctions each comprise a substantially uniform junction length, such that the junction length is lesser than the maximum section length for forming laterally opposed sleeve vents intermediate the dorsal sections and the ventral sections.

Certain case assemblies according to the present invention basically function for selectively encasing and displaying an electronic device. To achieve these basic objectives, the case assemblies according to the present invention may be said to preferably and essentially comprise a cradle or cradle element, a basal cover ensemble, and a cradle-to-cover connection panel assembly or mechanism. The cradle elements according to the present invention all have an open anterior cradle portion, a posterior cradle portion, and a cradle depth. The cradles are all preferably sized and shaped for receiving and retaining posterior portions of the electronic device so as to selectively display anterior portions of the electronic device.

The basal cover ensembles according to the present invention may all be said to preferably and essentially comprise an open anterior cover portion, a posterior cover portion, and a raised peripheral boundary portion or element. The raised peripheral boundary portion has a portion thickness and defines a primary cradle-receiving cavity. The primary cradle-receiving cavity is preferably sized and shaped for receiving the cradle and cradle-received or cradle-retained device when the anterior cover portion and anterior cradle portion face one another, the portion thickness being at least equal to the cradle depth.

The cradle-to-cover connection panel assembly or mechanism according to the present invention preferably and essentially comprises a dorsal panel portion and a ventral panel portion. The ventral panel portion is preferably connected to the posterior cradle portion and the dorsal panel portion is preferably connected to the posterior cover portion. The ventral panel portion is pivotally connected to the dorsal panel portion for enabling the user to selectively position the cradle and basal cover ensemble in either a select open case configuration or a closed case configuration such that the posterior cradle and cover portions face in opposite directions when in the closed case configuration.

The peripheral boundary portion may preferably comprise or include at least one ventral prop portion and the cradle may preferably comprise or include a dorsal edge. Each ventral prop portion basically functions to prop or support the dorsal edge of the cradle element when the cradle element is in one or more primary angled display configuration(s) relative to the basal cover ensemble. The basal cover ensemble may further comprise certain cradle-support surfacing for supporting the dorsal edge of the cradle element when the cradle is in a series of secondary angled display configurations relative to the basal cover ensemble.

The cradle-to-cover connection panel assembly or mechanism may preferably further comprise a support panel portion. The support panel portion is preferably pivotally connected to both the ventral panel portion and the dorsal panel portion and basically functions to support the cradle in any of the angled display configurations. The peripheral boundary portion may preferably comprise an outer peripheral edge and at least one secondary cavity. The primary cradle-receiving cavity and each secondary cavity are preferably off-centered relative to select portions of the outer peripheral edge.

The dorsal panel portion may preferably comprise certain posterior panel surfacing and anterior panel surfacing such that the anterior panel surfacing provides the cradle-support surfacing for supporting the cradle in the secondary angled display configurations. The basal cover ensemble, in certain embodiments, may be said to further preferably comprise raised cradle-support surfacing, which raised cradle-support surfacing supports the cradle in spaced relation relative to the posterior cover portion when in the closed case configuration.

The peripheral boundary portion may preferably comprise at least one secondary cavity formed in the raised cradle-support surfacing. Further, the outer peripheral edge of the raised peripheral boundary portion may preferably comprise a dorsal panel-receiving portion and laterally opposed panel-guide portions. The dorsal panel-receiving portion is preferably recessed relative to the laterally opposed panel-guide portions for structurally accommodating a panel thickness of the cradle-to-cover connection panel assembly when in the closed case configuration such that an outer dorsal edging of the closed case configuration is substantially flush at the laterally opposed guide portions.

Certain case assemblies according to the present invention may be said to further provide a C-shaped raised peripheral boundary portion wherein the C-shape of the peripheral boundary portion extends in a first dimension and a second dimension. The C-shaped raised peripheral boundary portion may thus be said to include a dorsal spine section and an open ventral section such that the open ventral section enables greater access to the secondary cavities. The anterior cover portion may be obliquely angled relative to the posterior cover portion in a third dimension such that the dorsal spine section is raised in elevation relative to ventral portions of the raised peripheral boundary portion. The obliquely angled anterior cover portion basically functions to support the cradle in a non-horizontal orientation relative to a horizontal support surface when in the closed case configuration.

Other objects of the present invention, as well as particular features, elements, and advantages thereof, will be elucidated or become apparent from, the following description and the accompanying drawing figures.

BRIEF DESCRIPTION OF THE DRAWINGS

Other features and objectives of the invention will become more evident from a consideration of the following brief descriptions of patent drawings:

FIG. 86 is an anterior plan view of a fourth alternative raised peripheral boundary portion of the third alternative basal cover ensemble of the third alternative case assembly according to the present invention.

DETAILED DESCRIPTION OF THE PREFERRED EMBODIMENTS

Figure 33:
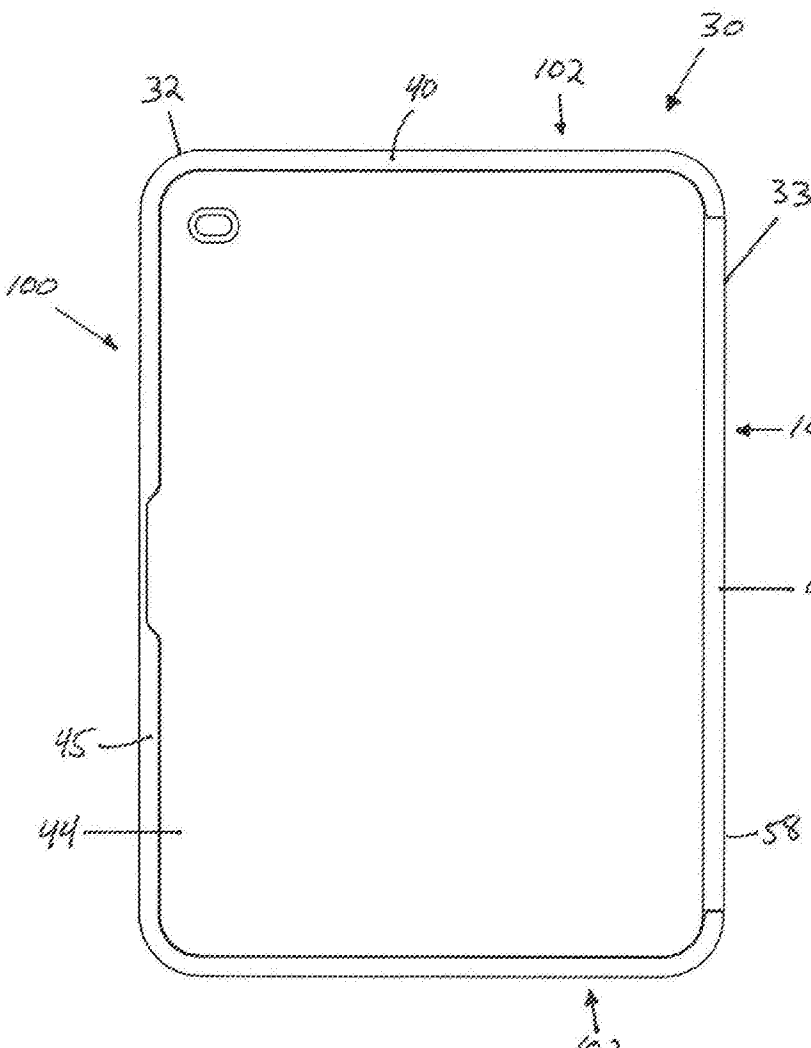
FIG. 33 is a first anterior plan view of a first alternative case assembly according to the present invention showing the case assembly in a closed case configuration.
Figure 36:
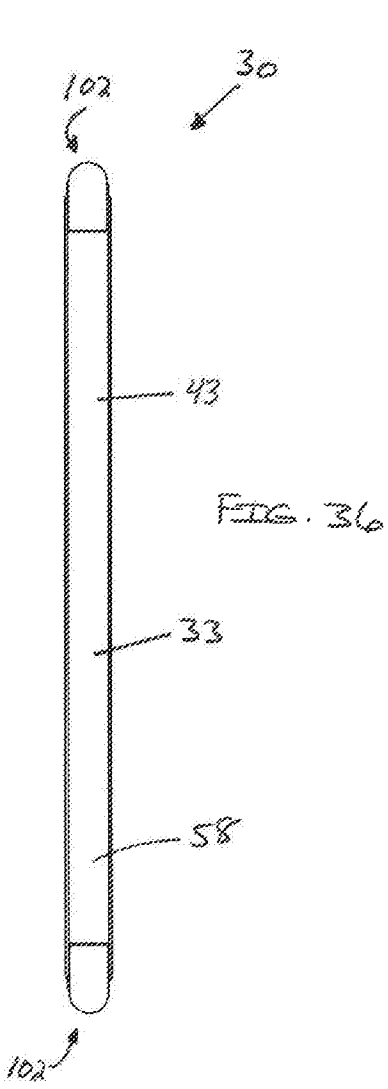
FIG. 36 is a dorsal edge view of the first alternative case assembly according to the present invention showing the case assembly in the closed case configuration.
Figure 35:
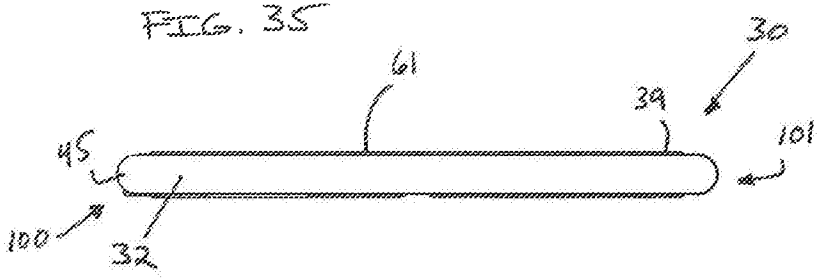
FIG. 35 is a first lateral edge view of the first alternative case assembly according to the present invention showing the case assembly in the closed case configuration.
Figure 37:
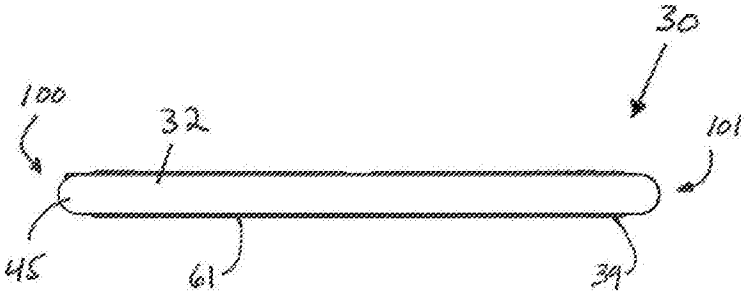
FIG. 37 is a second lateral edge view of the first alternative case assembly according to the present invention showing the case assembly in the closed case configuration.
Figure 38:
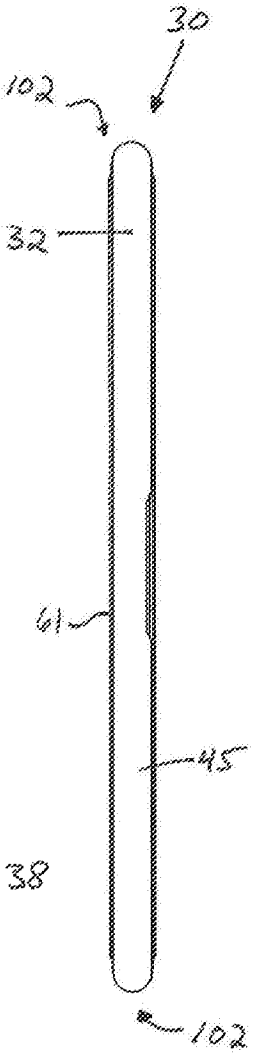
FIG. 38 is a ventral edge view of the first alternative case assembly according to the present invention showing the case assembly in the closed case configuration.
Figure 40:
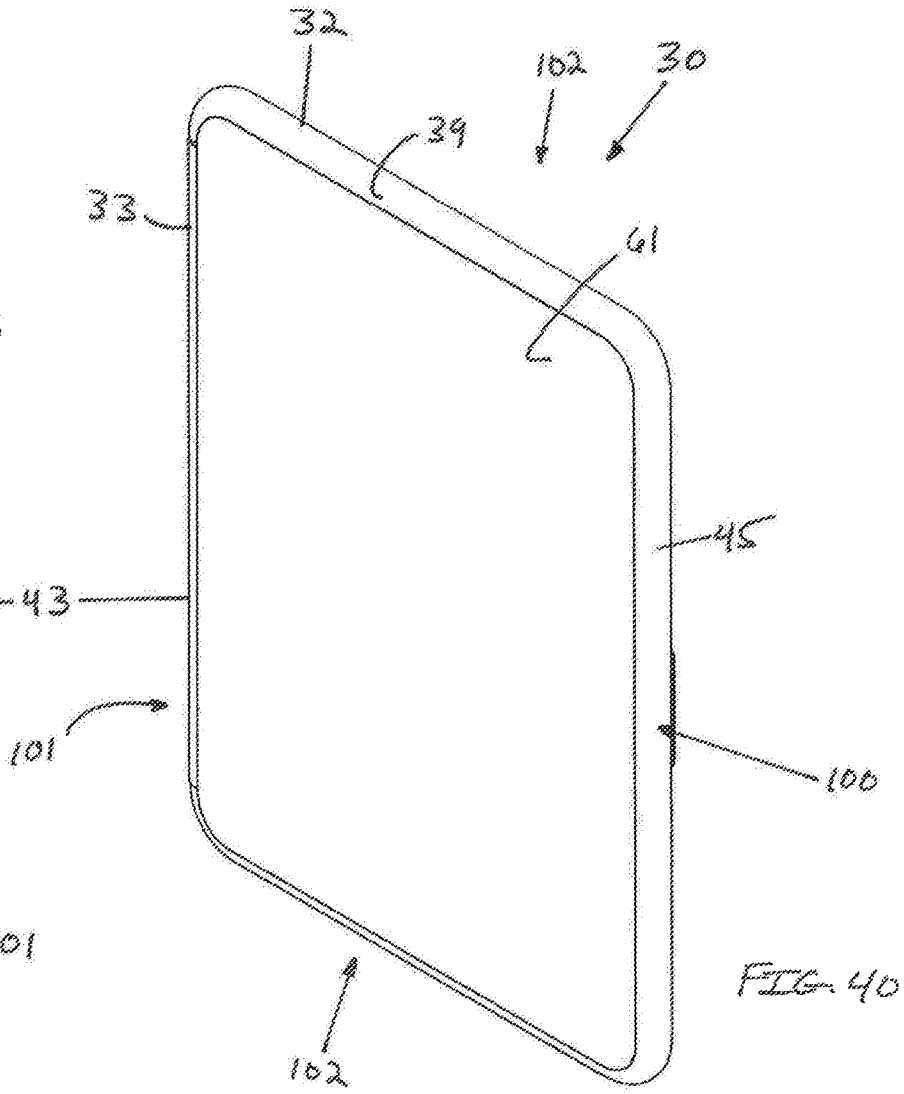
FIG. 40 is a posterior perspective view of the first alternative case assembly according to the present invention showing the case assembly in the closed case configuration.
Figure 39:
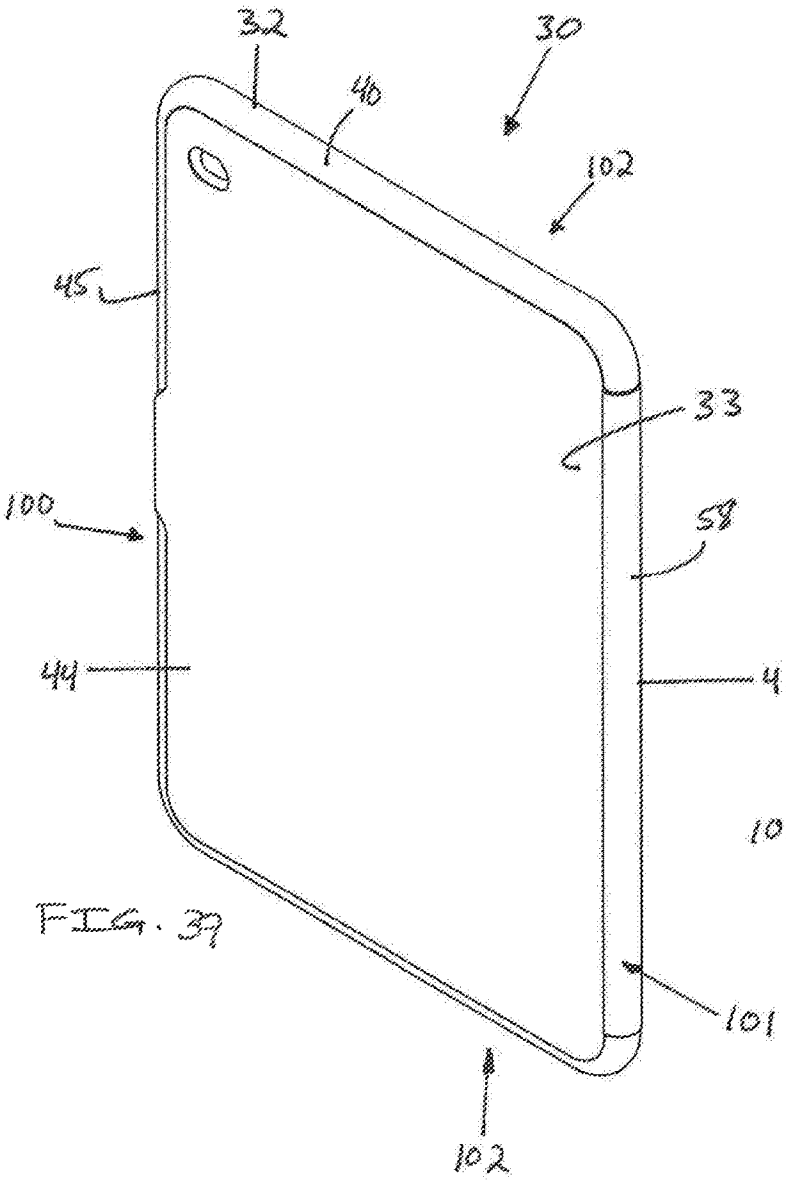
FIG. 39 is an anterior perspective view of the first alternative case assembly according to the present invention showing the case assembly in the closed case configuration.
Figures 41, 41A:
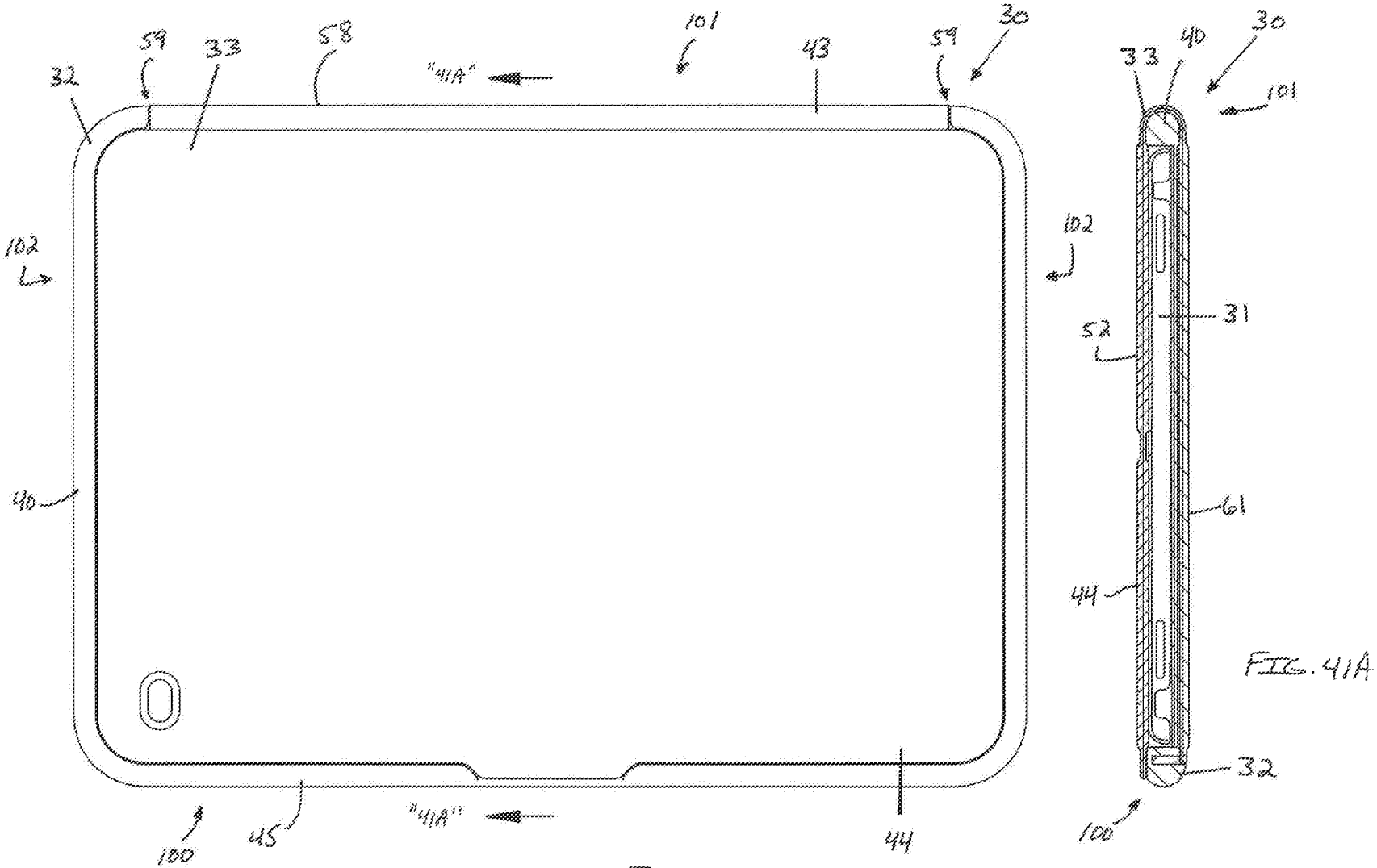
FIG. 41 is a second, enlarged, anterior plan view of the first alternative case assembly according to the present invention showing the case assembly in the closed case configuration.
FIG. 41A is a first, medial cross-sectional view of the first alternative case assembly according to the present invention as sectioned from FIG. 41 to show internal structural relationships of the closed case configuration.
Figure 42:
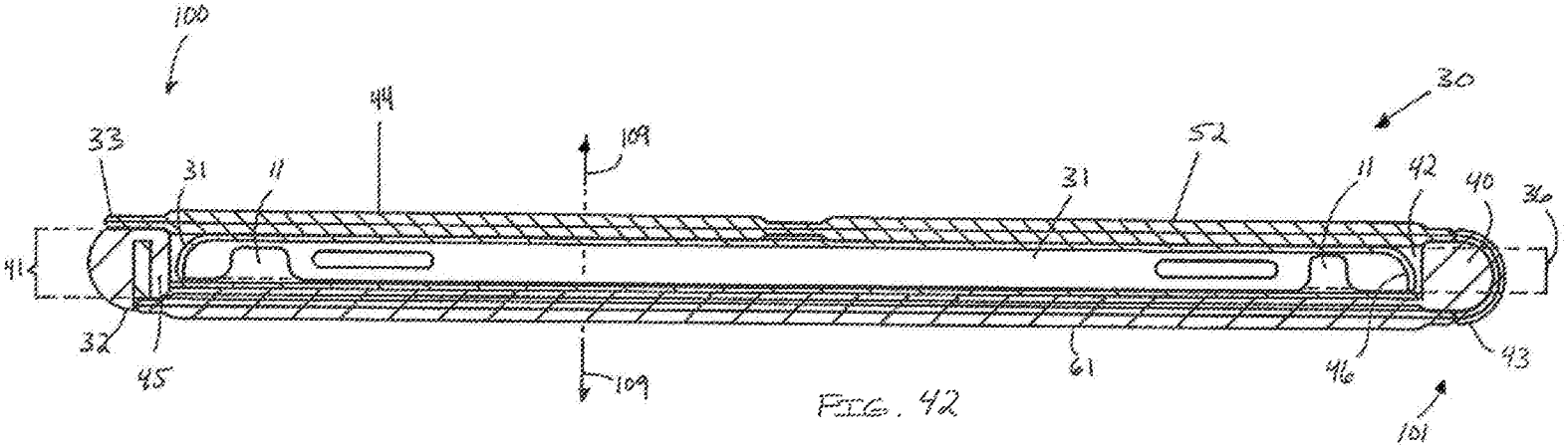
FIG. 42 is a second, enlarged, medial cross-sectional view of the first alternative case assembly according to the present invention as enlarged from FIG. 41A to show in greater detail the internal structural relationships of the closed case configuration.
Figure 88:
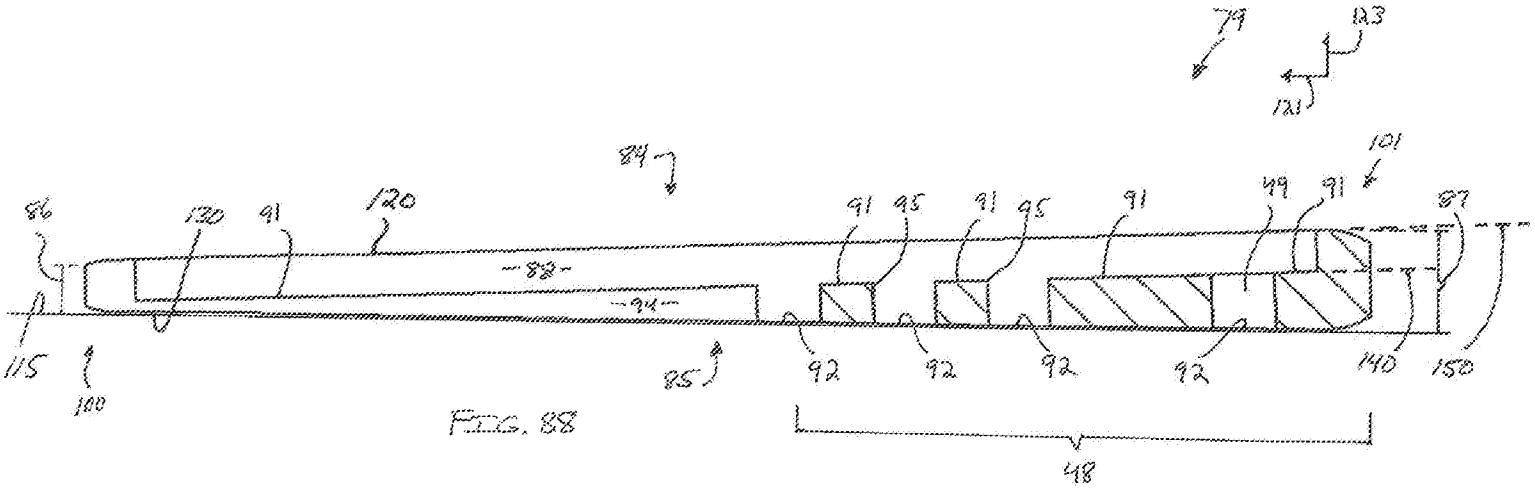
FIG. 88 is a second, enlarged, medial cross-sectional view of the fourth alternative raised peripheral boundary portion of the third alternative basal cover ensemble of the third alternative case assembly according to the present invention as enlarged from FIG. 86A to show in greater detail the medial cross-sectional details of the fourth alternative raised peripheral boundary portion.

Referring now to the drawings with more specificity, in view of the foregoing brief descriptions, it will be understood that the present invention preferably provides certain sleeve assemblies or constructions for selectively covering, encasing, and/or protecting an electronic device as at 11. The sleeve assemblies according to the present invention are generally and variously depicted in FIGS. 1-32. It will be further understood that the present invention provides certain case assemblies or constructions for selectively covering, encasing, protecting and displaying an electronic device 11 as generally and variously depicted in FIGS. 33-88. All embodiments according to the present invention preferably comprise key components formed from materials having relatively high impact-resistance or toughness as may be preferably exemplified by Ethylene Vinyl Acetate or EVA.

Figure 14:
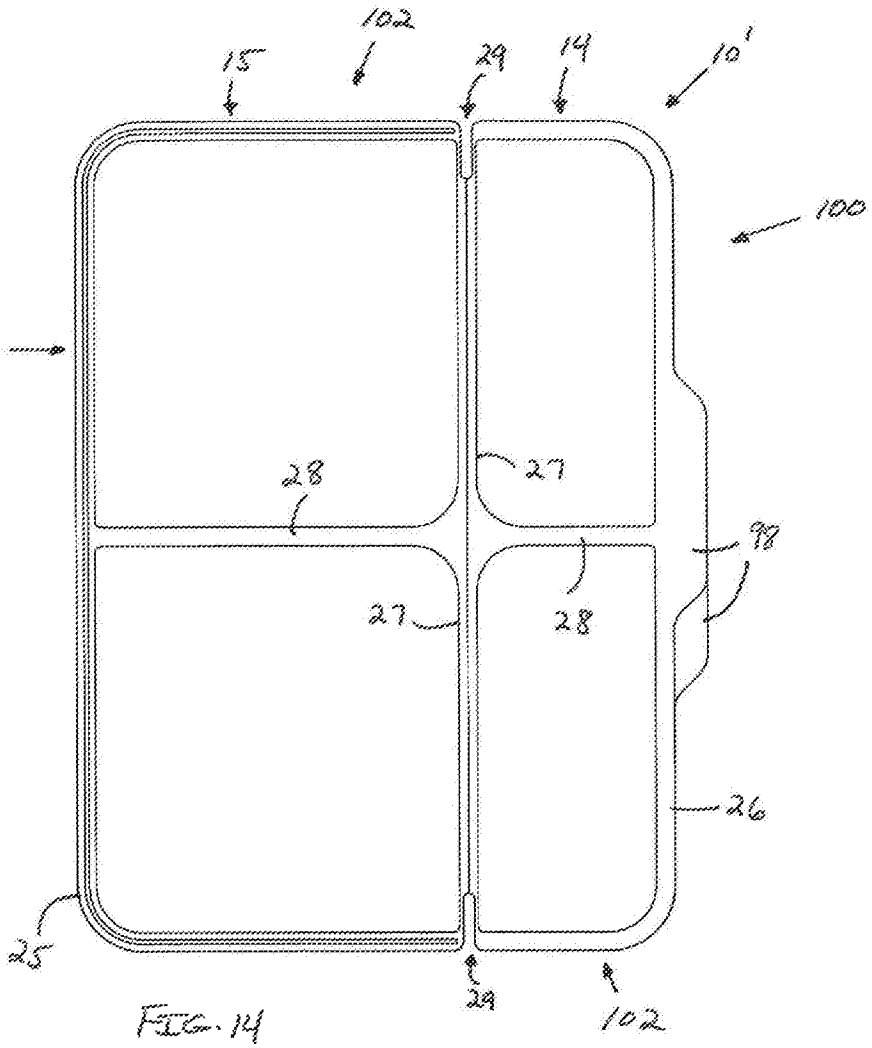
FIG. 14 is a plan view of a second side of the second alternative sleeve assembly according to the present invention showing the sleeve assembly in the closed sleeve configuration.
Figure 13:
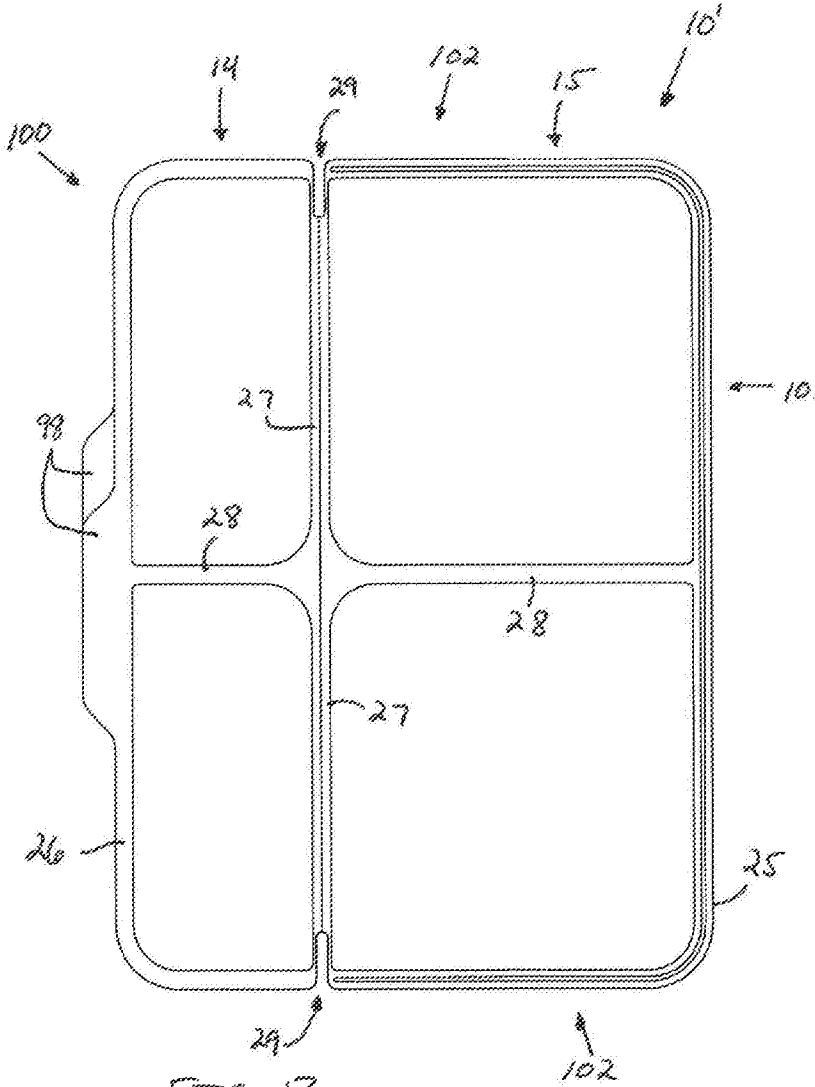
FIG. 13 is a plan view of a first side of a second alternative sleeve assembly according to the present invention showing the sleeve assembly in a closed sleeve configuration.
Figure 16:
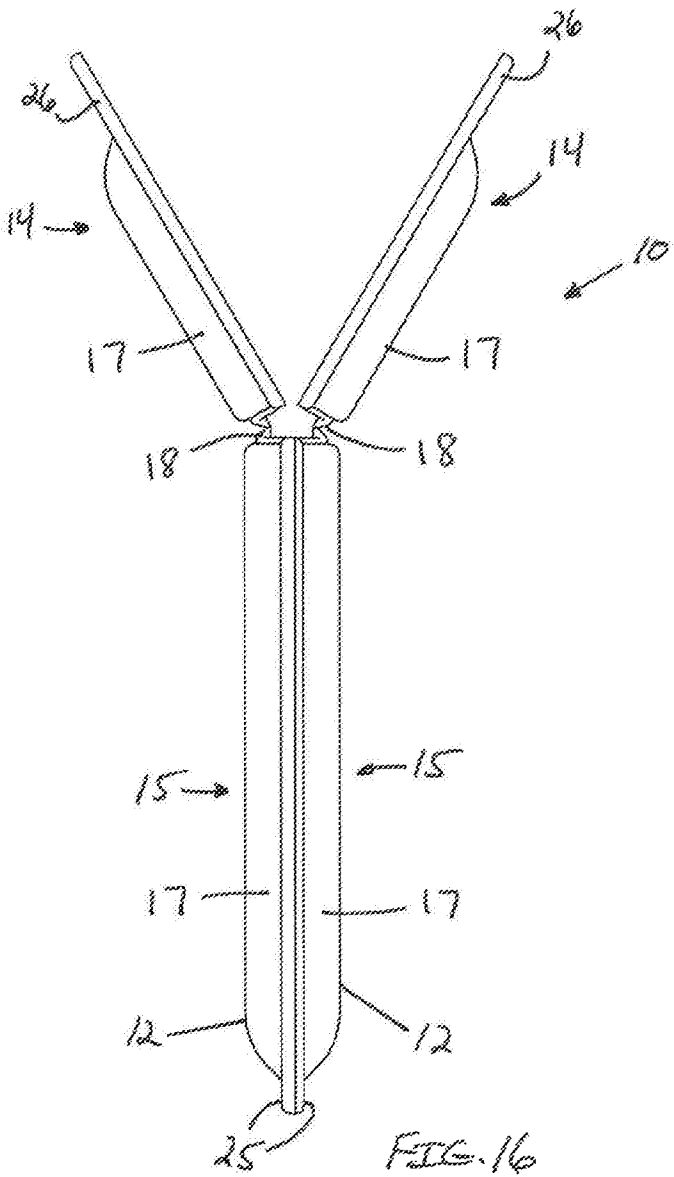
FIG. 16 is a fifth lateral edge view of the first alternative sleeve assembly according to the present invention showing the sleeve assembly in an open sleeve configuration.
Figure 15:
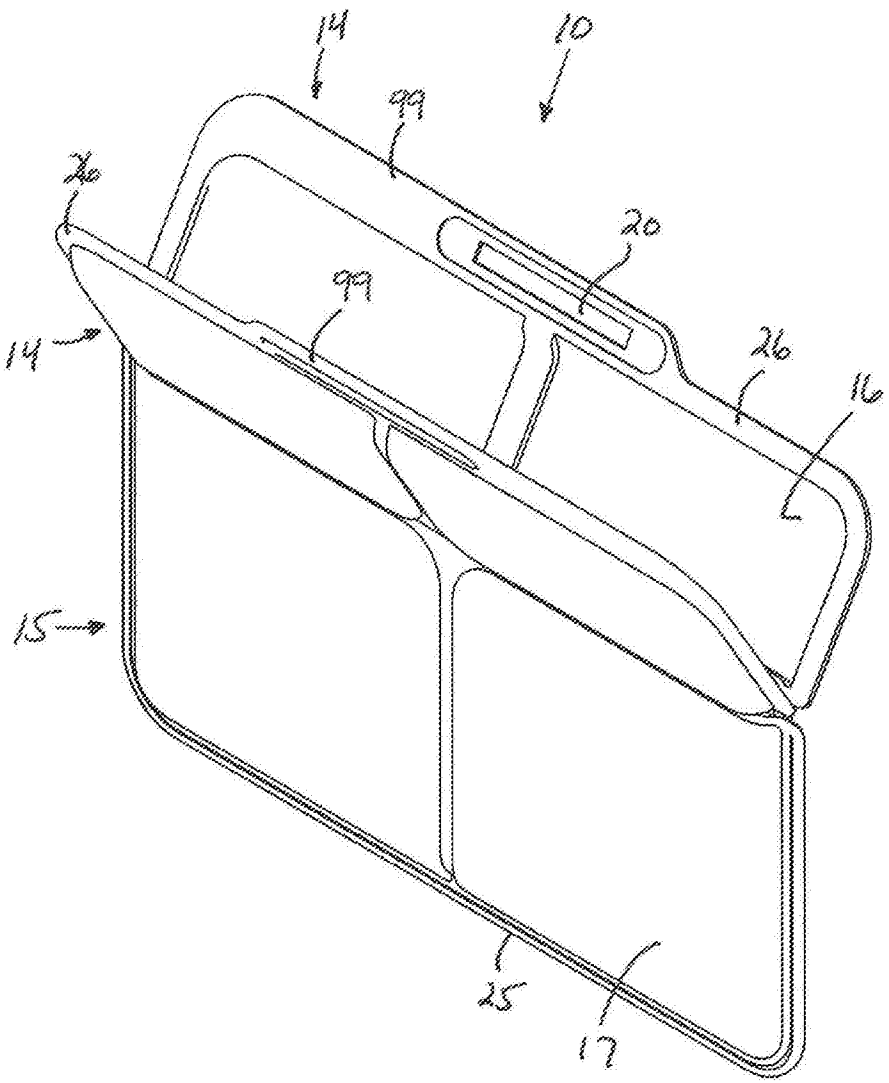
FIG. 15 is second ventral perspective view of the first alternative sleeve assembly according to the present invention showing the sleeve assembly in an open sleeve configuration.
Figure 17:
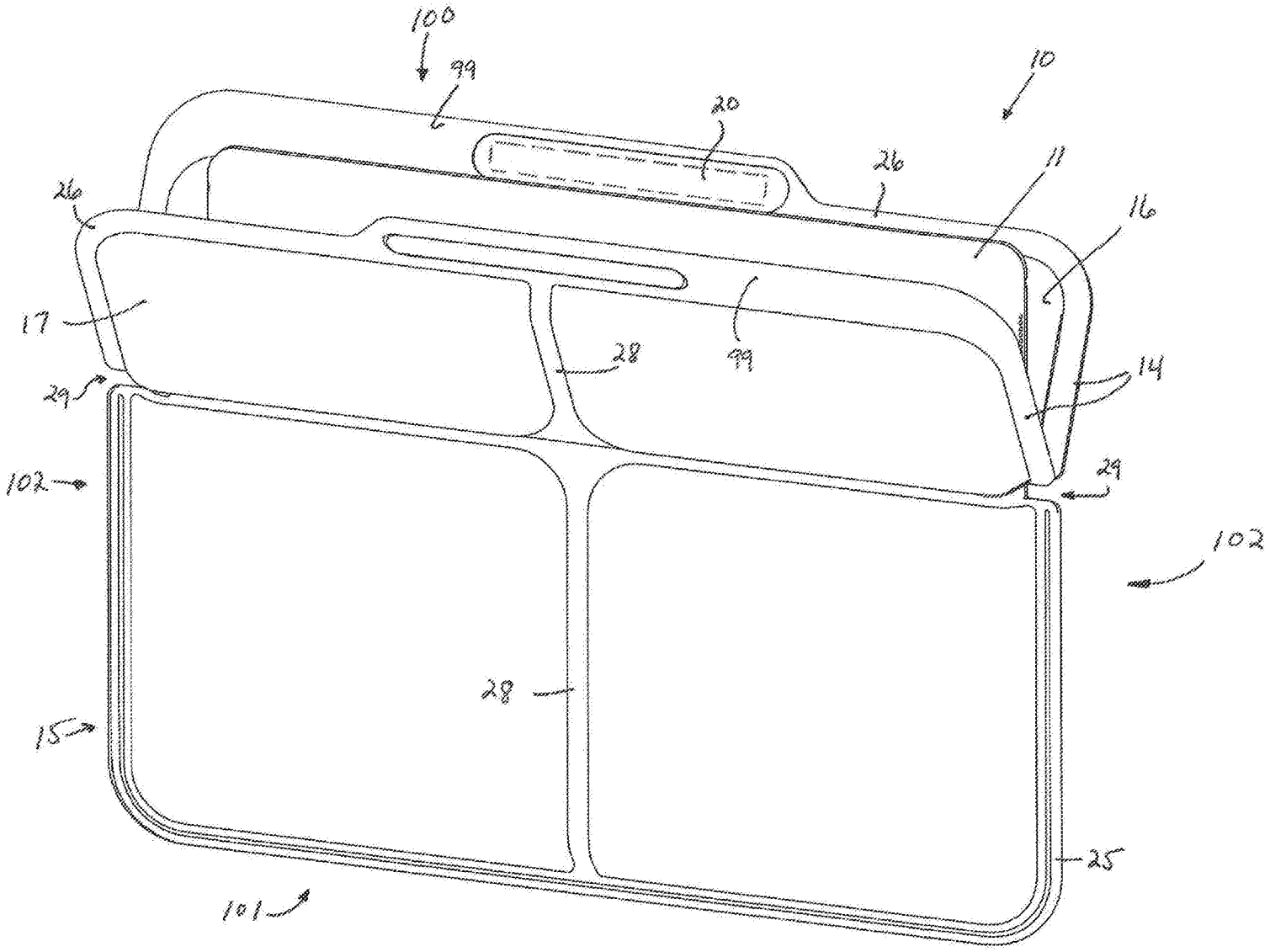
FIG. 17 is third ventral perspective view of the first alternative sleeve assembly according to the present invention showing the sleeve assembly in an open sleeve configuration with an electronic device being received into a device-receiving volume of the sleeve assembly.

A first alternative sleeve construction or assembly 10 according to the present invention is generally depicted and referenced in FIGS. 1-28. A slightly modified version of the first alternative sleeve assembly is depicted in FIGS. 13 and 14. FIGS. 13 and 14 depict a modified tab arrangement at the ventral side or edge 100 of the assembly referenced at 10'. Sleeve assembly 10' preferably comprises abbreviated ⅓—length ventral side tabs 98 as compared to ⅔ length ventral side tabs 99 for sleeve assembly 10. A second alternative sleeve construction or assembly according to the present invention comprises or provides an alternative panel arrangement for each sleeve half shell, which alternative panel arrangements are generally depicted and referenced in FIGS. 29-32.

More particularly, each of the sleeve assemblies according to the present invention preferably comprise first and second, substantially identical, segmented-sleeve half shells as at 12 in the first alternative embodiment of the sleeve assemblies 10 and 10'; and as at 13 in the second alternative embodiment of the sleeve assembly according to the present invention. Only the half shells 13 of the second alternative embodiment of the sleeve assembly have been illustrated for enhancing the conciseness of description. Each of the half shells 12 and 13 preferably comprise a dorsal side or edge as generally referenced at 101; a ventral side or edge as at 100; laterally opposed portions sides or edges as at 102; a shell length 103 intermediate the laterally opposed sides 102; and a shell width 104 intermediate the dorsal and ventral sides 101 and 100.

Each of the segmented-sleeve half shells 12 and 13 are preferably constructed from or comprise Ethylene Vinyl Acetate or EVA and include a dorsal section or portion 15, a ventral section or portion 14, a device-opposing internal sleeve contour or surfacing 16, and an environment-opposing external sleeve contour or surfacing 17. The ventral sections or portions 14 are pivotally or hingedly attached to the dorsal sections or portions 15. In this regard, it is contemplated that living hinge mechanisms 18 preferably pivotally attach the ventral sections 14 to the dorsal sections 15. Each internal device-opposing sleeve contour or surfacing 16 is preferably shaped to receive and resiliently engage a corresponding outer half or contour of the electronic device 11 and each environment-opposing external sleeve contour or surface 17 preferably defines or comprises an exterior surface plane as at 105.

The first and second ventral sections 14 are pivotally and respectively attached to the first and second dorsal sections 15 at opposed flange junctions 27 comprising exemplary living hinge mechanisms 18. The opposed flange junctions 27 extend in opposed junction planes 107 parallel to and intermediate the first and second exterior surface planes 105 when the outer ventral section flanges 26 are separably attached to one another. The opposed flange junctions 27 preferably extend in the opposed junction planes 107 as such for resiliently contacting opposite sides of the electronic device 11 as received in the device-receiving volume defined by the internal device-opposing sleeve contour or surfacing 16 of each shell 12 or 13. The opposed flange junctions 27 thus prevent movement of the electronic device 11 (in the bi-direction(s) 109) within the device-receiving volume, which device-receiving volume may be defined by the sum total of the device-receiving ventral volume as at 22 and the device-receiving dorsal volume as at 21.

Figures 1, 2:
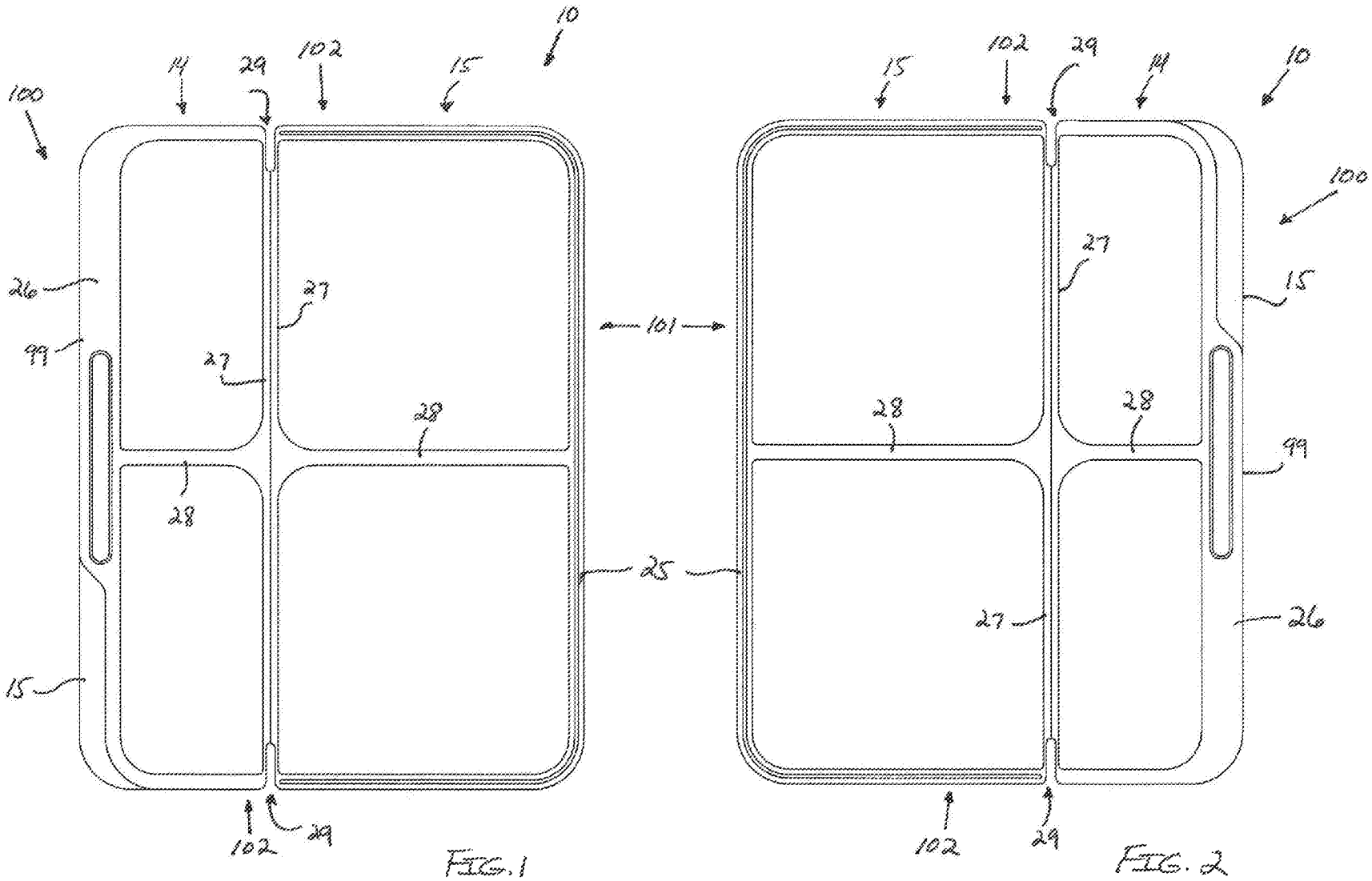
FIG. 1 is a plan view of a first side of a first alternative sleeve assembly according to the present invention showing the sleeve assembly in a closed sleeve configuration.
FIG. 2 is a plan view of a second side of the first alternative sleeve assembly according to the present invention showing the sleeve assembly in the closed sleeve configuration.
Figures 3, 4, 5, 6:
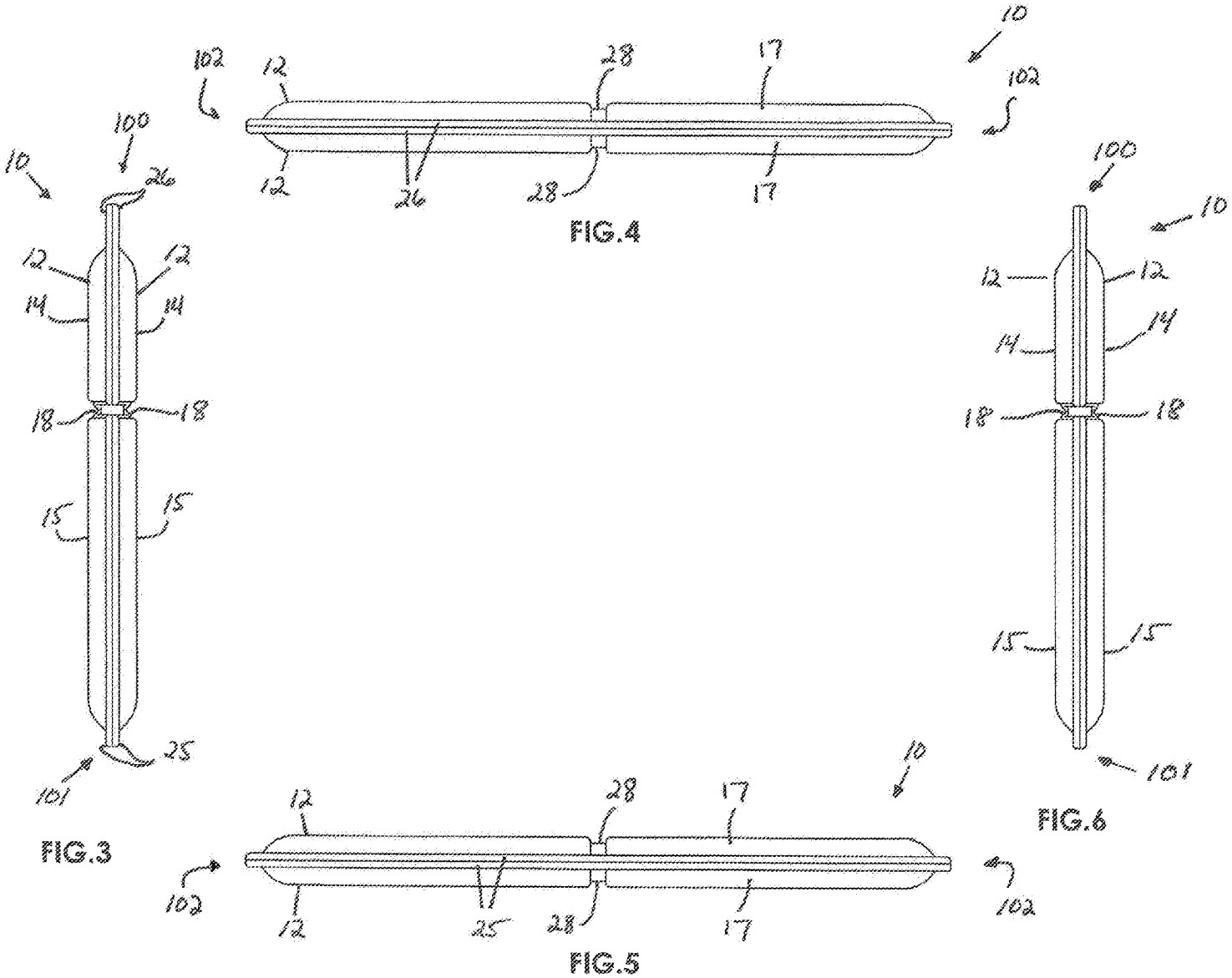
FIG. 3 is a first lateral edge view of the first alternative sleeve assembly according to the present invention showing the sleeve assembly in the closed sleeve configuration.
FIG. 4 is a first ventral edge view of the first alternative sleeve assembly according to the present invention showing the sleeve assembly in the closed sleeve configuration.
FIG. 5 is a first dorsal edge view of the first alternative sleeve assembly according to the present invention showing the sleeve assembly in the closed sleeve configuration.
FIG. 6 is a second lateral edge view of the first alternative sleeve assembly according to the present invention showing the sleeve assembly in the closed sleeve configuration.
Figure 7:
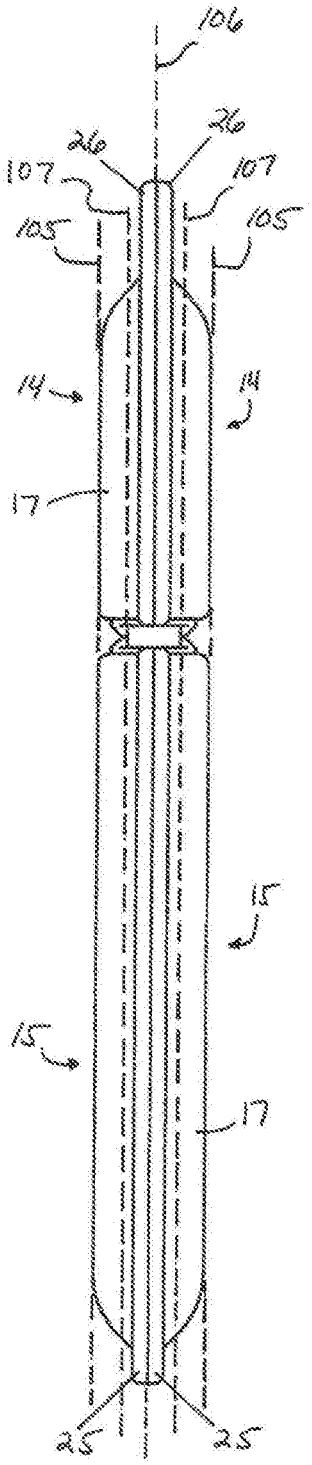
FIG. 7 is an enlarged third lateral edge view of the first alternative sleeve assembly according to the present invention showing various planar relationships of the sleeve assembly and showing the sleeve assembly in a closed sleeve configuration.
Figure 7A:
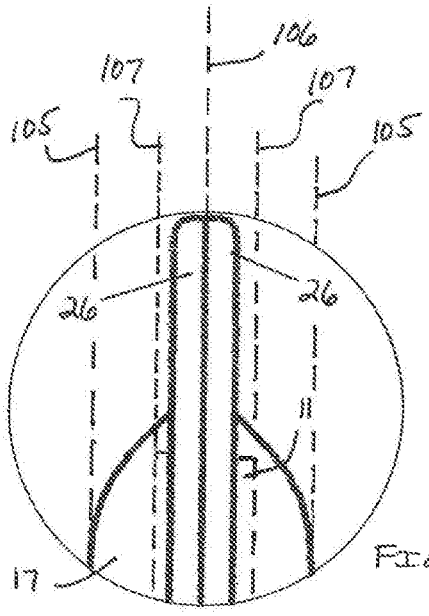
FIG. 7A is an enlarged, fragmentary sectional view as sectioned from upper ventral portions of the first alternative sleeve assembly as otherwise depicted in FIG. 7.
Figure 7B:
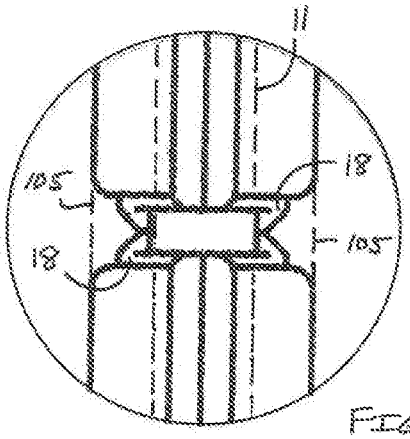
FIG. 7B is an enlarged, fragmentary sectional view as sectioned from central, ventral-to-dorsal junction site portions of the first alternative sleeve assembly as otherwise depicted in FIG. 7.
Figure 7C:
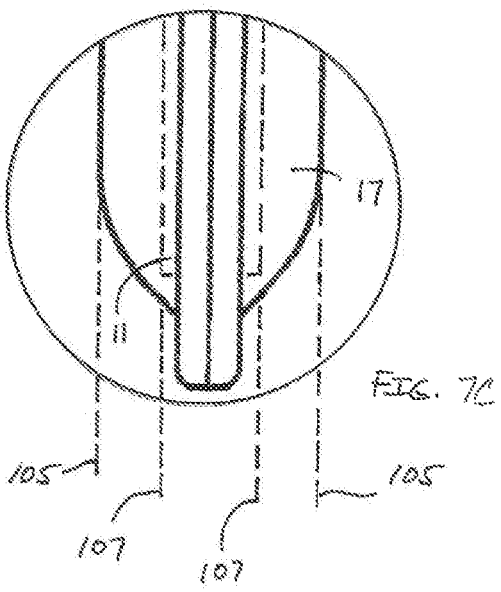
FIG. 7C is an enlarged, fragmentary sectional view as sectioned from lower dorsal portions of the first alternative sleeve assembly as otherwise depicted in FIG. 7.
Figure 8:
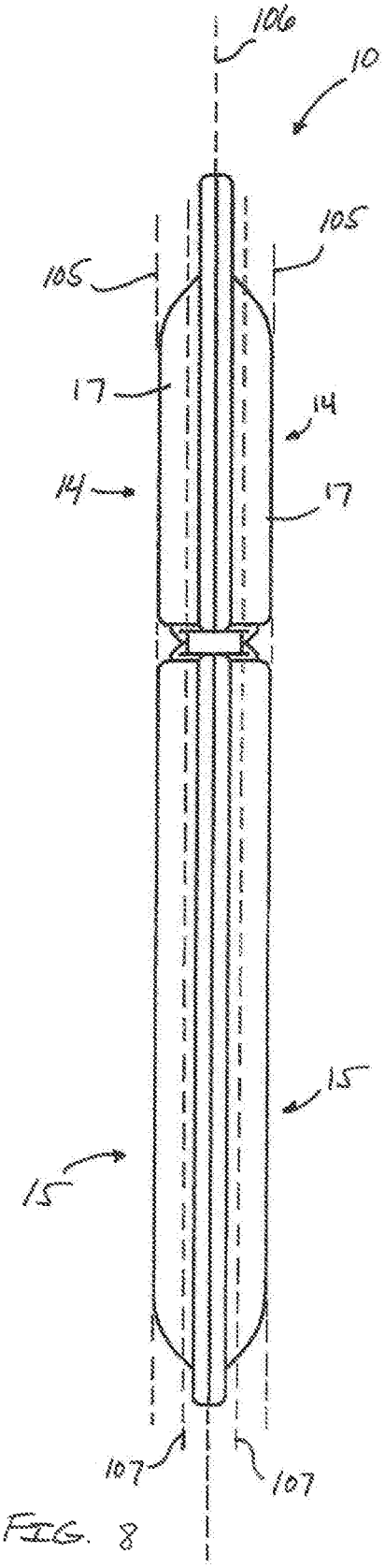
FIG. 8 is an enlarged fourth lateral edge view of the first alternative sleeve assembly according to the present invention showing various planar relationships of the sleeve assembly and showing the sleeve assembly in a closed sleeve configuration.
Figure 8A:
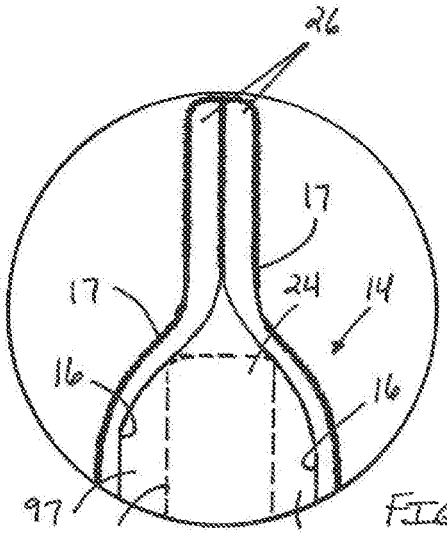
FIG. 8A is an enlarged, fragmentary diagrammatic depiction of internal structures of upper ventral portions of the first alternative sleeve assembly as otherwise depicted in FIG. 8, phantom edging of an electronic device being depicted in engagement with internal surfacing of the sleeve assembly for preventing movement of the electronic device at upper ventral portions of the first alternative sleeve assembly.
Figure 8B:
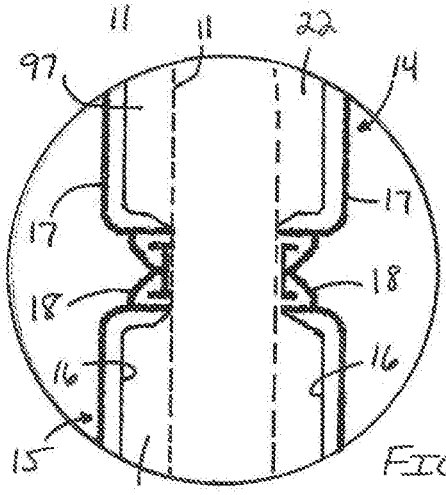
FIG. 8B is an enlarged, fragmentary diagrammatic depiction of internal structures of central, ventral-to-dorsal junction site portions of the first alternative sleeve assembly as otherwise depicted in FIG. 8, phantom edging of an electronic device being depicted in engagement with first flange junctions of the sleeve assembly for preventing movement of the electronic device at ventral-to-dorsal junction site portions of the first alternative sleeve assembly.
Figure 8C:
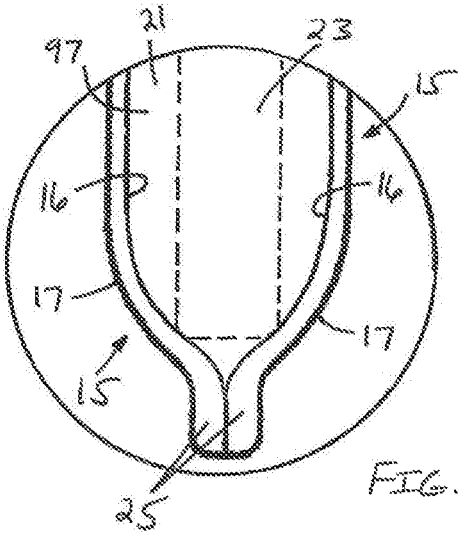
FIG. 8C is an enlarged, fragmentary diagrammatic depiction of internal structures of lower dorsal portions of the first alternative sleeve assembly as otherwise depicted in FIG. 8, phantom edging of an electronic device being depicted in engagement with internal surfacing of the sleeve assembly for preventing movement of the electronic device at lower dorsal portions of the first alternative sleeve assembly.
Figures 9, 9A, 9B, 9C:
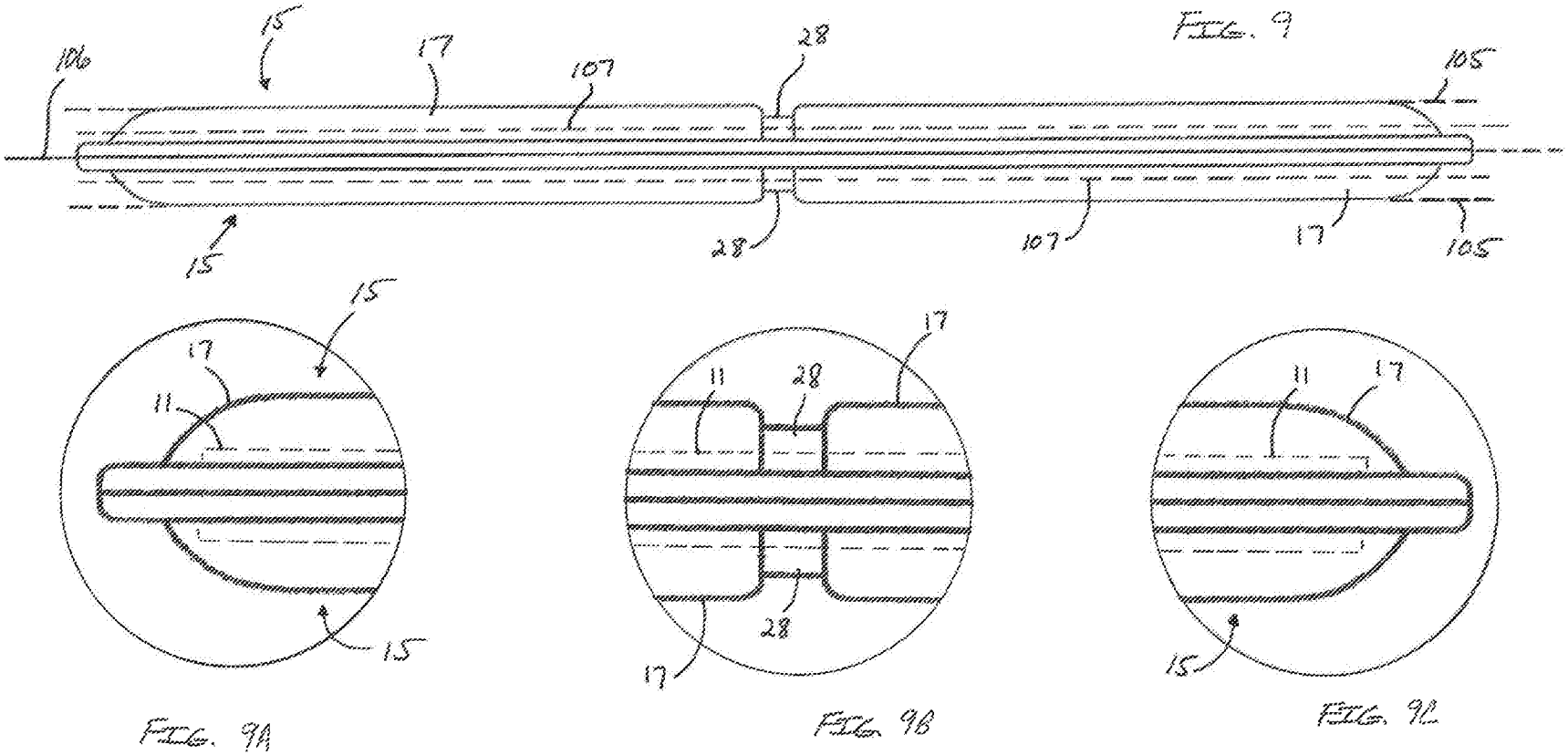
FIG. 9 is an enlarged second dorsal edge view of the first alternative sleeve assembly according to the present invention showing various planar relationships of the sleeve assembly and showing the sleeve assembly in a closed sleeve configuration.
FIG. 9A is an enlarged, fragmentary sectional view as sectioned from left lateral portions of the first alternative sleeve assembly as otherwise depicted in FIG. 9, a left lateral portion of a hidden electronic device being therein depicted.
FIG. 9B is an enlarged, fragmentary sectional view as sectioned from central, left-to-right lateral half junction site portions of the first alternative sleeve assembly as otherwise depicted in FIG. 9, a central portion of a hidden electronic device being therein depicted.
FIG. 9C is an enlarged, fragmentary sectional view as sectioned from right lateral portions of the first alternative sleeve assembly as otherwise depicted in FIG. 9 a right lateral portion of a hidden electronic device being therein depicted.
Figure 10:
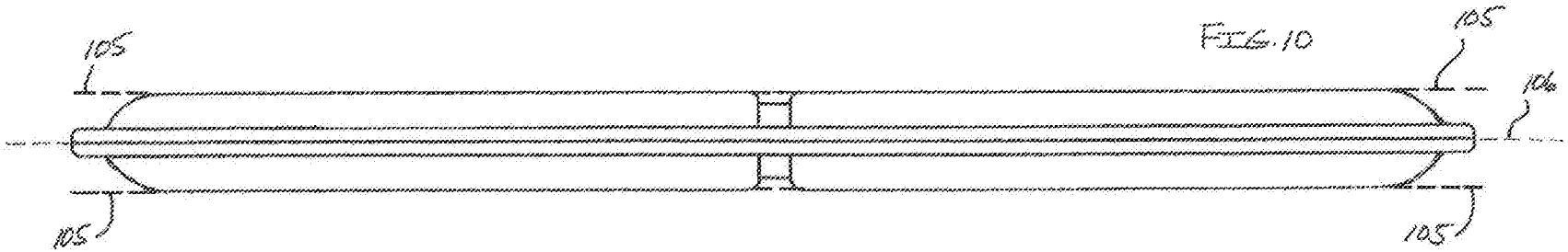
FIG. 10 is an enlarged third dorsal edge view of the first alternative sleeve assembly according to the present invention showing various planar relationships of the sleeve assembly and showing the sleeve assembly in a closed sleeve configuration.
Figure 10C:
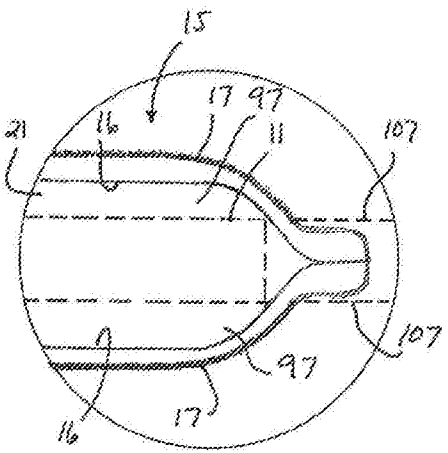
FIG. 10C is an enlarged, fragmentary diagrammatic depiction of internal structures of right lateral portions of the first alternative sleeve assembly as otherwise depicted in FIG. 10, phantom edging of an electronic device being depicted in engagement with internal surfacing of the sleeve assembly for preventing movement of the electronic device at right lateral portions of the first alternative sleeve assembly.
Figure 10B:
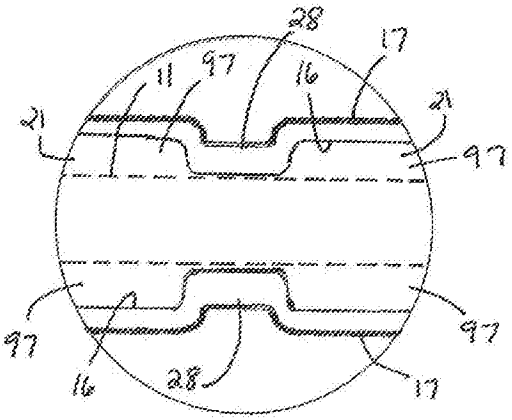
FIG. 10B is an enlarged, fragmentary diagrammatic depiction of internal structures of central, left-to-right lateral half junction site portions of the first alternative sleeve assembly as otherwise depicted in FIG. 10, phantom edging of an electronic device being depicted in engagement with second flange junctions of the sleeve assembly for preventing movement of the electronic device at medial junction site portions of the first alternative sleeve assembly.
Figure 10A:
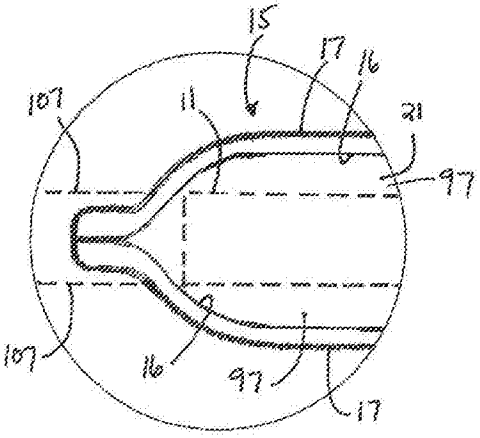
FIG. 10A is an enlarged, fragmentary diagrammatic depiction of internal structures of left lateral portions of the first alternative sleeve assembly as otherwise depicted in FIG. 10, phantom edging of an electronic device being depicted in engagement with internal surfacing of the sleeve assembly for preventing movement of the electronic device at left lateral portions of the first alternative sleeve assembly.
Figure 12:
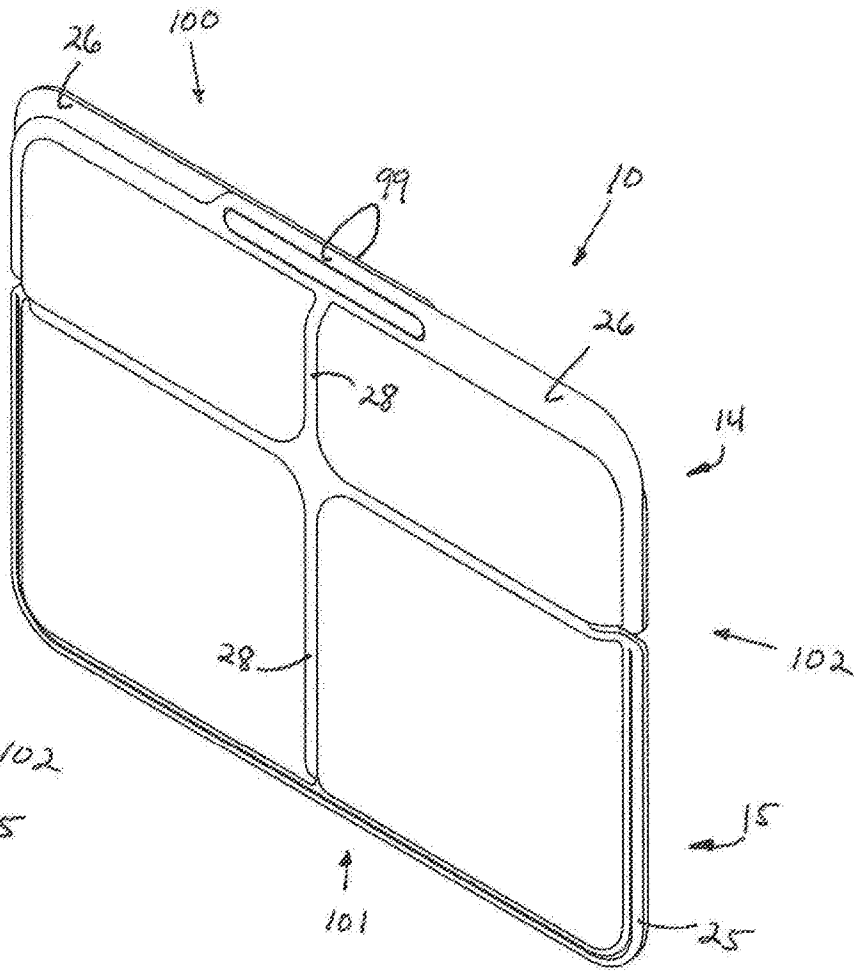
FIG. 12 is second ventral perspective view of the first alternative sleeve assembly according to the present invention showing the sleeve assembly in the closed sleeve configuration.
Figure 11:
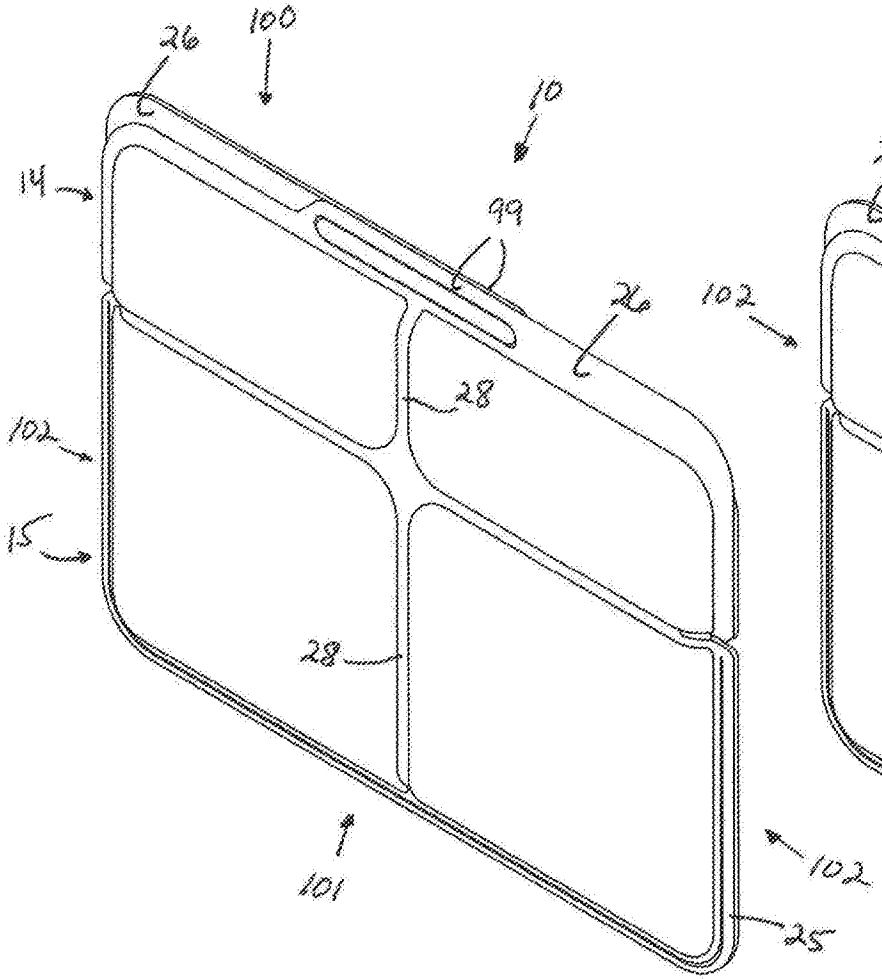
FIG. 11 is first ventral perspective view of the first alternative sleeve assembly according to the present invention showing the sleeve assembly in the closed sleeve configuration.

Noting that the opposed flange junctions or hinge mechanisms 18 extend in a first bi-direction as at 110, it is contemplated that each of the first and second segmented-sleeve half shells 12 may preferably comprise at least one secondary device support flange as at 28. Comparing the segmented-sleeve half shells 12 with the segmented-sleeve half shells 13, the reader will note that the first and second segmented-sleeve half shells 13 are devoid of secondary device support flanges 28. Each secondary device support flange 28 is preferably coplanar with a respective junction plane 107 when the outer ventral section flanges 26 are separably attached to one another. Preferably, each secondary device support flange 28 extends in a second bi-direction 111 orthogonal relative to the first bi-direction 110. The secondary device support flanges 28 also function to prevent movement of the electronic device 11 (in the bi-direction(s) 109) within the device-receiving volume by resiliently contacting opposite sides of the electronic device 11 as received in the device-receiving volume as generally depicted in FIG. 10B.

Figure 18:
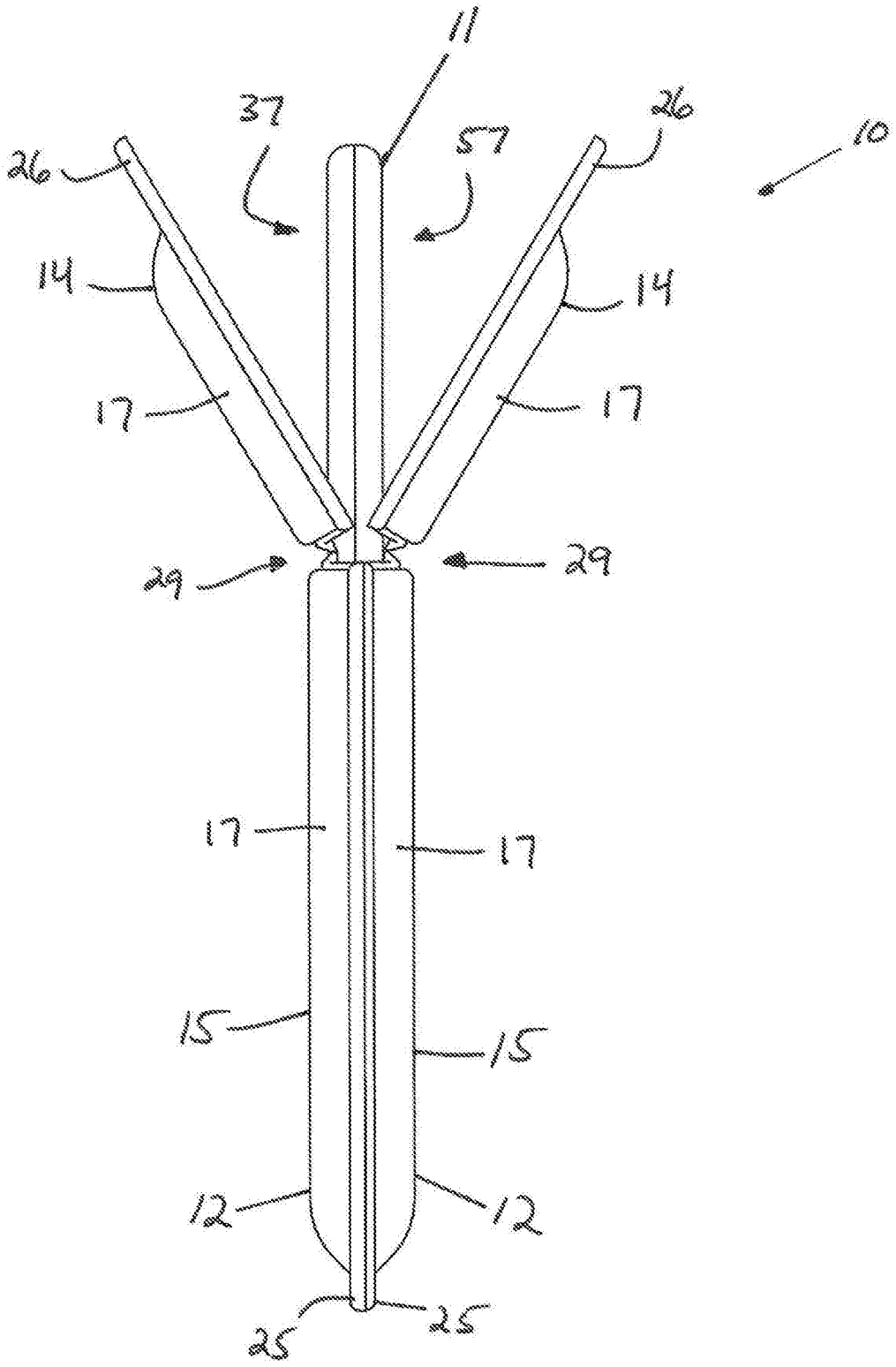
FIG. 18 is a sixth lateral edge view of the first alternative sleeve assembly according to the present invention showing the sleeve assembly in an open sleeve configuration with an electronic device being received into a device-receiving volume of the sleeve assembly.
Figure 20:
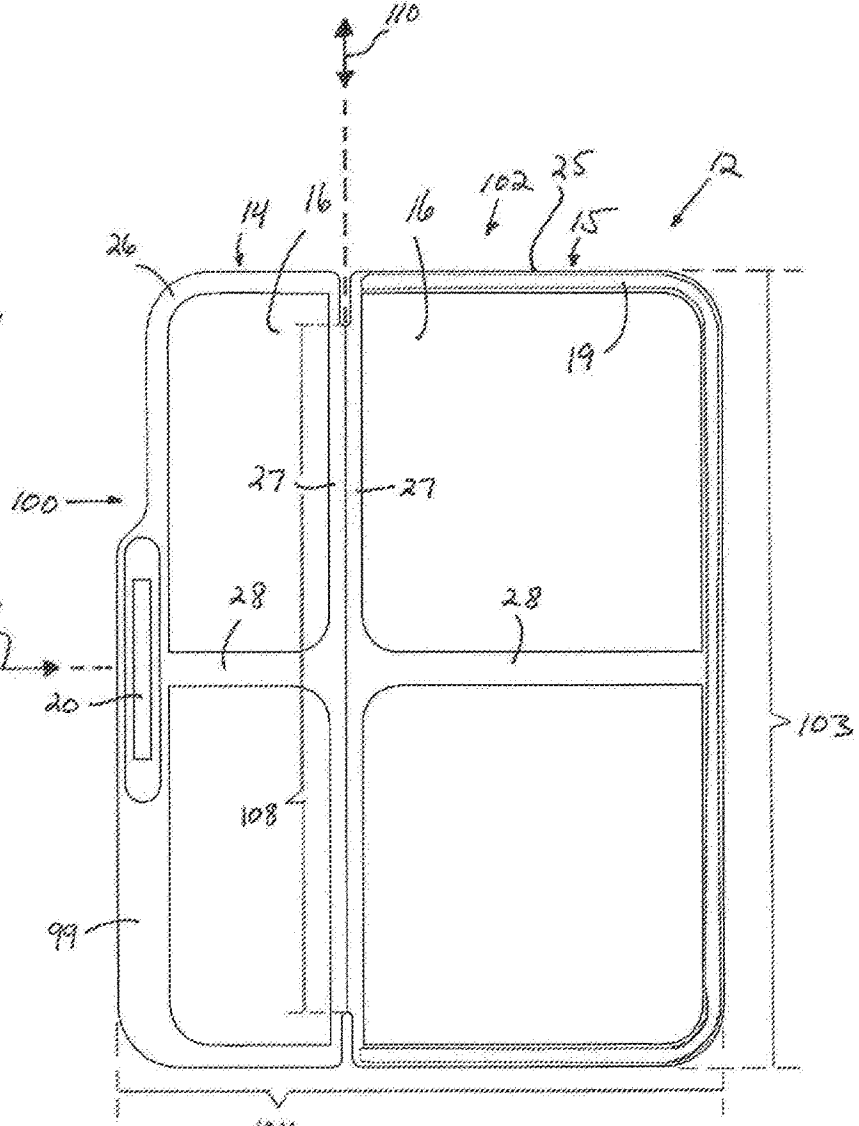
FIG. 20 is a first plan view of internal surfacing of the first segmented-sleeve half shell of the first alternative sleeve assembly according to the present invention.
Figure 19:
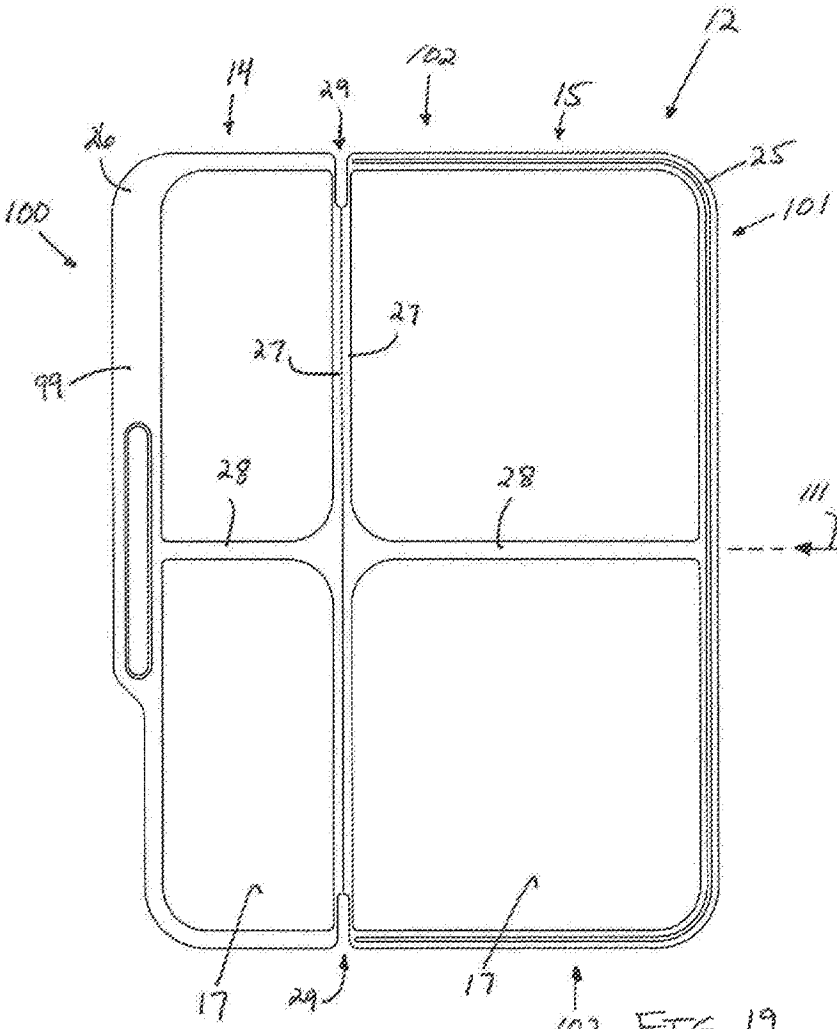
FIG. 19 is a first plan view of external surfacing of a first segmented-sleeve half shell of the first alternative sleeve assembly according to the present invention.
Figure 22:
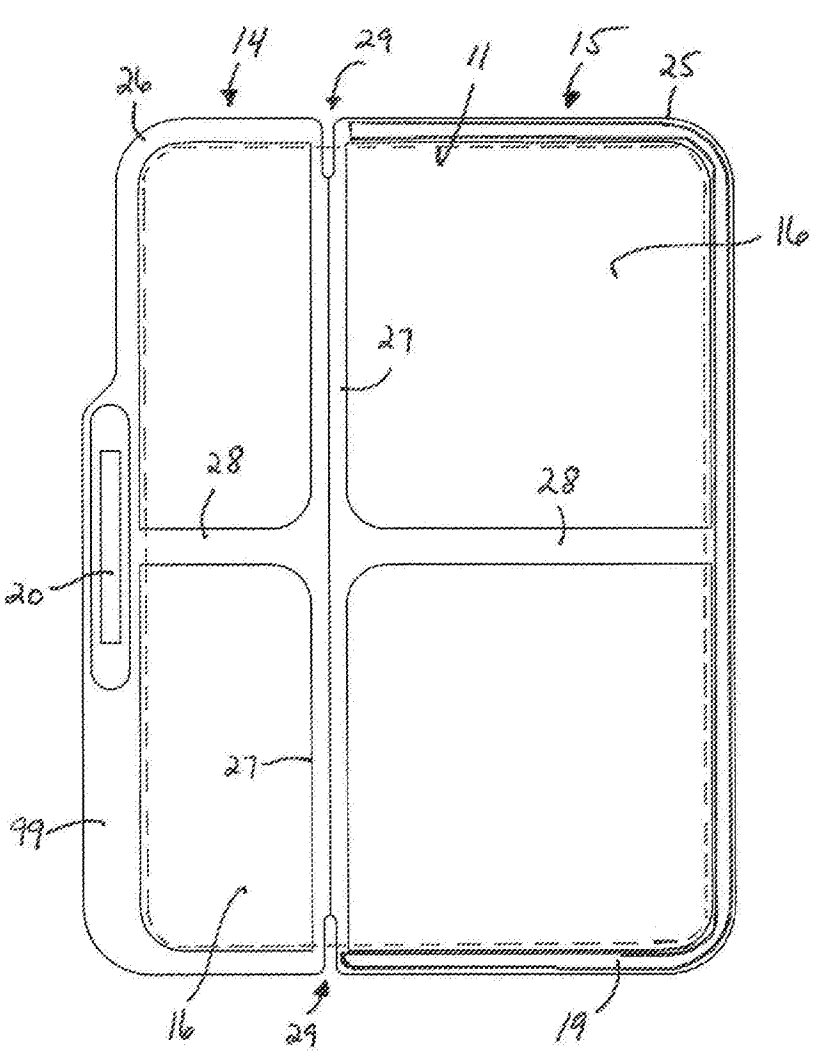
FIG. 22 is a second plan view of internal surfacing of the first segmented-sleeve half shell of the first alternative sleeve assembly according to the present invention showing a phantom electronic device positioned relative to the first segmented-sleeve half shell.
Figure 21:
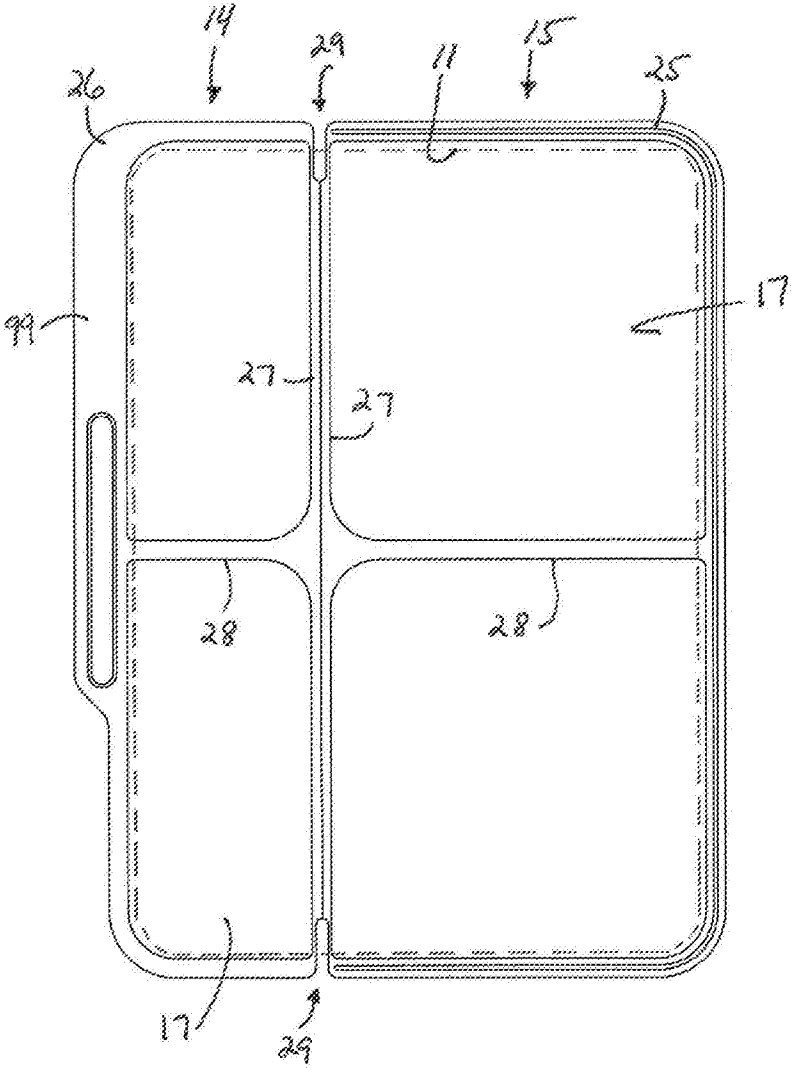
FIG. 21 is a second plan view of external surfacing of the first segmented-sleeve half shell of the first alternative sleeve assembly according to the present invention showing a phantom electronic device positioned relative to the first segmented-sleeve half shell.
Figures 23, 24, 25, 26:
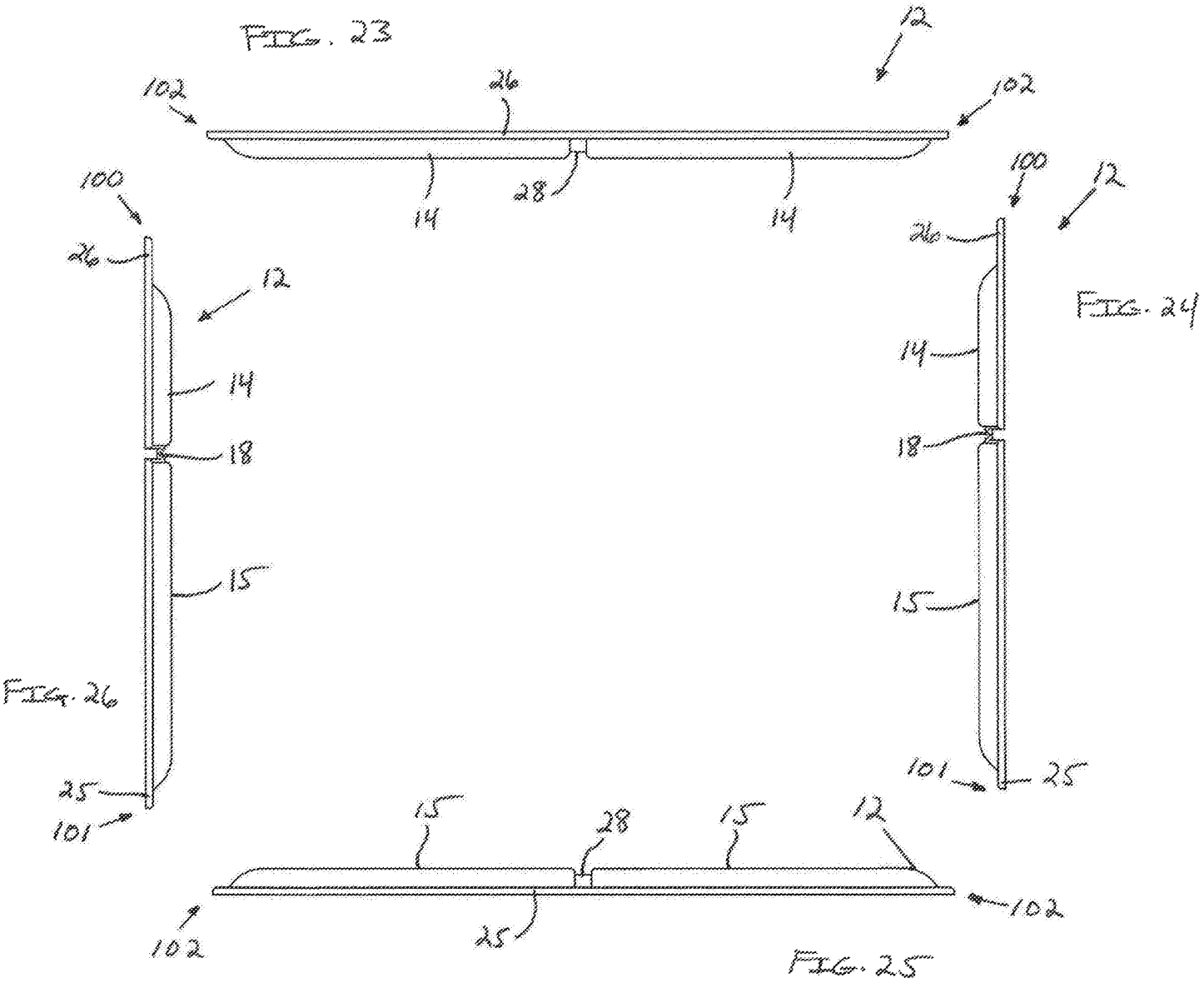
FIG. 23 is a ventral edge view of a first segmented-sleeve half shell of the first alternative sleeve assembly according to the present invention.
FIG. 24 is a first lateral edge view the first segmented-sleeve half shell of the first alternative sleeve assembly according to the present invention
FIG. 25 is a dorsal edge view of a first segmented-sleeve half shell of the first alternative sleeve assembly according to the present invention.
FIG. 26 is a second lateral edge view the first segmented-sleeve half shell of the first alternative sleeve assembly according to the present invention.
Figure 28:
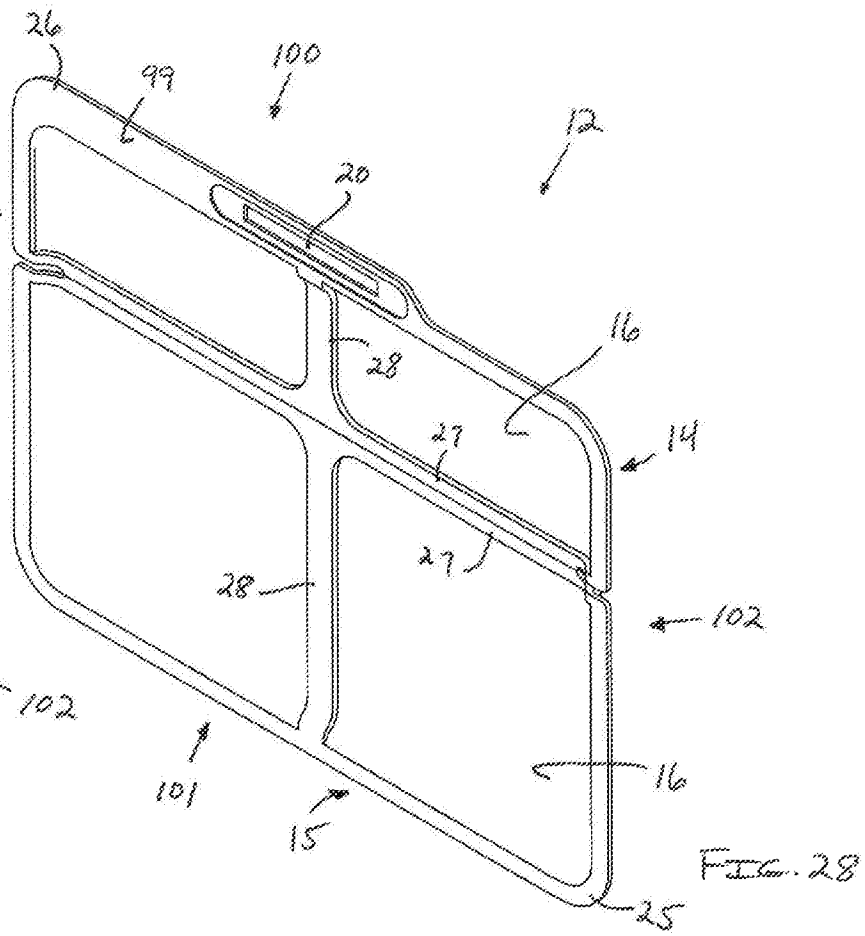
FIG. 28 is a ventral perspective view of internal surfacing of the first segmented-sleeve half shell of the first alternative sleeve assembly according to the present invention.
Figure 27:
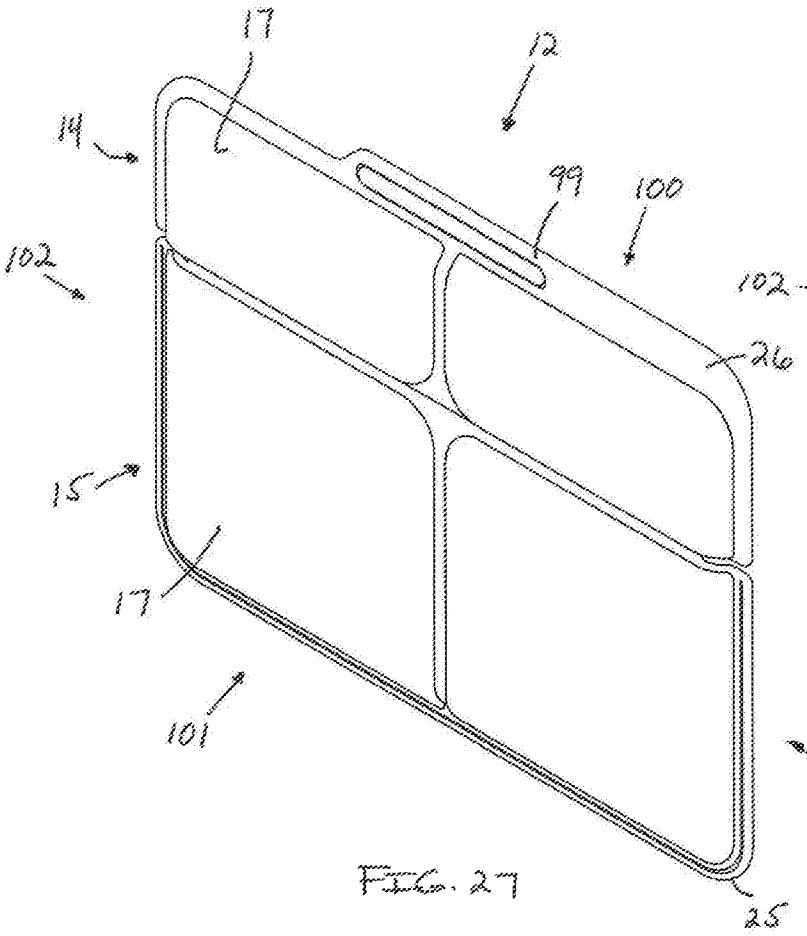
FIG. 27 is a ventral perspective view of external surfacing of the first segmented-sleeve half shell of the first alternative sleeve assembly according to the present invention.
Figure 30:
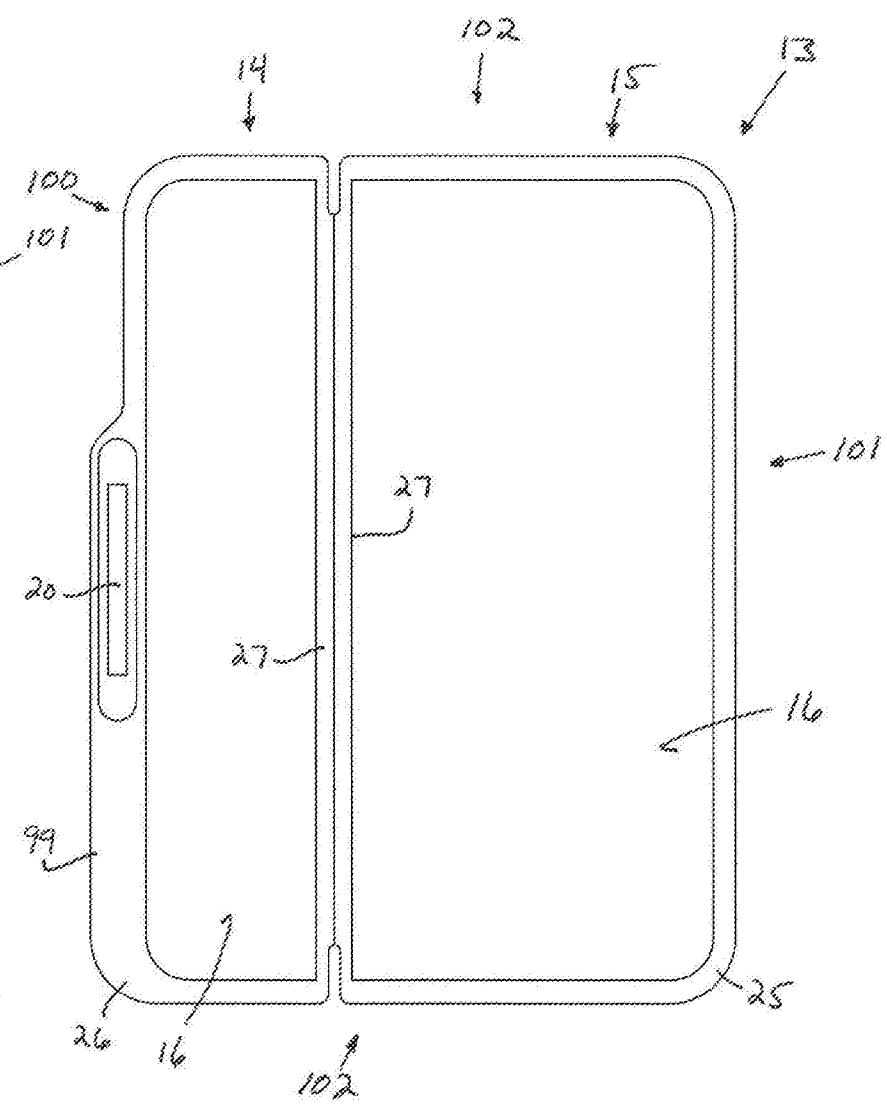
FIG. 30 is a plan view of internal surfacing of the first segmented-sleeve half shell of the third alternative sleeve assembly according to the present invention.
Figure 29:
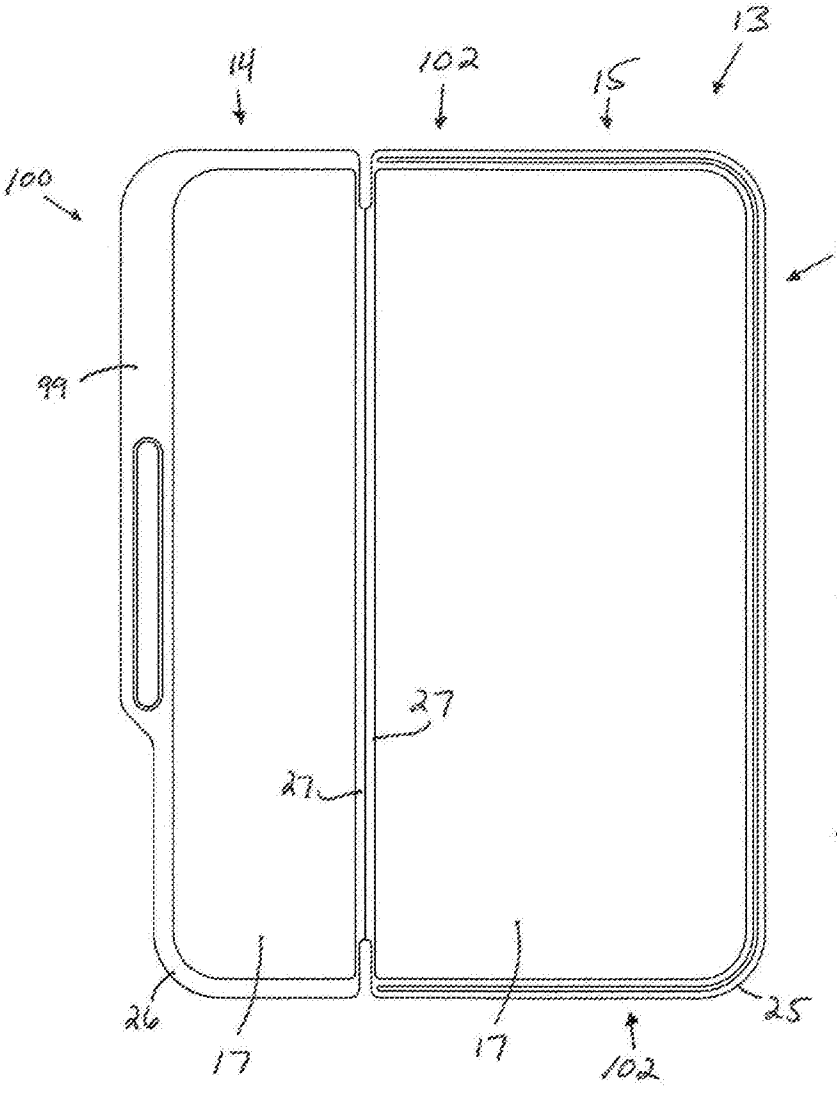
FIG. 29 is a plan view of external surfacing of a first segmented-sleeve half shell of a third alternative sleeve assembly according to the present invention.
Figure 32:
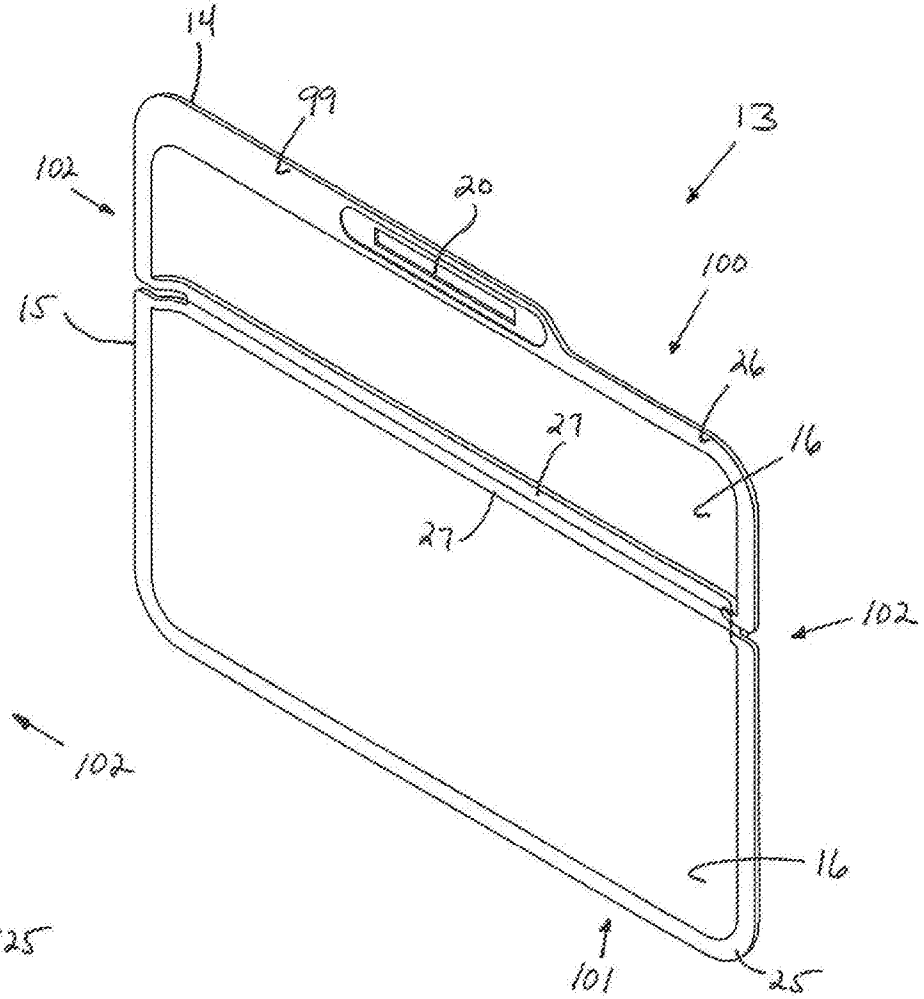
FIG. 32 is a ventral perspective view of internal surfacing of the first segmented-sleeve half shell of the third alternative sleeve assembly according to the present invention.
Figure 31:
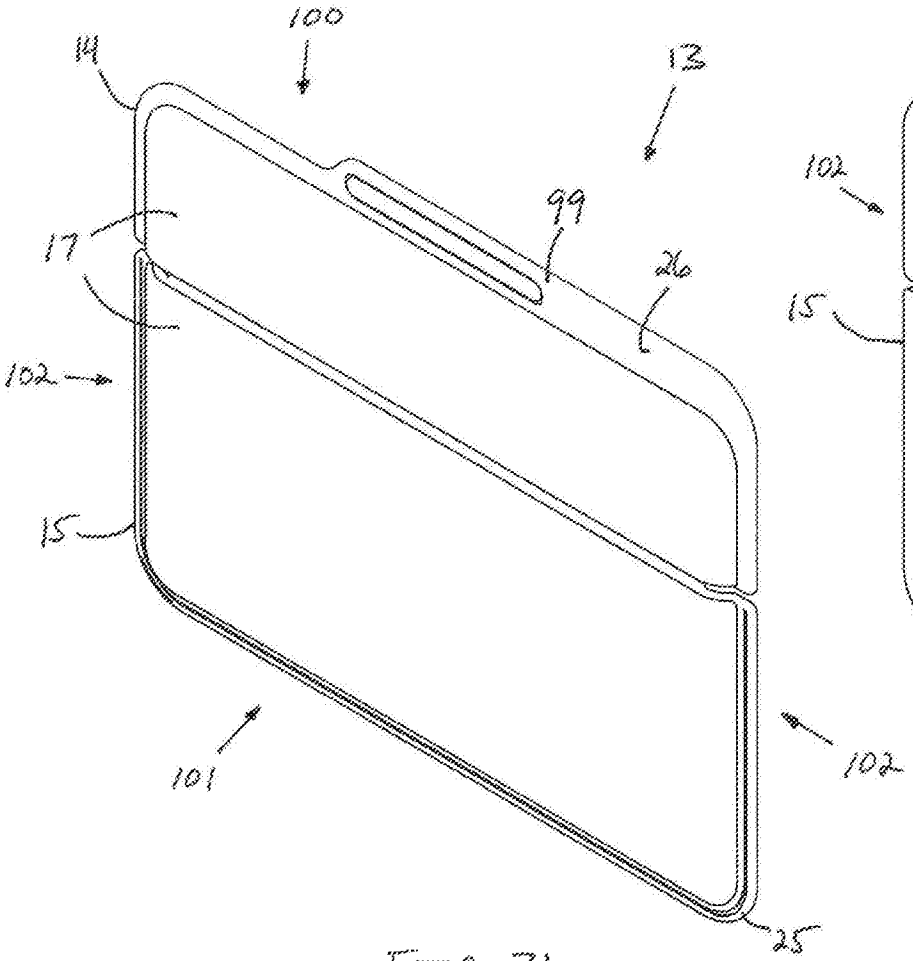
FIG. 31 is a ventral perspective view of external surfacing of the first segmented-sleeve half shell of the third alternative sleeve assembly according to the present invention.
Figure 34:
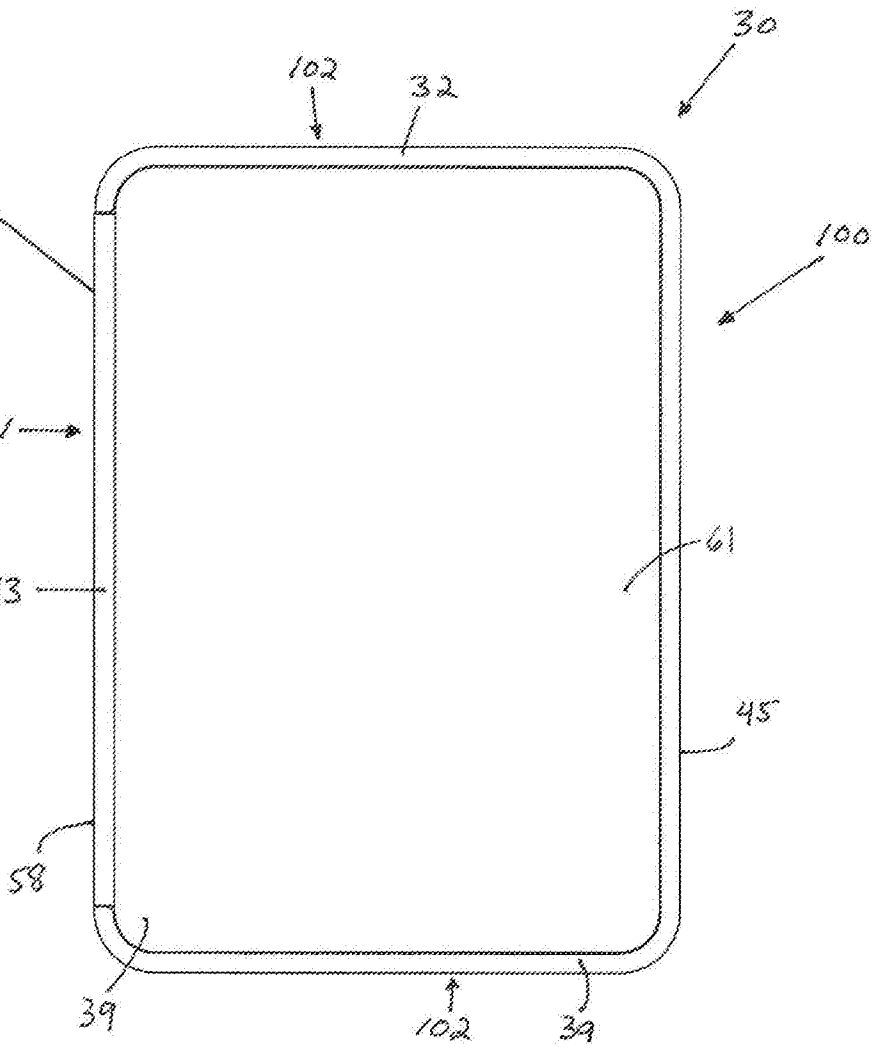
FIG. 34 is a posterior plan view of the first alternative case assembly according to the present invention showing the case assembly in the closed case configuration.

The first and second dorsal sections 15 and the first and second ventral sections 14 each preferably comprise a substantially uniform maximum section length substantially equal to the shell length 103. The reader will note further that the opposed flange junctions 27 may each preferably comprise a substantially uniform junction length as at 108 as generally depicted and referenced in FIG. 20. Comparatively referencing the maximum section length(s) or shell length 103 versus the junction length 108, it will be understood that the junction length 108 is preferably lesser in magnitude than the maximum section length 103 for forming laterally opposed sleeve vents 29 intermediate the dorsal sections 15 and the ventral sections 14. It will thus be understood that the electronic device 11 is externally exposed at the laterally opposed sleeve vents 29 as generally depicted in FIGS. 18, 21, and 22.

The first and second dorsal sections 15 are preferably fixedly or permanently attached to one another. In this regard, it is contemplated that an adhesive layer may preferably bond and/or attach the dorsal sections 15 to one another. An adhesive layer or is generally depicted and referenced at 19. As prefaced above, the first and second ventral sections 14, in contrast to the dorsal sections 15, are preferably separably or removably attachable to one another, and thus preferably comprise certain ventral section retention means for cooperably retaining the first and second ventral sections 14 in engagement with or separably attached to one another. In this regard, it is contemplated that ventral sections 14 may be preferably outfitted with cooperable magnetic means for magnetically holding the ventral sections 14 in engagement with one another. Generic magnets or magnetically attractive elements are depicted and referenced at 20 throughout the drawings.

The exterior surface planes 105 are preferably substantially parallel when the first and second ventral sections 15 are separably attached to one another as generally depicted in the various illustrations submitted in support of these specifications. As further prefaced above, the first and second device-opposing internal sleeve contours 16 together define a device-receiving internal volume. More particularly, the first and second device-opposing internal sleeve contours 16 together define a fixed device-receiving dorsal volume or space 21 within the first and second dorsal sections 15 in view of their permanent fixation to one another. Similarly, the first and second device-opposing internal sleeve contours 16 together define a device-receiving ventral volume or space 22 within the first and second ventral sections 14 when the first and second ventral sections 14 are separably attached to one another.

The sleeve constructions or assemblies according to the present invention as exemplified by sleeve assemblies 10 and 10' may be further preferably described as having first and second dorsal sections 15 with outer dorsal section flanges as at 25 and first and second ventral sections 14 with outer ventral section flanges as at 26. The outer dorsal section flanges 25 are preferably fixedly attached to one another via the adhesive layer 19 and the outer ventral section flanges 26 are preferably separably attachable to one another via the cooperable magnetic mechanisms generically depicted at 20. The outer dorsal and ventral flange sections 25 and 26 are preferably and substantially coplanar extending in an outer flange plane as at 106 (intermediate the outer surface planes 105) when the outer ventral section flanges 26 are separably attached to one another.

A dorsal portion 23 of the electronic device 11 is thus receivable in the device-receiving dorsal volume 21 by way of the first and second ventral sections 14 when the first and second ventral sections 14 are pivotally displaced or separated from one another as generally and comparatively depicted in FIGS. 15-18. A ventral portion 24 of the electronic device 11 is further receivable in the device-receiving ventral volume 22 when the first and second ventral sections 14 are separably attached to one another. When received within the device-receiving volume, the electronic device 11 is believed well-protected by the impact-resistant material construction of the half shells 12 and 13.

Referencing FIGS. 8A through 8C and 10A through 10C, the reader is directed to the air pockets referenced at 97 intermediate the resilient material construction (i.e. that material extending between inner surface 16 and outer surface 17) and the external surfacing of the electronic device 11. The resiliency of the material construction of each half shell 12/13 and the air pockets 97 further and together function to protect or shield the electronic device 11 from side impacts and thus the sleeve constructions or assemblies according to the present invention thus selectively cover, encase, and/or protect the electronic device 11 as received in the device-receiving dorsal and ventral volumes 21 and 22.

Figure 43:
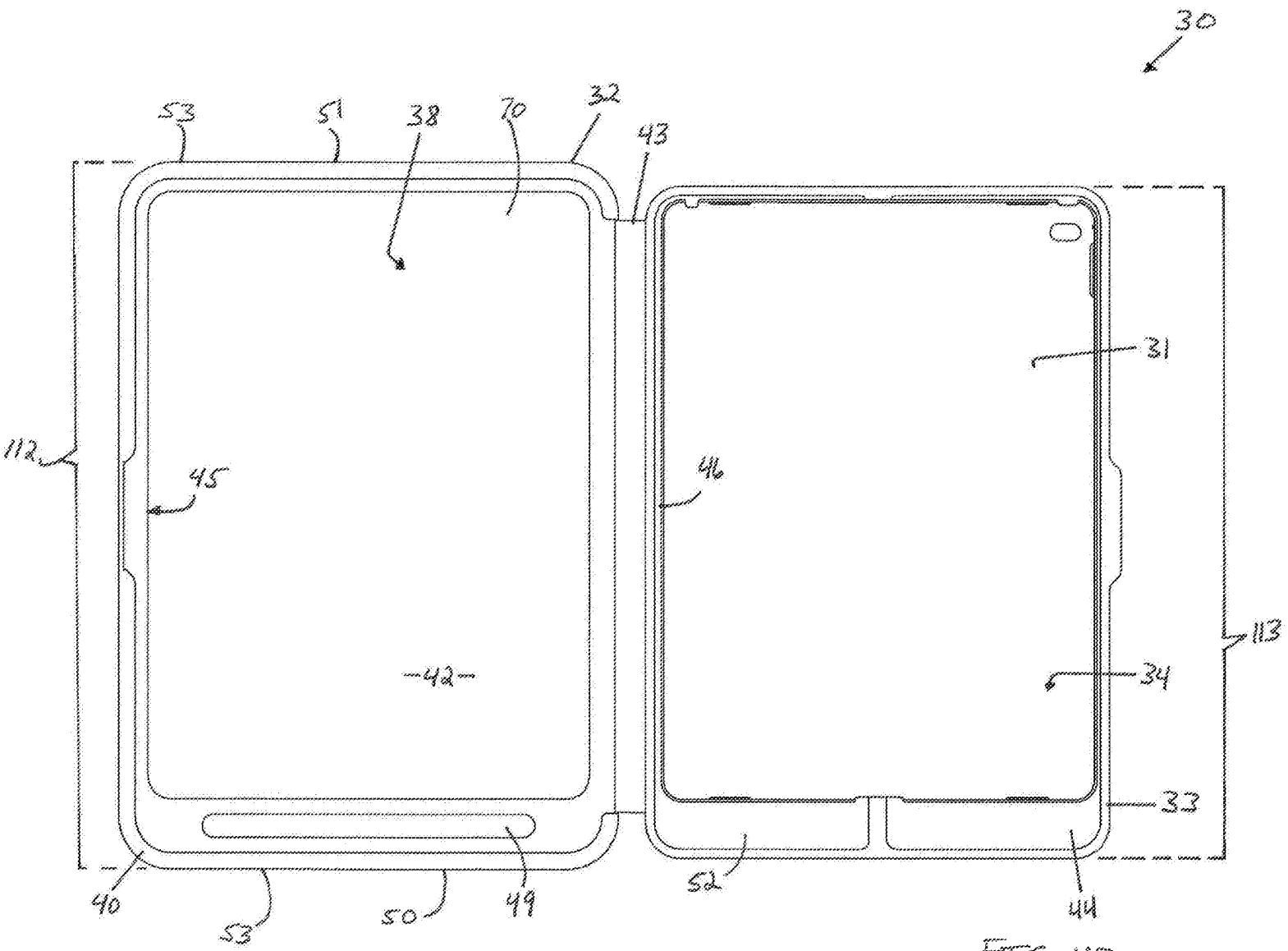
FIG. 43 is an internal, anterior plan view of the first alternative case assembly according to the present invention showing the case assembly in an open flat case configuration.
Figure 44:
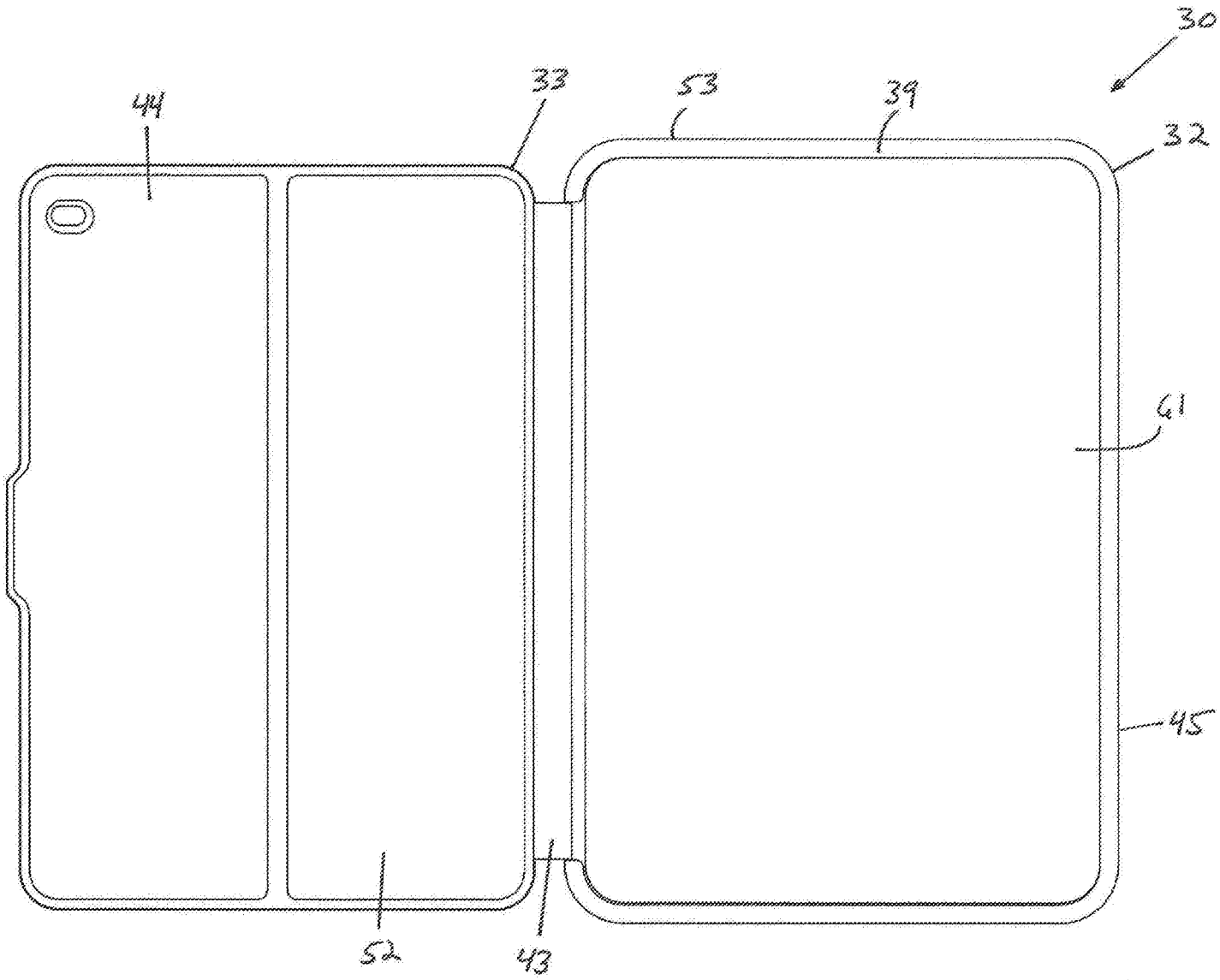
FIG. 44 is an external, posterior plan view of the first alternative case assembly according to the present invention showing the case assembly in the open flat case configuration.

Turning now to the case assembly and components generally and variously depicted in FIGS. 33-50, the reader will there consider a first alternative case assembly 30 according to the present invention. As with the sleeve assemblies 10 and 10', the case assembly 30 primarily functions to selectively cover, encase or protect an electronic device as at 11 when in a closed case configuration as generally and comparatively depicted in FIGS. 33-42. Further, however, the case assembly 30 also functions to selectively display an electronic device 11 in any number of open case display configurations including an open flat display configuration as in FIG. 43, and any number of angled display configurations relative to a horizontal frame of reference as generally and comparatively depicted in FIGS. 46-50.

Figure 46:
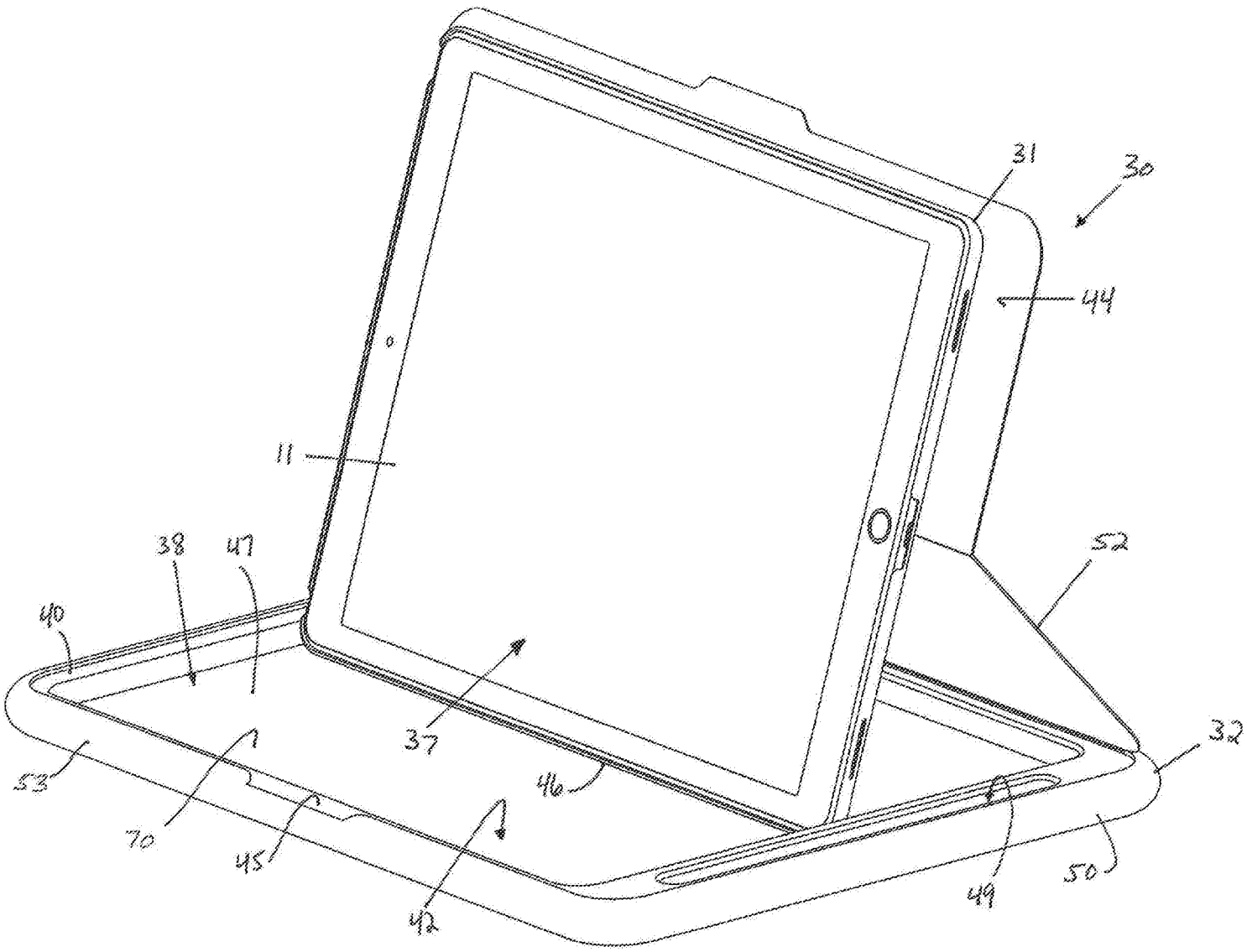
FIG. 46 is a first, anterior perspective view of the first alternative case assembly according to the present invention showing the case assembly in a first open angled-display case configuration.
Figure 47:
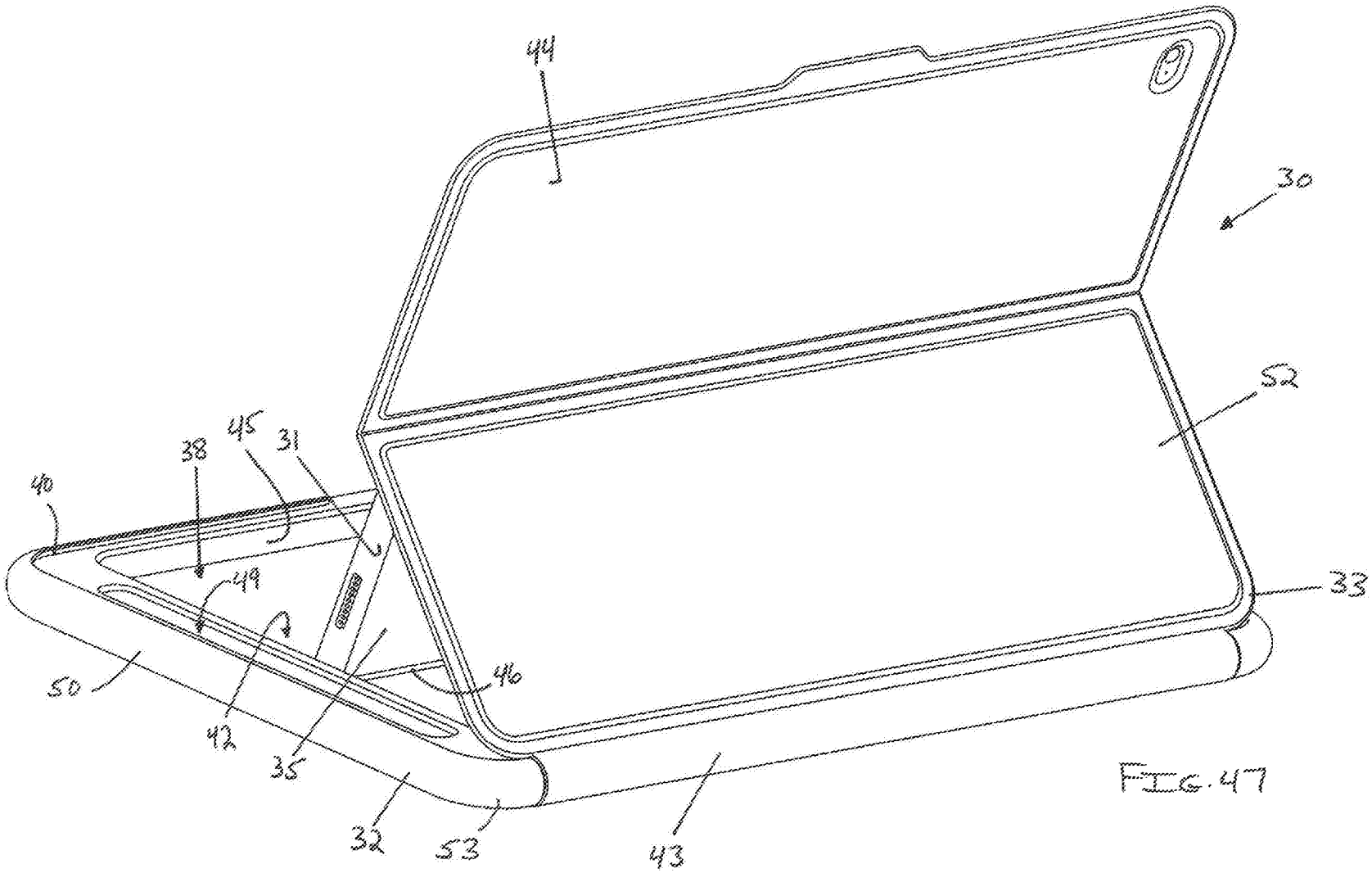
FIG. 47 is a first, posterior perspective view of the first alternative case assembly according to the present invention showing the case assembly in the first open angled-display case configuration.
Figure 48:
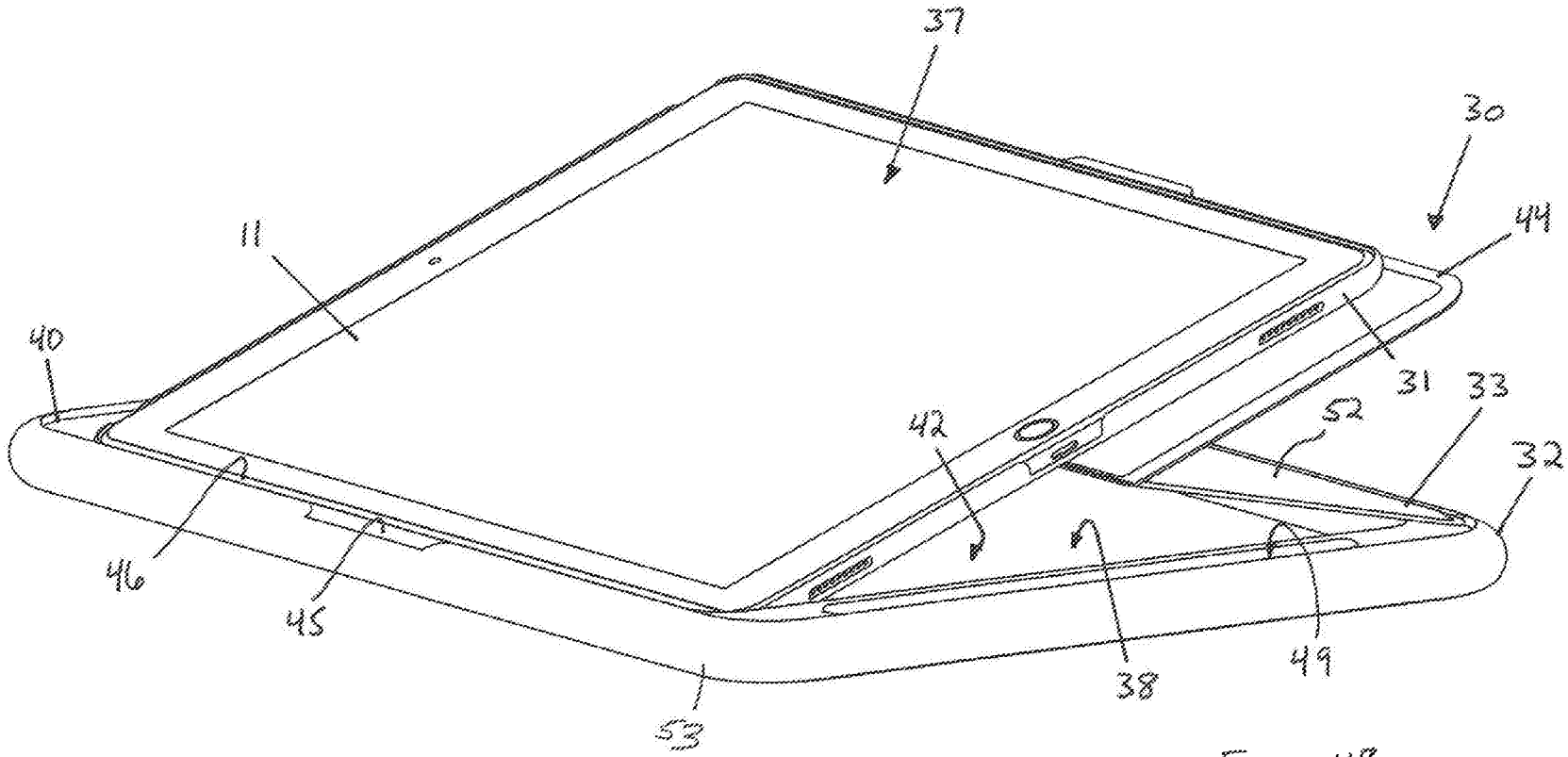
FIG. 48 is a second, anterior perspective view of the first alternative case assembly according to the present invention showing the case assembly in a second open angled-display case configuration.
Figure 50:
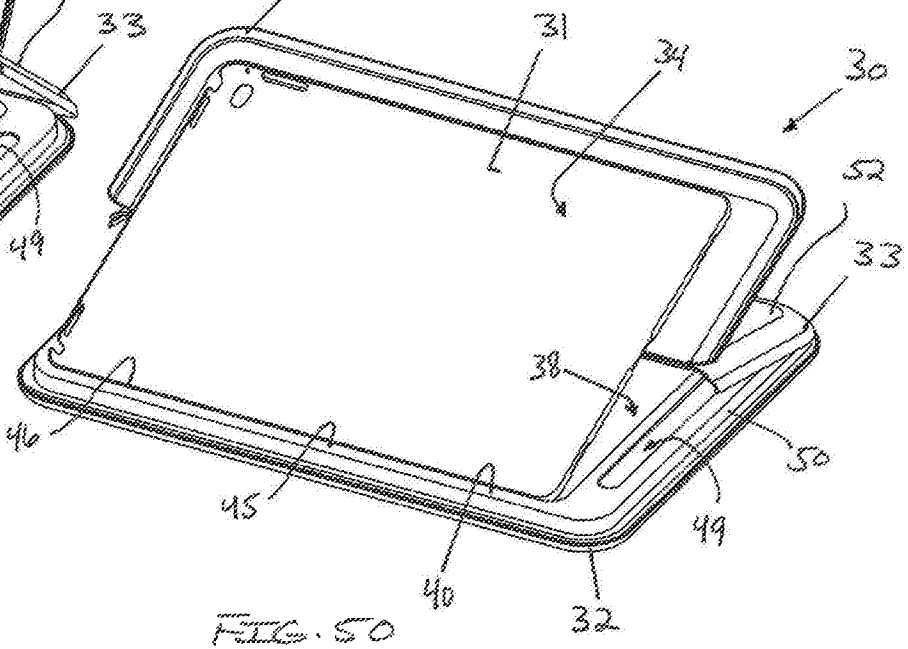
FIG. 50 is a fourth reduced anterior perspective view of the first alternative case assembly according to the present invention showing the case assembly in the second open angled-display case configuration juxtaposed adjacent FIG. 49 for comparison purposes.
Figure 49:
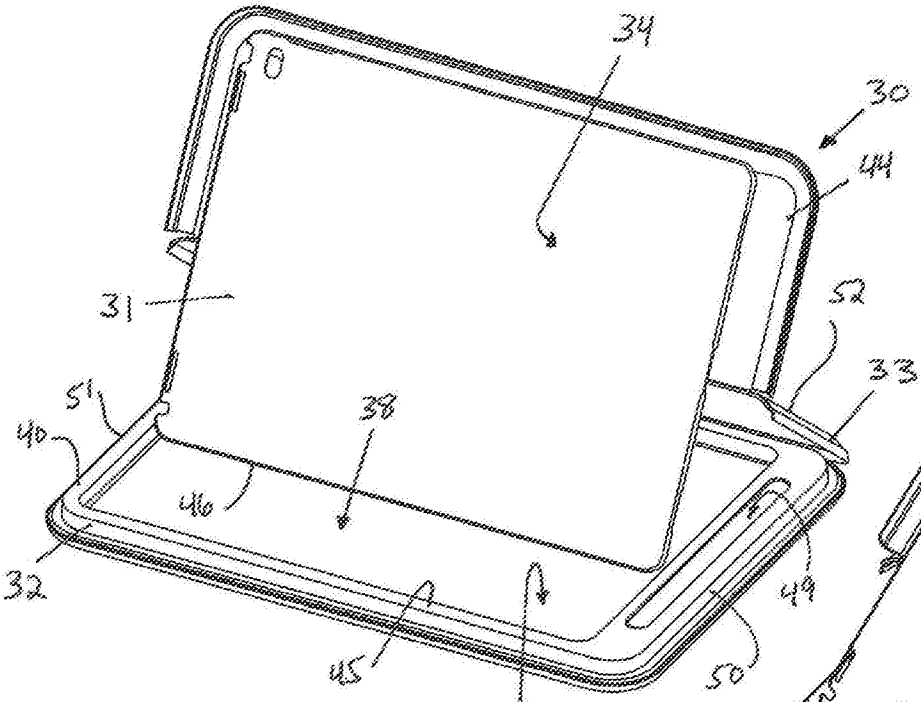
FIG. 49 is a third, reduced anterior perspective view of the first alternative case assembly according to the present invention showing the case assembly in the first open angled-display case configuration juxtaposed adjacent FIG. 50 for comparison purposes.
Figure 52:
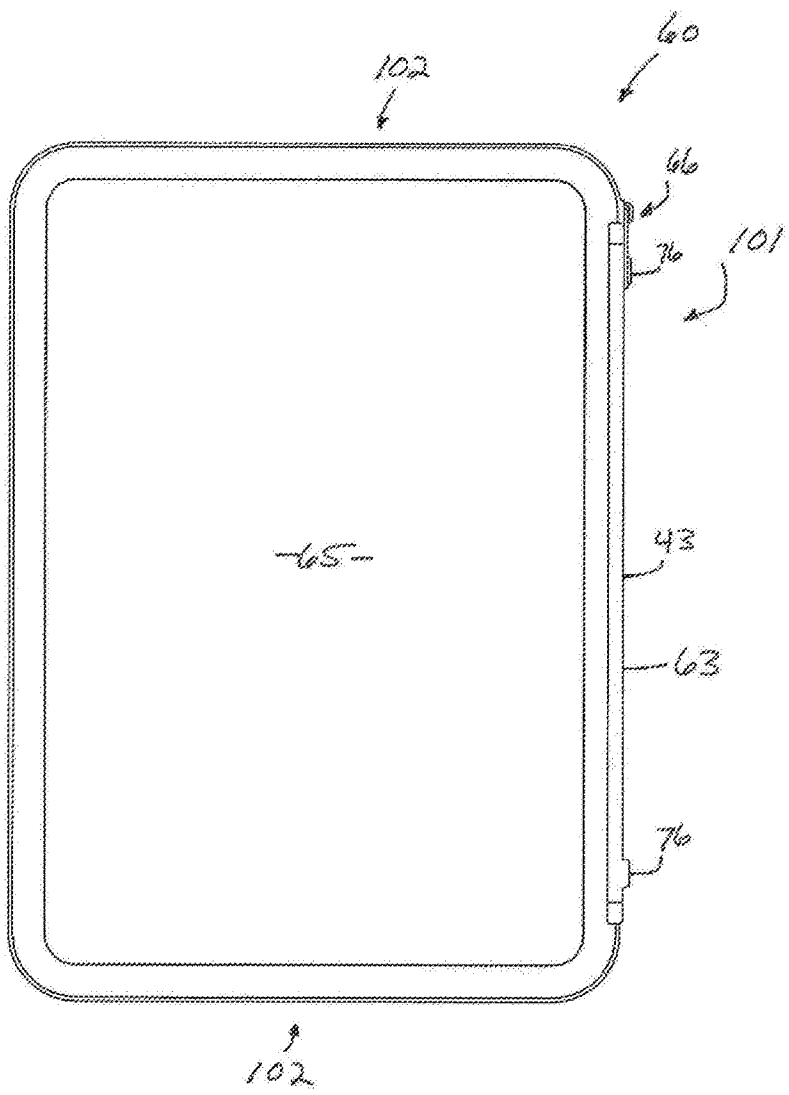
FIG. 52 is a posterior plan view of the second alternative case assembly according to the present invention showing the case assembly in the closed case configuration.
Figure 51:
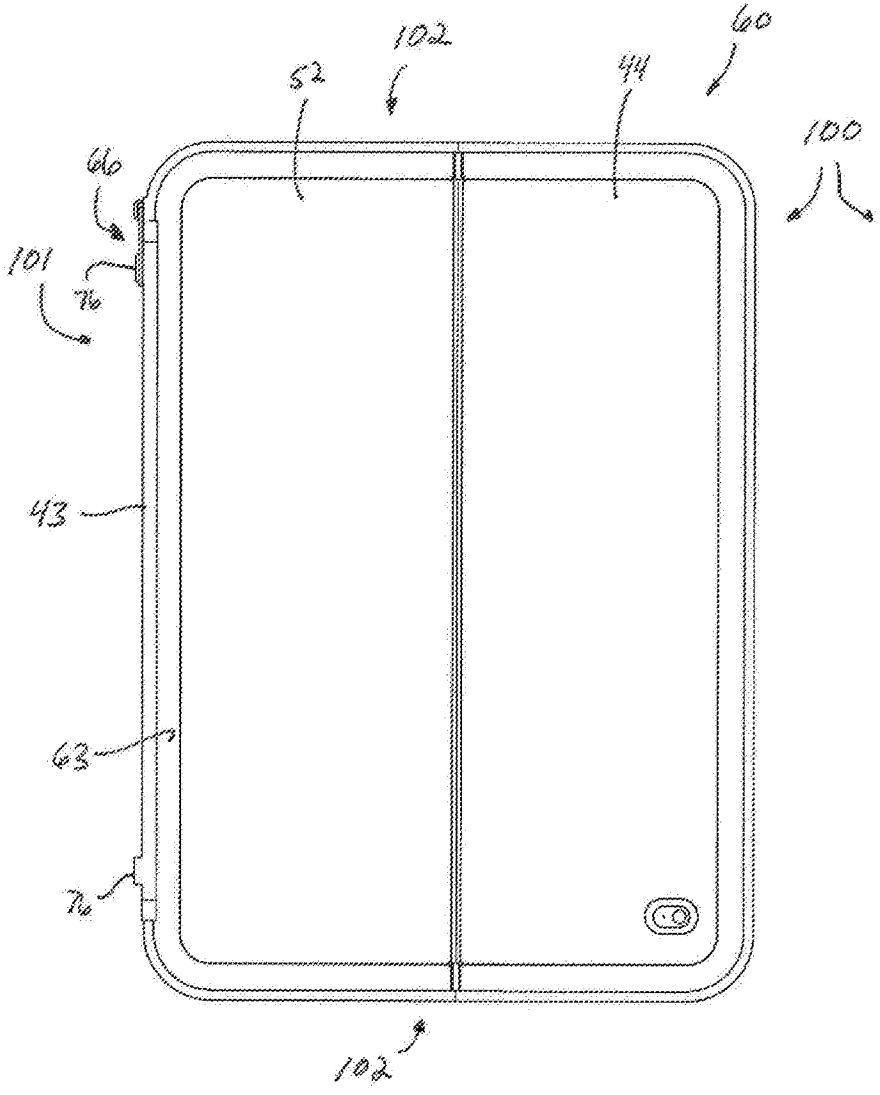
FIG. 51 is a first, anterior plan view of a second alternative case assembly according to the present invention showing the case assembly in a closed case configuration.
Figure 53:
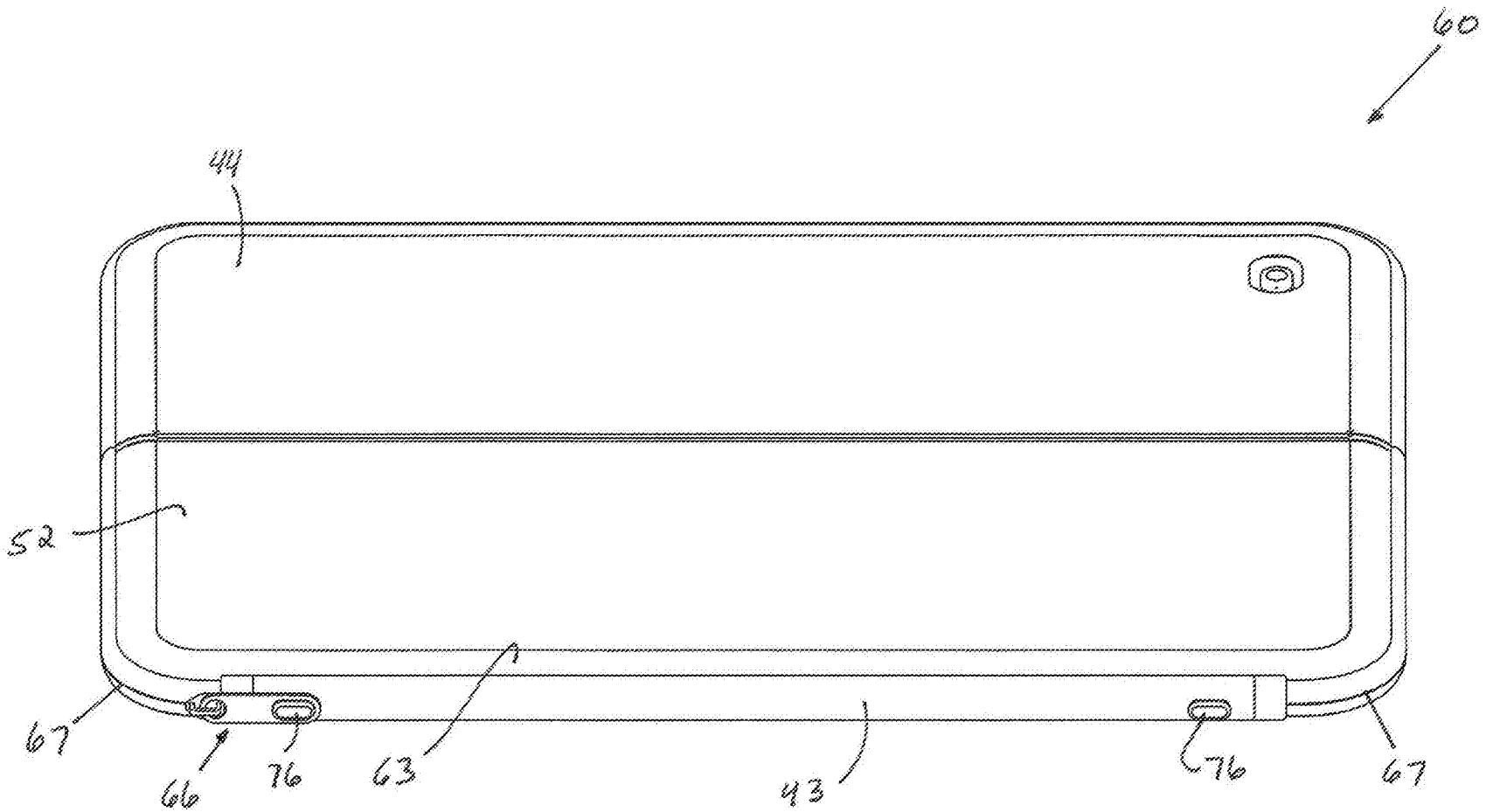
FIG. 53 is a dorsal anterior perspective view of the second alternative case assembly according to the present invention showing the case assembly in the closed case configuration.
Figures 54, 54A:
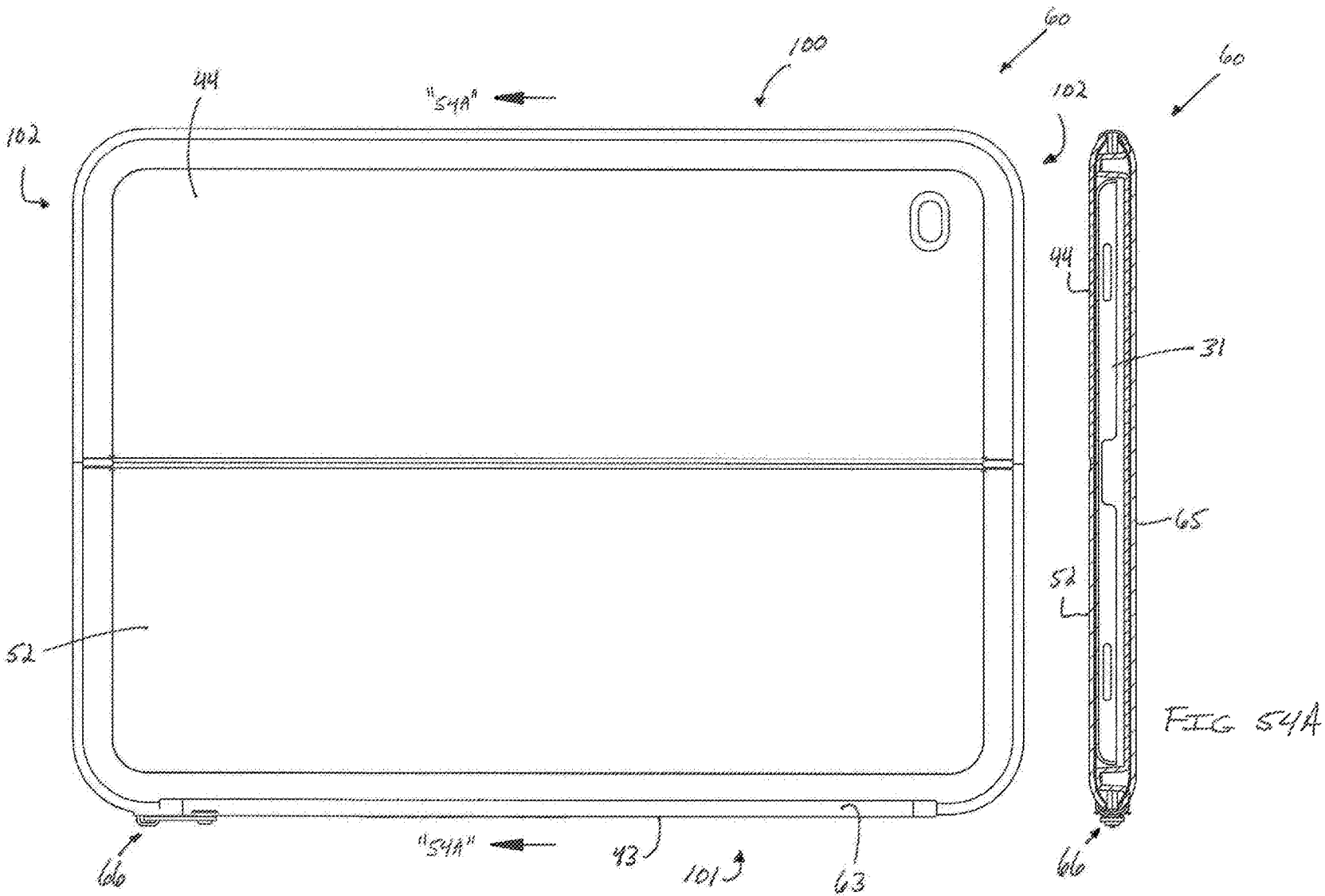
FIG. 54 is a second, enlarged anterior plan view of the second alternative case assembly according to the present invention showing the case assembly in the closed case configuration.
FIG. 54A is a first, medial cross-sectional view of the second alternative case assembly according to the present invention as sectioned from FIG. 54 to show internal structural relationships of the closed case configuration.
Figure 55:
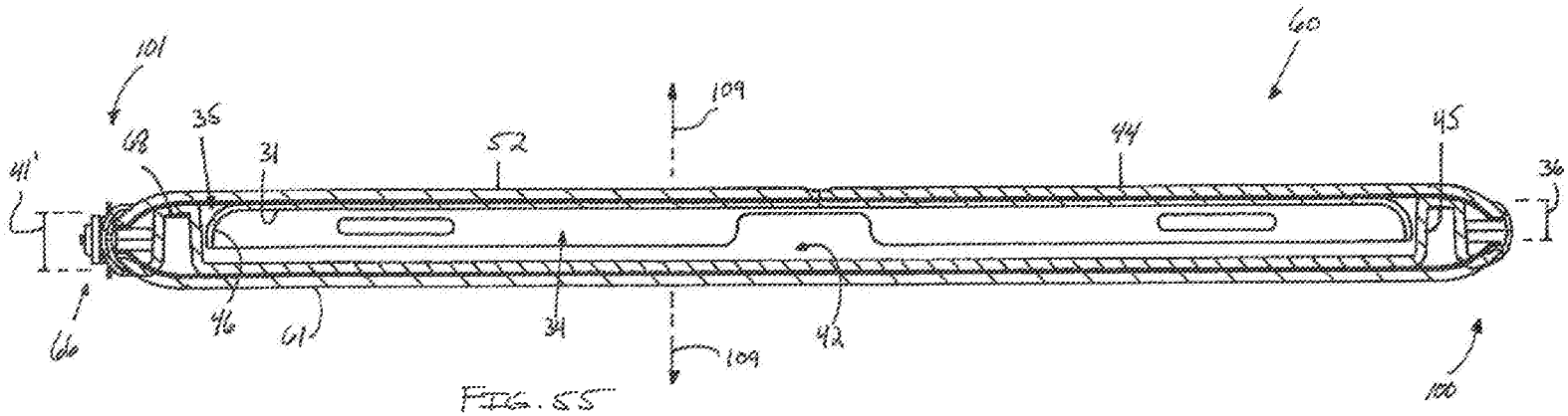
FIG. 55 is a second, enlarged, medial cross-sectional view of the second alternative case assembly according to the present invention as enlarged from FIG. 54A to show in greater detail the internal structural relationships of the closed case configuration.

The case assembly 30 according to the present invention preferably comprises a basic cradle element as at 31; a basal cover ensemble as at 32; and a cradle-to-cover connection mechanism as at 33. The cradle element 31 preferably comprises an open anterior cradle portion as at 34 for receiving an electronic device 11; a posterior cradle portion 35 cooperable with the connection mechanism 33; and a cradle depth as generally referenced at 36. The cradle element 31 is thus preferably sized and shaped for receiving, retaining, and covering posterior portions 57 of the electronic device 11 so as to selectively display anterior portions 37 of the electronic device 11 as generally depicted in FIGS. 46 and 48.

The basal cover ensemble or assembly 32 preferably comprises an open anterior cover portion or side as at 38; a posterior cover portion or side as at 39; and a raised peripheral boundary portion or element as at 40. The basal cover ensemble 32 is referred to as such since it acts as both (1) a base for supporting the cradle element 31 in any number of angled display configurations, and (2) a cover that receives the cradle element 31 and cradle-received or cradle-retained electronic device 11 when re-positioned into a closed case configuration such that anterior portions of both the basal cover ensemble 32 and the cradle element 31 face or oppose one another. In other words, when the ensemble 32 is facing upward, the cradle element 31 is invertedly placed into and thus covered by the ensemble 32 in a downward direction.

The raised peripheral boundary portion 40 is preferably constructed from or comprises Ethylene Vinyl Acetate or EVA for impact resistance or toughness and has a portion thickness as at 41 with a primary cradle-receiving cavity as at 42 defined thereby. As prefaced above, the primary cradle-receiving cavity 42 is preferably sized and shaped for receiving the cradle element 31 when the anterior cover portion 38 and the anterior cradle portion 34 face or oppose one another. Referencing FIG. 42, for example, the reader will there consider that the portion thickness 41 is at least equal to, but preferably greater than the cradle depth 36 so that the cradle element 31 and the electronic device 11 cradled thereby may be received within the cradle-receiving cavity 42.

The cradle-to-cover connection mechanism 33 is preferably a panel assembly and in this regard preferably comprises a dorsal panel portion as at 43 and a ventral panel portion as at 44. The ventral panel portion 44 is preferably connected to the posterior cradle portion 35 and the dorsal panel portion 43 is preferably connected to the posterior cover portion 39. The cradle-to-cover connection panel assembly or mechanism 33 may further preferably comprise a support panel portion 52. The support panel portion 52 is pivotally connected to both the ventral panel portion 44 and the dorsal panel portion 43 and primarily functions to prop or support the cradle element 31 in any of the angled display configurations.

It will thus be understood that the ventral panel portion 44 is pivotally connected to the dorsal panel portion 43 in any case for enabling the user to selectively position the cradle element 31 and the basal cover ensemble or assembly 32 into either a select open case configuration as generally depicted in FIGS. 43, 44, and 46-50 or a closed case configuration as generally depicted in FIGS. 33-42. The posterior cradle portion 35 and the posterior cover portion 39 face in opposite directions as at 109 and the anterior cradle portion 34 and the anterior cover portion 38 face one another when in the closed case configuration.

The raised peripheral boundary element or feature 40 may preferably further comprise or provide a ventral prop portion as at 45, and the cradle element 31 may preferably further comprise or provide a dorsal edge as at 46. The ventral prop portion 45 primarily functions to prop or support the dorsal edge 46 when the cradle element 31 is in a primary angled display configuration relative to the basal cover ensemble or assembly 32 as perhaps most clearly illustrated in FIGS. 48 and 50. The basal cover ensemble or assembly 32 may further preferably comprise or provide a relatively high-friction, lower cradle support surfacing as at 47. The lower cradle-support surfacing 47 primarily functions to support the dorsal edge 46 when the cradle element 31 is positioned in a series of secondary angled display configurations relative to the basal cover ensemble or assembly 32 as in FIGS. 46, 47, and 49. The dorsal panel portion 43 may preferably comprise posterior panel surfacing 61 and anterior panel surfacing 70, which anterior panel surfacing 70 may optionally provide or define the lower cradle-support surfacing 47.

The raised peripheral boundary element 40 further preferably comprises an outer peripheral edge as at 53 and at least one secondary cavity as at 49 for receiving accessory objects as exemplified by a writing utensil or stylus as at 69. The primary cradle-receiving cavity 42 and each secondary cavity 49 are preferably and structurally formed so as to be off-centered relative to select portions of the outer peripheral edge 53. Referencing FIG. 43, for example, the reader will there consider the secondary cavity 49 situated in adjacency to the lateral edge 50 whereas the primary cradle-receiving cavity is situated in adjacency to the lateral edge 51 opposite the lateral edge 50 and thus the two cavities 42 and 49 are off-centered relative to the overall length 112 intermediate lateral edge 50 and lateral edge 51. The reader will further note that cradle element 31 is also off-centered relative to the length 113 of the cradle-to-cover connection mechanism 33 so as to be readily received in the cradle-receiving cavity 42 when the case assembly 30 is placed into the closed case configuration.

Figures 45, 45A, 45B:
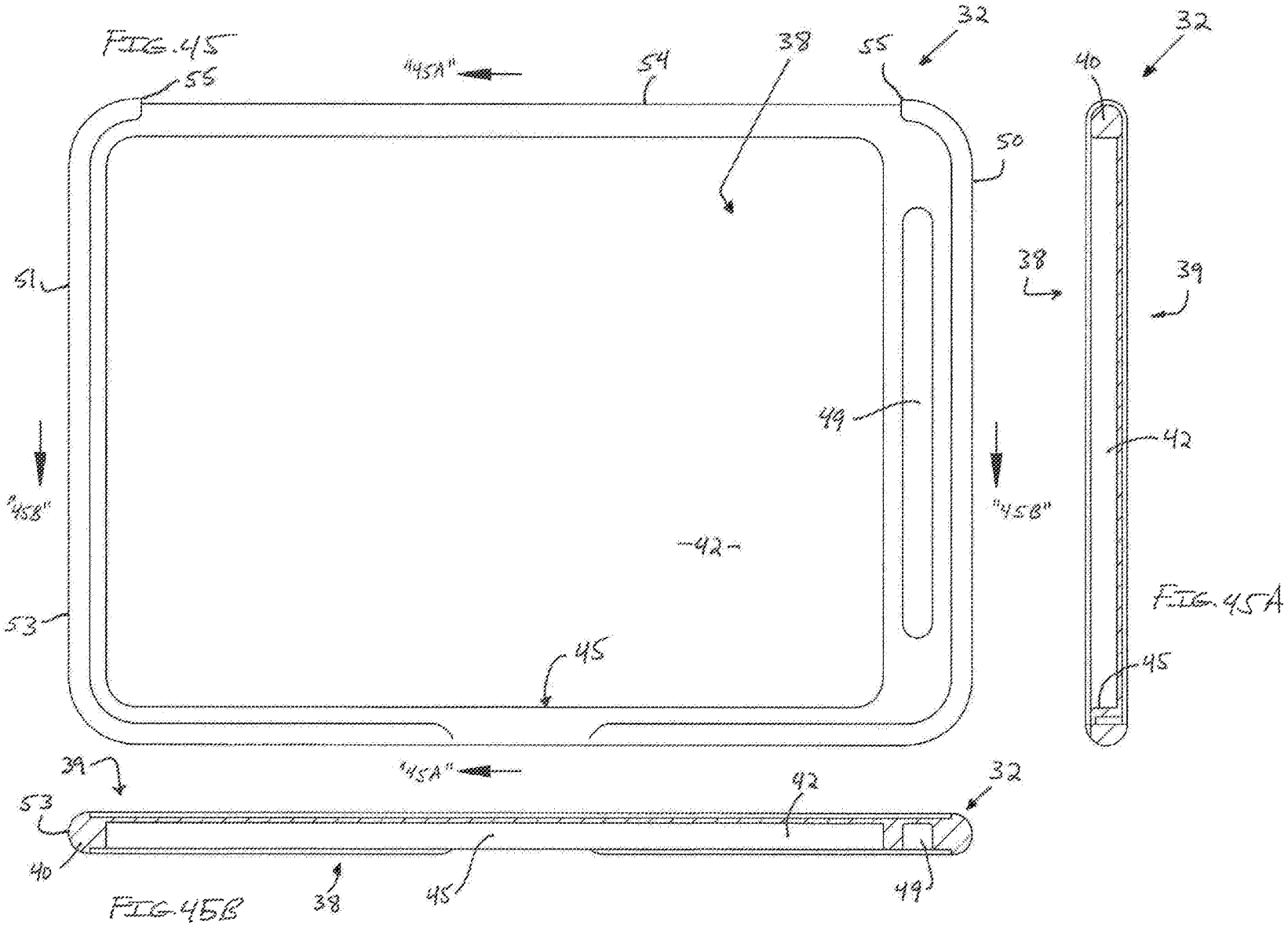
FIG. 45 is an anterior plan view of a first alternative basal cover ensemble of the first alternative case assembly according to the present invention.
FIG. 45A is a medial cross-sectional view of the first alternative basal cover ensemble of the first alternative case assembly according to the present invention as sectioned from FIG. 45 to show medial cross-sectional details of the first alternative basal cover ensemble.
FIG. 45B is a transverse cross-sectional view of the first alternative basal cover ensemble of the first alternative case assembly according to the present invention as sectioned from FIG. 45 to show transverse cross-sectional details of the first alternative basal cover ensemble.

The outer peripheral edge 53 of the raised peripheral boundary element 40 may further preferably comprise a dorsal panel-receiving portion as at 54 and laterally opposed panel-guide portions as at 55 as perhaps most clearly depicted in FIG. 45. The dorsal panel-receiving portion 54 is recessed relative to the laterally opposed panel-guide portions 55 for structurally accommodating the dorsal panel portion 43 of the cradle-to-cover connection mechanism or panel assembly 33 when positioned into the closed case configuration such that an outer dorsal edging 58 of the closed case configuration is substantially flush as generally depicted and referenced at 59 in FIG. 41.

Figure 56:
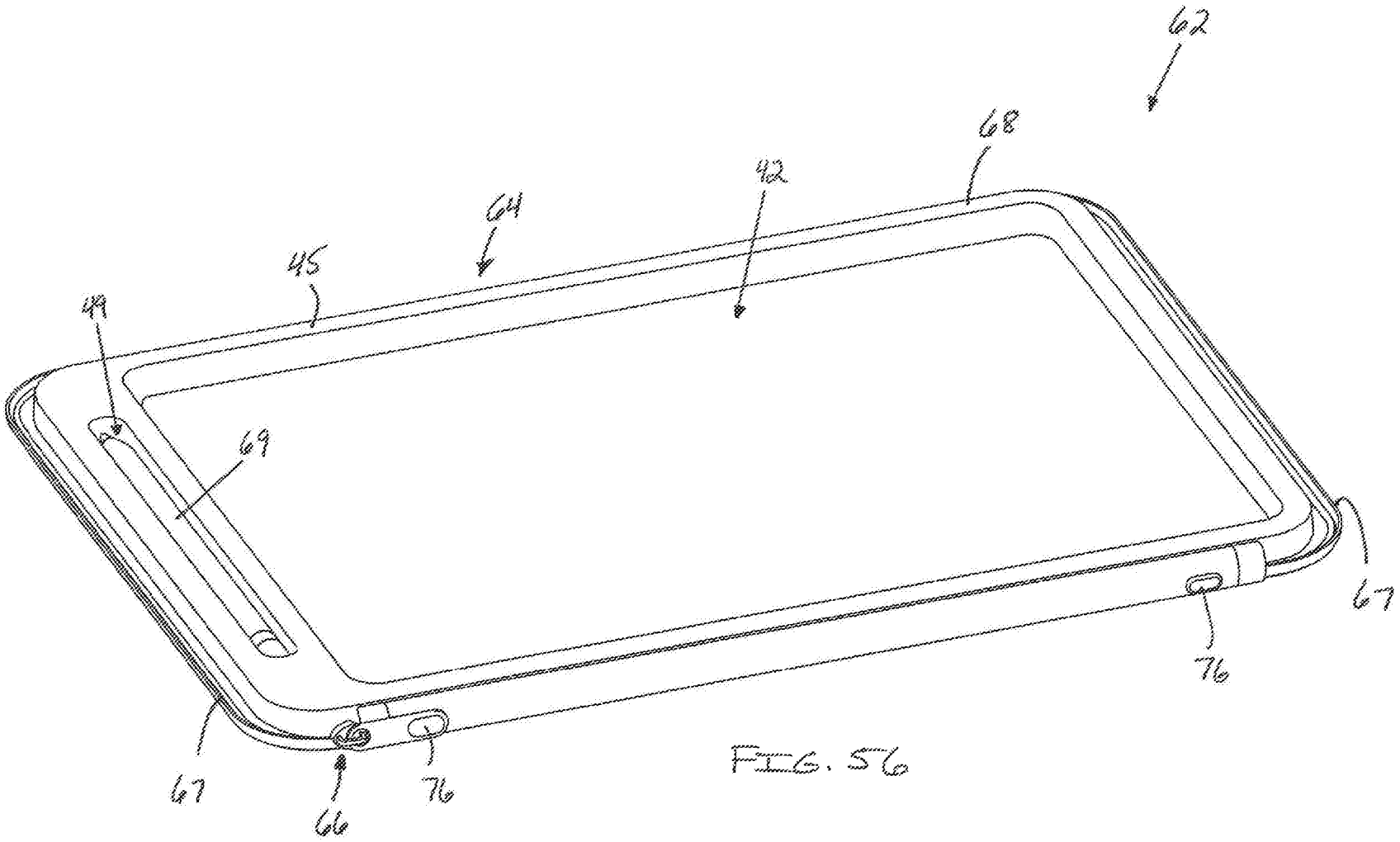
FIG. 56 is an anterior perspective view of a second alternative basal cover ensemble of the second alternative case assembly according to the present invention.
Figures 57, 58:
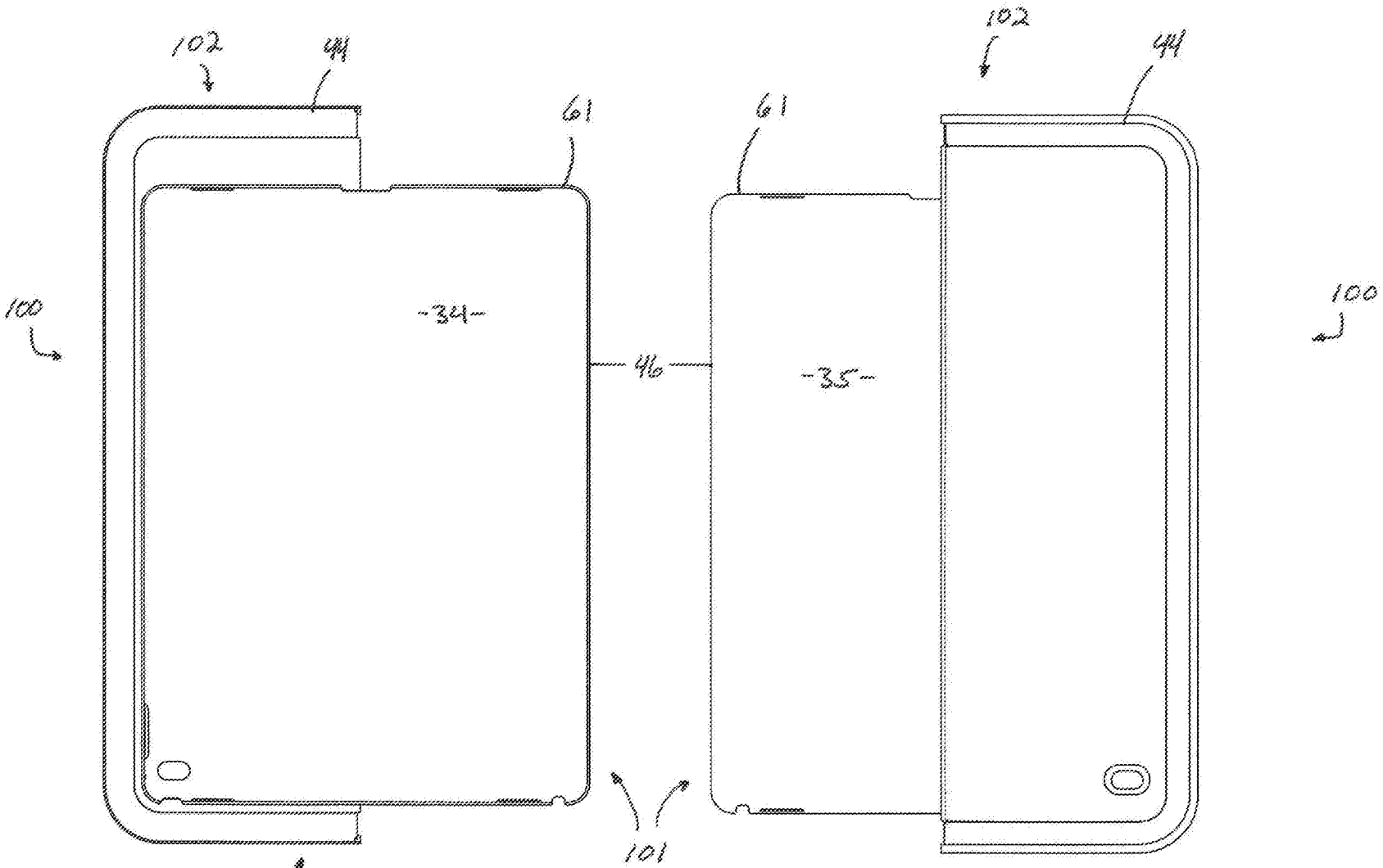
FIG. 57 is an anterior plan view of a cradle element attached to a ventral panel portion of a cradle-to-cover connection mechanism of the second alternative case assembly according to the present invention.
FIG. 58 is a posterior plan view of the cradle element attached to the ventral panel portion of the cradle-to-cover connection mechanism of the second alternative case assembly according to the present invention.

Turning now to FIGS. 51-72 an alternative case assembly 60 and various components thereof according to the present invention are therein depicted, which case assembly 60 with its various components is believed to be structurally on par with or similar to case assembly 30. In this regard, alternative case assembly 60 in its entirety is generally depicted and referenced in FIGS. 51-55 and FIGS. 56-72 depict separate parts of the case assembly 60 for ease of understanding and conciseness of description. FIGS. 51-55 show the case assembly 60 in the closed case configuration; FIG. 56 depicts a basal cover ensemble 62 according to the present invention; FIGS. 57 and 58 depict a cradle element 31 connected to a ventral panel portion 44 of a cradle-to-cover connection mechanism 63 according to the present invention. A support panel portion 52 of the cradle-to-cover mechanism 63 is otherwise depicted and referenced in FIGS. 51, 53, 54, 54A and 55.

The primary structural difference between case assembly 30 and case assembly 60 is the inclusion of a zipper closure mechanism in combination with the cradle-to-cover connection mechanism 63 for zip-fastening portions of the cradle-to-cover connection mechanism 63 to the basal cover ensemble 62. A zipper pull-body assembly 66 and 66' of the zipper closure mechanism is generally depicted and referenced in FIGS. 62-65. Zipper teeth are not specifically illustrated in the drawings submitted in support of these specifications in view of zipper art being well understood, but reference is made to a track line as at 67 to generally show the track along which either zipper pull-body assembly 66 or 66' travels. The zipper mechanism thus enables the user of case assembly 60 to selectively zip-close the case assembly 60 in the closed case configuration or zip-open the case assembly 60 for selectively displaying the cradle element 31 in any number of display configurations including an open flat display configuration or any number of open angled display configurations.

Case assembly 60 thus basically functions to selectively encase and display an electronic device 11 and to achieve this basic function preferably comprises the cradle element 31, the basal cover ensemble 62, and the cradle-to-cover connection mechanism 63. Similar to the various features of case assembly 30, the cradle element 31 preferably has an open anterior cradle portion as at 34, a posterior cradle portion as at 35, and a cradle depth as at 36. The cradle element 31 is preferably sized and shaped for receiving, retaining, and covering posterior portions 57 of the electronic device 11 so as to selectively display anterior portions 37 of the electronic device 11.

The basal cover element or ensemble 62 preferably comprises an anterior cover portion as at 64, a posterior cover portion as at 65, and a raised peripheral boundary portion or element as at 68 optionally removable from an outer sleeve or casing material that primarily forms the cradle-to-cover connection mechanism 63. The raised peripheral boundary portion or element 68 is preferably constructed from or comprises Ethylene Vinyl Acetate or EVA for impact resistance or toughness and has a portion thickness 41' on par with portion thickness 41, and similarly defines a primary cradle-receiving cavity as at 42. The primary cradle-receiving cavity 42 of basal cover element or ensemble 62 is similarly sized and shaped for receiving the cradle element 31 when the anterior cover portion 64 and anterior cradle portion 34 face one another, and the portion thickness (as at 41') is preferably at least equal to the cradle depth 36 for receiving and anteriorly covering the cradle element 31.

The cradle-to-cover connection mechanism 63 preferably comprises a cover attachment portion as at 43 and a cradle attachment portion as at 44. The cover attachment portion 43 is preferably connected or attached to the basal cover ensemble 62 and the cradle attachment portion 44 is preferably connected or attached to the cradle element 31. The cover and cradle attachment portions 43 and 44 are pivotally attachable to one another for enabling the user to selectively position the cradle element 31 and basal cover element or ensemble 62 in either a select open case configuration or a closed case configuration. As in case assembly 30, the posterior cradle and cover portions 35 and 65, and the anterior cradle and cover portions face 34 and 64 face in opposite directions when in the closed case configuration.

Figure 59A:
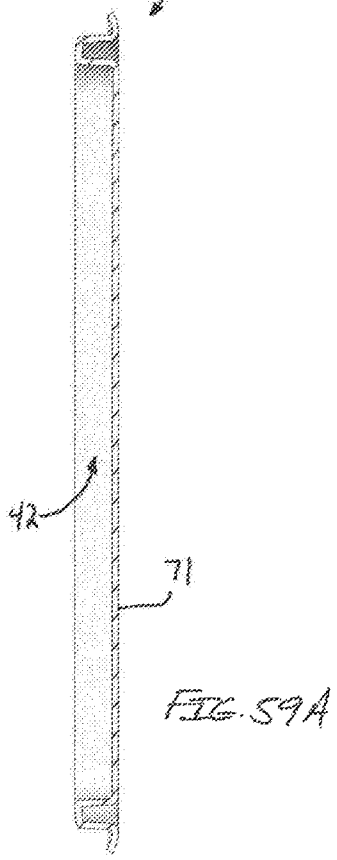
FIG. 59A is a first, medial cross-sectional view of the second alternative raised peripheral boundary portion of the second alternative basal cover ensemble of the second alternative case assembly according to the present invention as sectioned from FIG. 59 to show medial cross-sectional details of the raised peripheral boundary portion.
Figure 59:
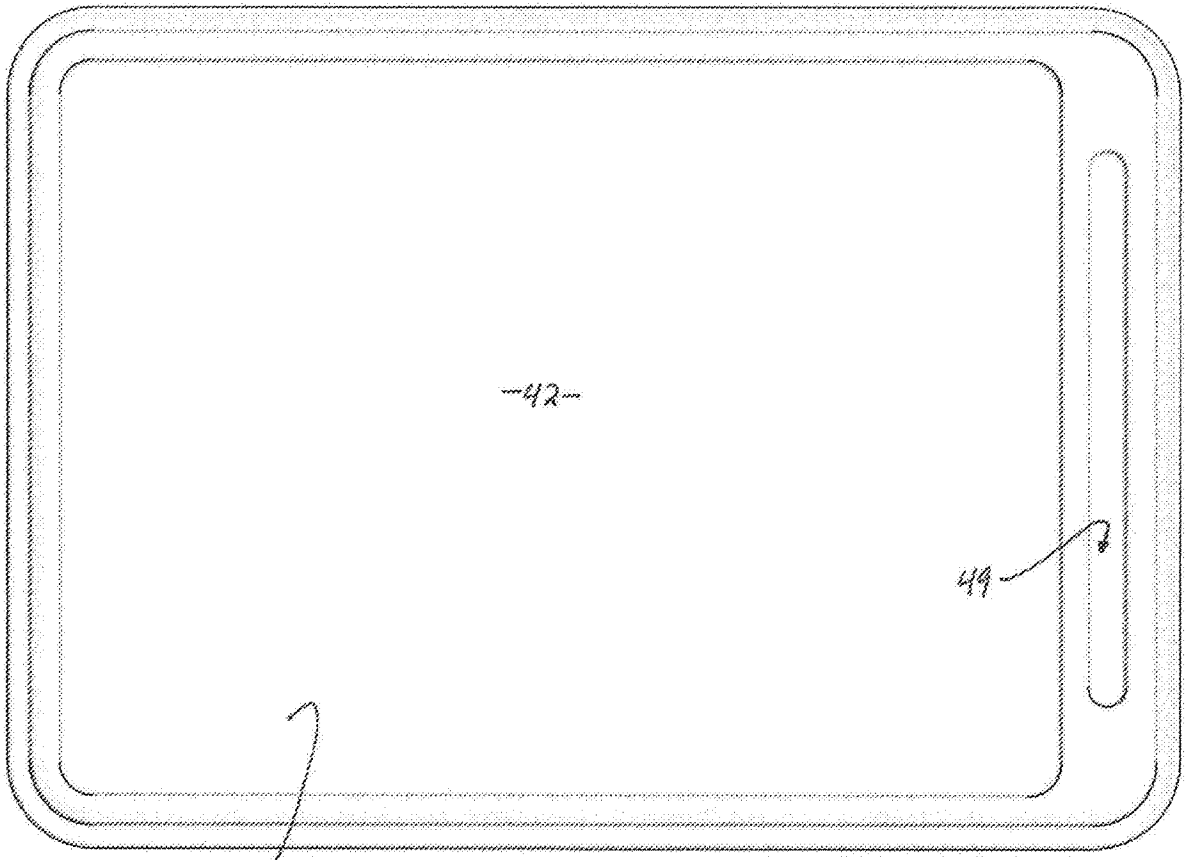
FIG. 59 is an anterior plan view of a second alternative raised peripheral boundary portion of the second alternative basal cover ensemble of the second alternative case assembly according to the present invention.
Figure 60:
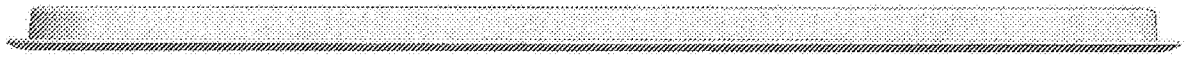
FIG. 60 is a ventral edge view of the second alternative raised peripheral boundary portion of the second alternative basal cover ensemble of the second alternative case assembly according to the present invention.
Figure 61:
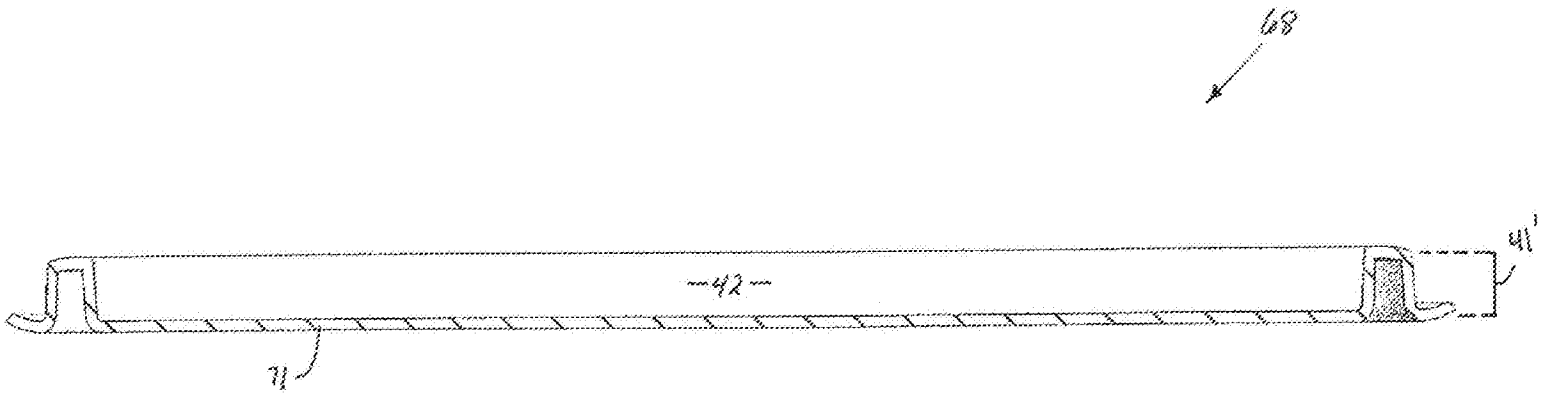
FIG. 61 is a second, enlarged medial cross-sectional view of the second alternative raised peripheral boundary portion of the second alternative basal cover ensemble of the second alternative case assembly according to the present invention as enlarged from FIG. 59A to show in greater detail medial cross-sectional details of the raised peripheral boundary portion.
Figures 62, 63, 64, 65, 66, 67, 68, 69, 70, 71, 72:
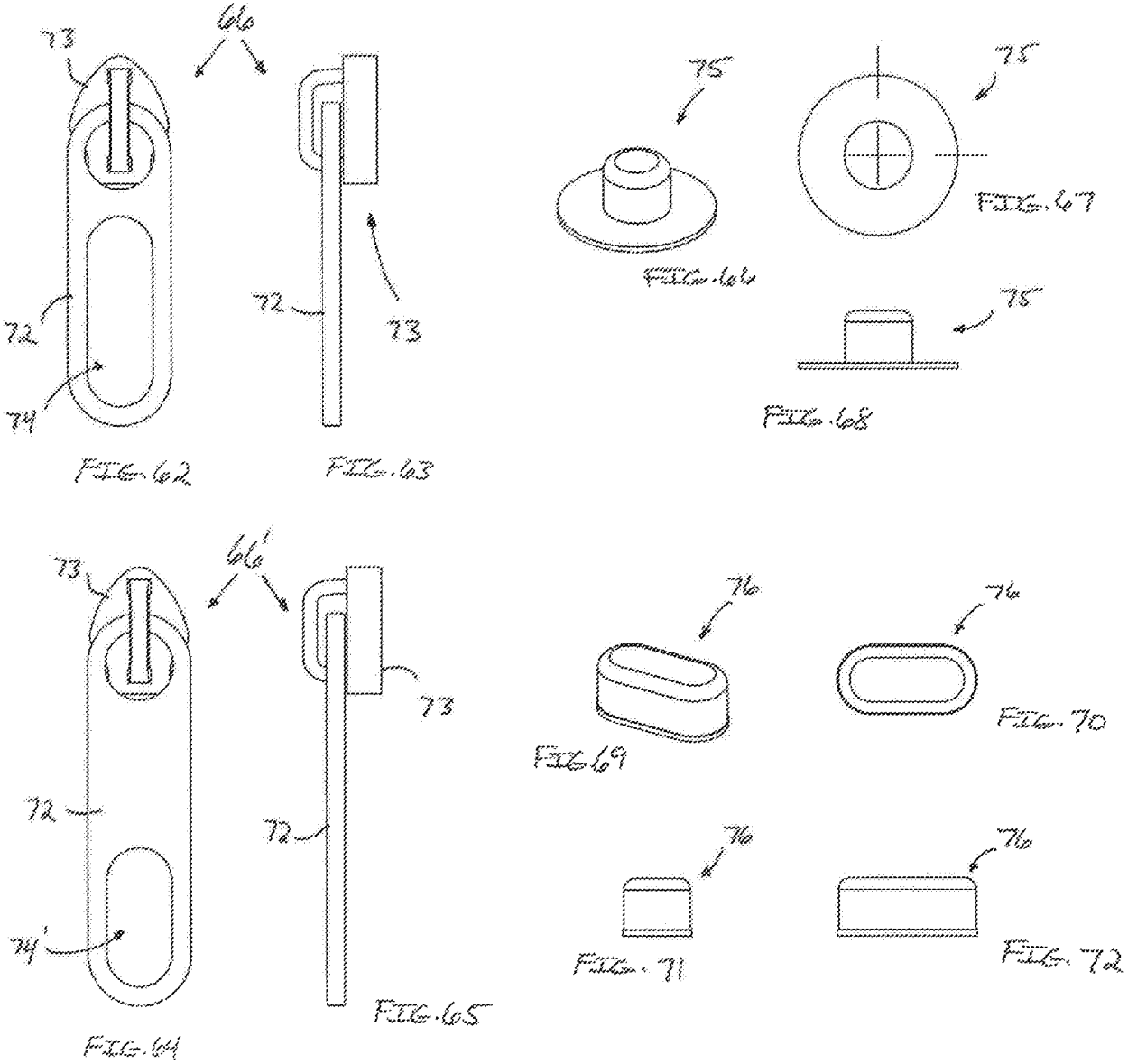
FIG. 62 is a plan view of a first zipper pull-body assembly usable in combination with the cradle-to-cover connection mechanism of the second alternative case assembly according to the present invention, the zipper pull portion of the first zipper pull-body assembly having a first button-receiving aperture.
FIG. 63 is an edge view of the first zipper pull-body assembly usable in combination with the cradle-to-cover connection mechanism of the second alternative case assembly according to the present invention.
FIG. 64 is a plan view of a second zipper pull-body assembly usable in combination with the cradle-to-cover connection mechanism of the second alternative case assembly according to the present invention, the zipper pull portion of the second zipper pull-body assembly having a second button-receiving aperture.
FIG. 65 is an edge view of the second zipper pull-body assembly usable in combination with the cradle-to-cover connection mechanism of the second alternative case assembly according to the present invention.
FIG. 66 is a perspective view of a first anchor button usable in combination with either the first or second zipper pull-body assemblies and receivable in the either the first or second button-receiving apertures for anchoring said first or second zipper pull-body assemblies.
FIG. 67 is a top plan view of the first anchor button usable in combination with either the first or second zipper pull-body assemblies and receivable in the either the first or second button-receiving apertures for anchoring said first or second zipper pull-body assemblies.
FIG. 68 is a side elevational view of the first anchor button usable in combination with either the first or second zipper pull-body assemblies and receivable in the either the first or second button-receiving apertures for anchoring said first or second zipper pull-body assemblies.
FIG. 69 is a perspective view of a second anchor button usable in combination with either the first or second zipper pull-body assemblies and receivable in the either the first or second button-receiving apertures for anchoring said first or second zipper pull-body assemblies.
FIG. 70 is a top plan view of the second anchor button usable in combination with either the first or second zipper pull-body assemblies and receivable in the either the first or second button-receiving apertures for anchoring said first or second zipper pull-body assemblies.
FIG. 71 is an end elevational view of the second anchor button usable in combination with either the first or second zipper pull-body assemblies and receivable in the either the first or second button-receiving apertures for anchoring said first or second zipper pull-body assemblies.
FIG. 72 is a side elevational view of the second anchor button usable in combination with either the first or second zipper pull-body assemblies and receivable in the either the first or second button-receiving apertures for anchoring said first or second zipper pull-body assemblies.

The raised peripheral boundary portion or element 68 is separately illustrated and referenced in FIGS. 59-61. From a consideration of FIGS. 59-61, it will be understood that raised peripheral boundary portion 68 preferably further comprises a closed bottom portion as at 71. The zipper pull-body assembly as at either 66 or 66' preferably comprises a pull portion 72 and a body portion 73. The pull portion 72 may preferably comprise a button-receiving aperture as at 74 or 74', the aperture 74' being relatively larger as compared to aperture 74 thereby providing the structural difference between assembly 66 and 66'. Case assembly 60 may be preferably outfitted with at least one of either anchor button 75 or anchor button 76, which anchor buttons 75 and/or 76 preferably comprise a maximum button width or diameter that may readily be received within the button-receiving aperture 74 or 74' for holding or anchoring the zipper pull-body assembly 66 or 66' at the button attachment site(s).

Figures 73, 73A:
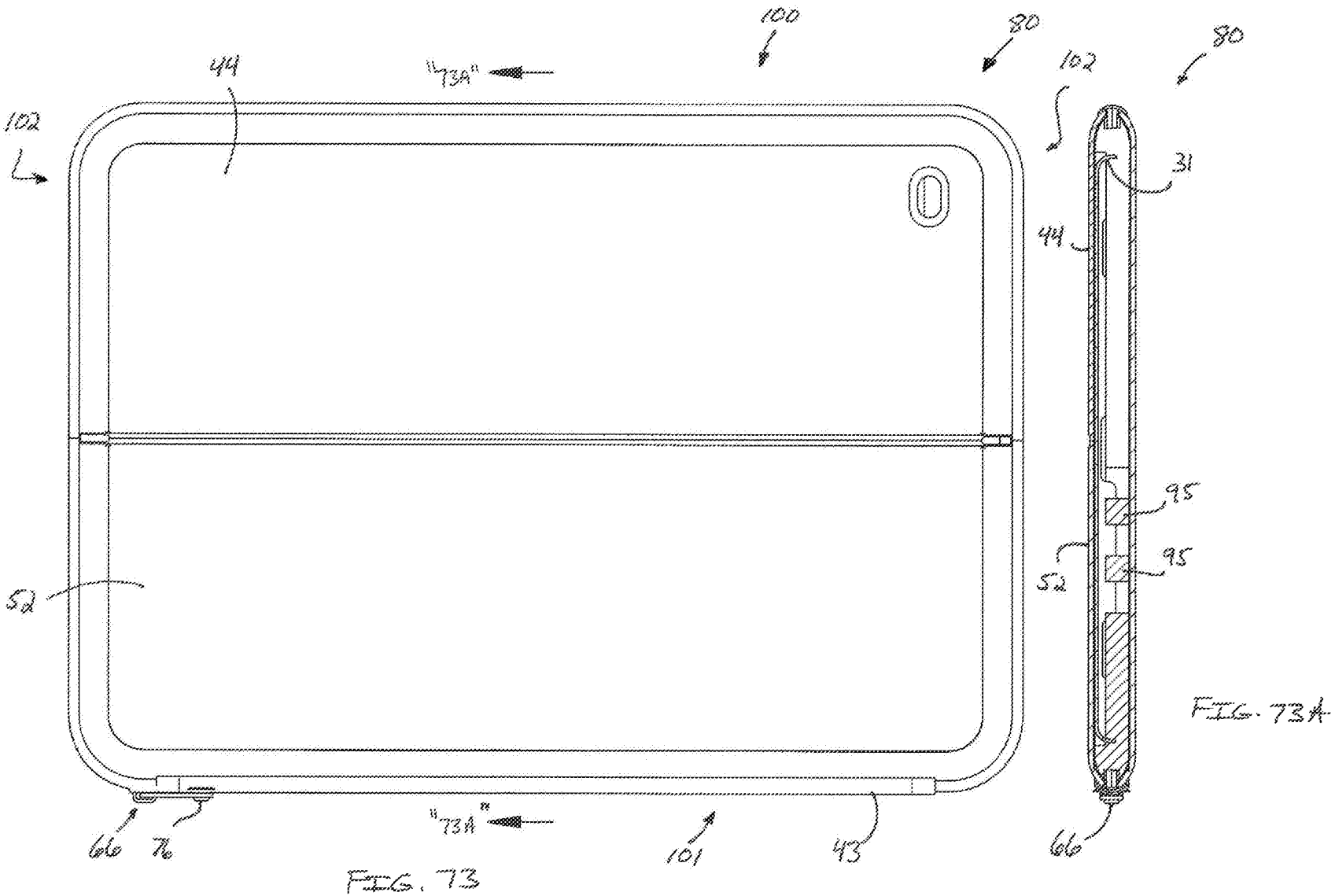
FIG. 73 is an enlarged anterior plan view of a third alternative case assembly according to the present invention showing the case assembly in a closed case configuration.
FIG. 73A is a first, medial cross-sectional view of the third alternative case assembly according to the present invention as sectioned from FIG. 73 to show internal structural relationships of the closed case configuration.
Figure 74:
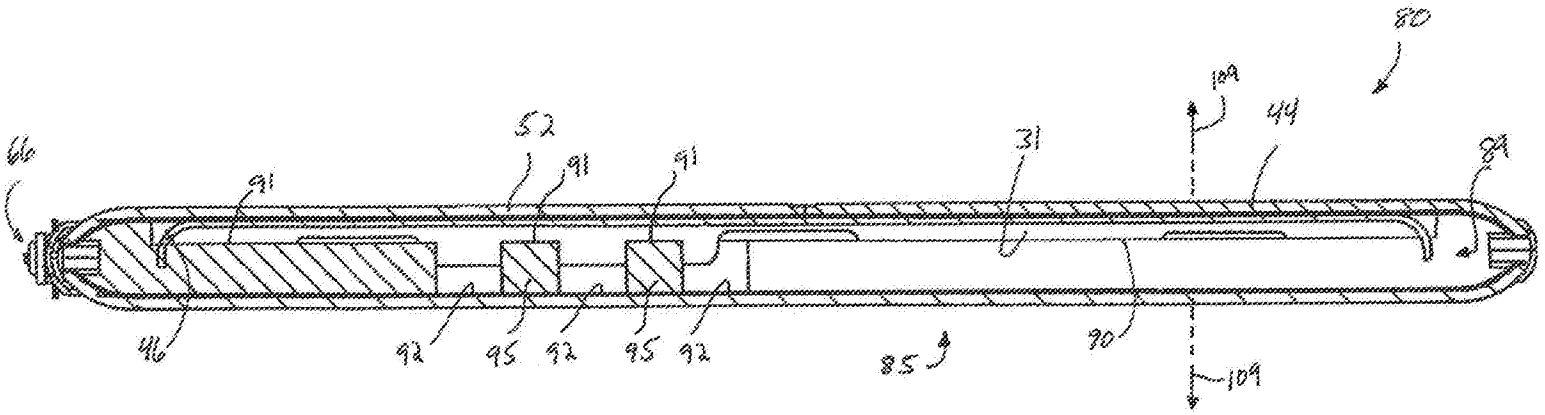
FIG. 74 is a second, enlarged, medial cross-sectional view of the third alternative case assembly according to the present invention as enlarged from FIG. 73A to show in greater detail the internal structural relationships of the closed case configuration.
Figure 75:
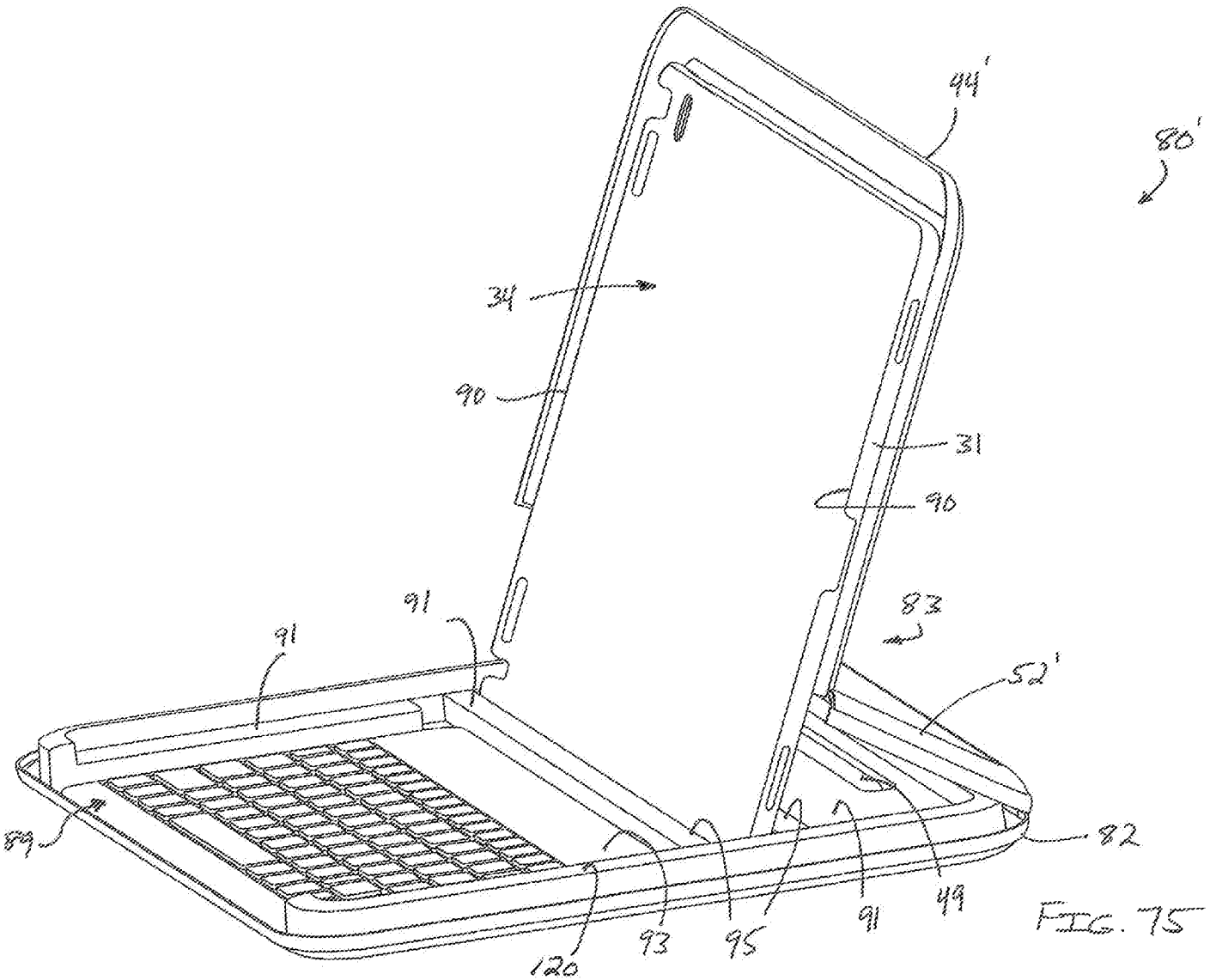
FIG. 75 is an anterior perspective view of a portrait orientation device-display type embodiment or version of the third alternative case assembly according to the present invention showing the case assembly in a first open angled-display case configuration.
Figure 76:
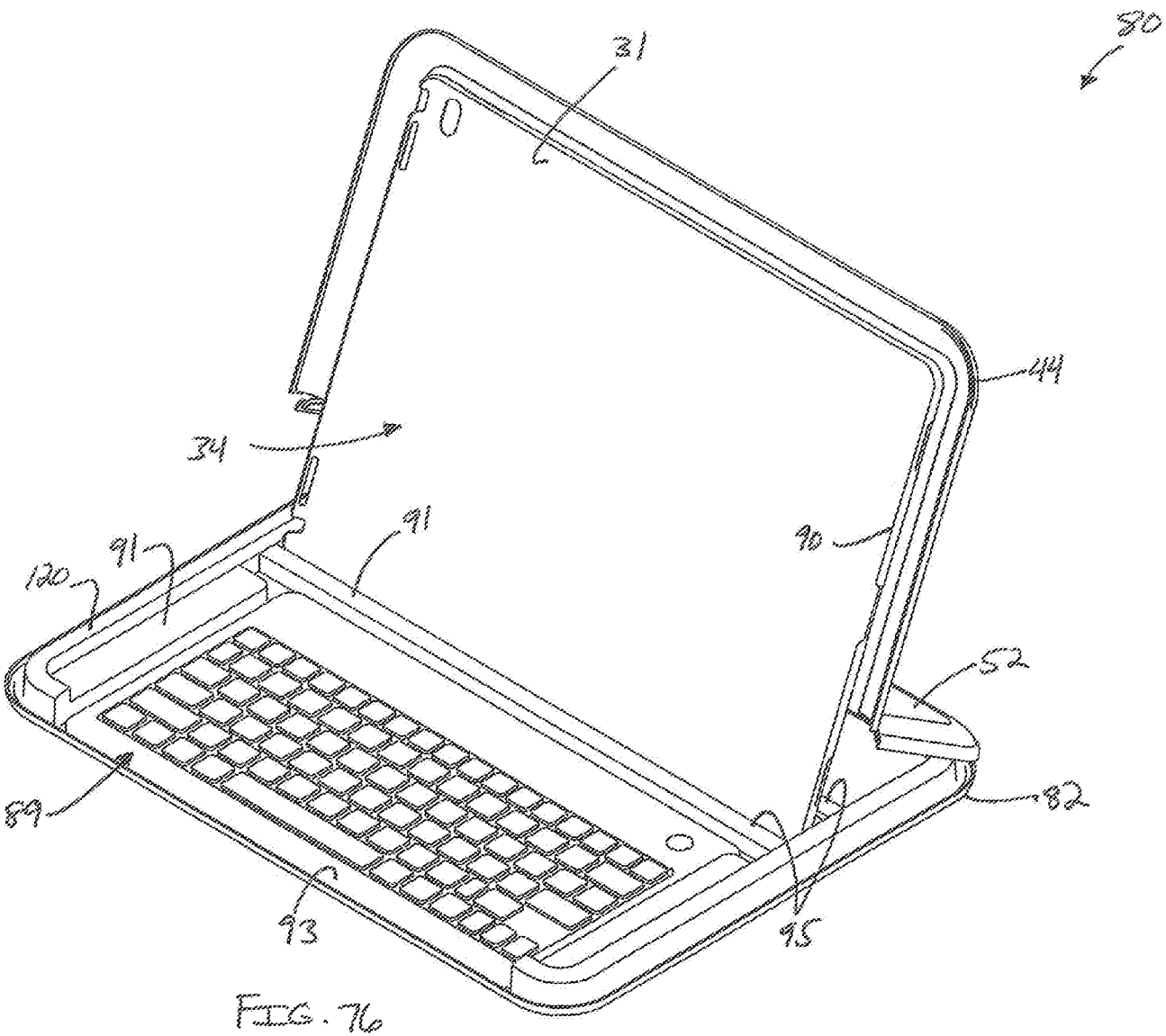
FIG. 76 is an anterior perspective view of a landscape orientation device-display type embodiment or version of the third alternative case assembly according to the present invention showing the case assembly in a first open angled-display case configuration.
Figure 77:
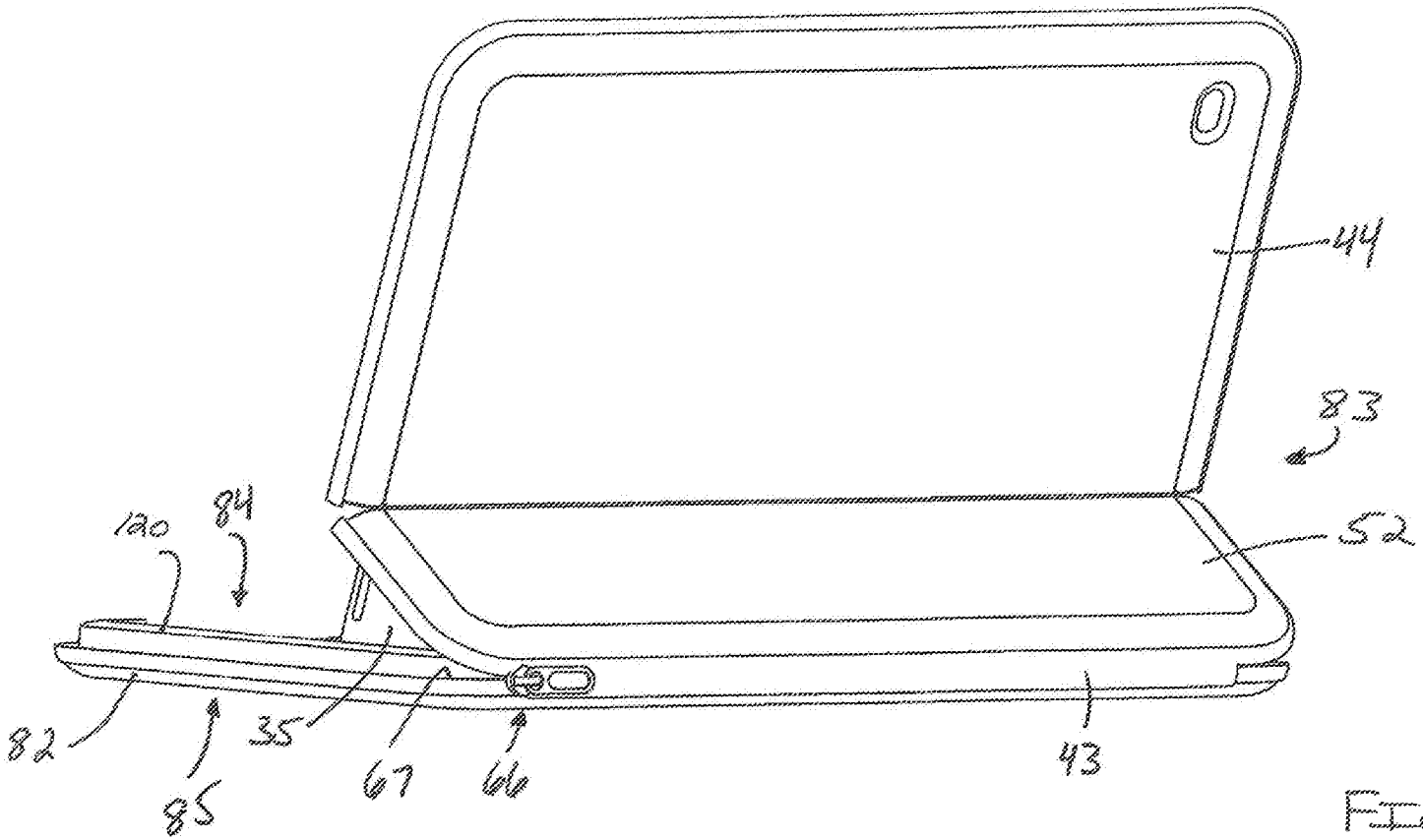
FIG. 77 is a posterior perspective view of the landscape orientation device-display type embodiment or version of the third alternative case assembly according to the present invention showing the case assembly in the first open angled-display case configuration.
Figure 78:
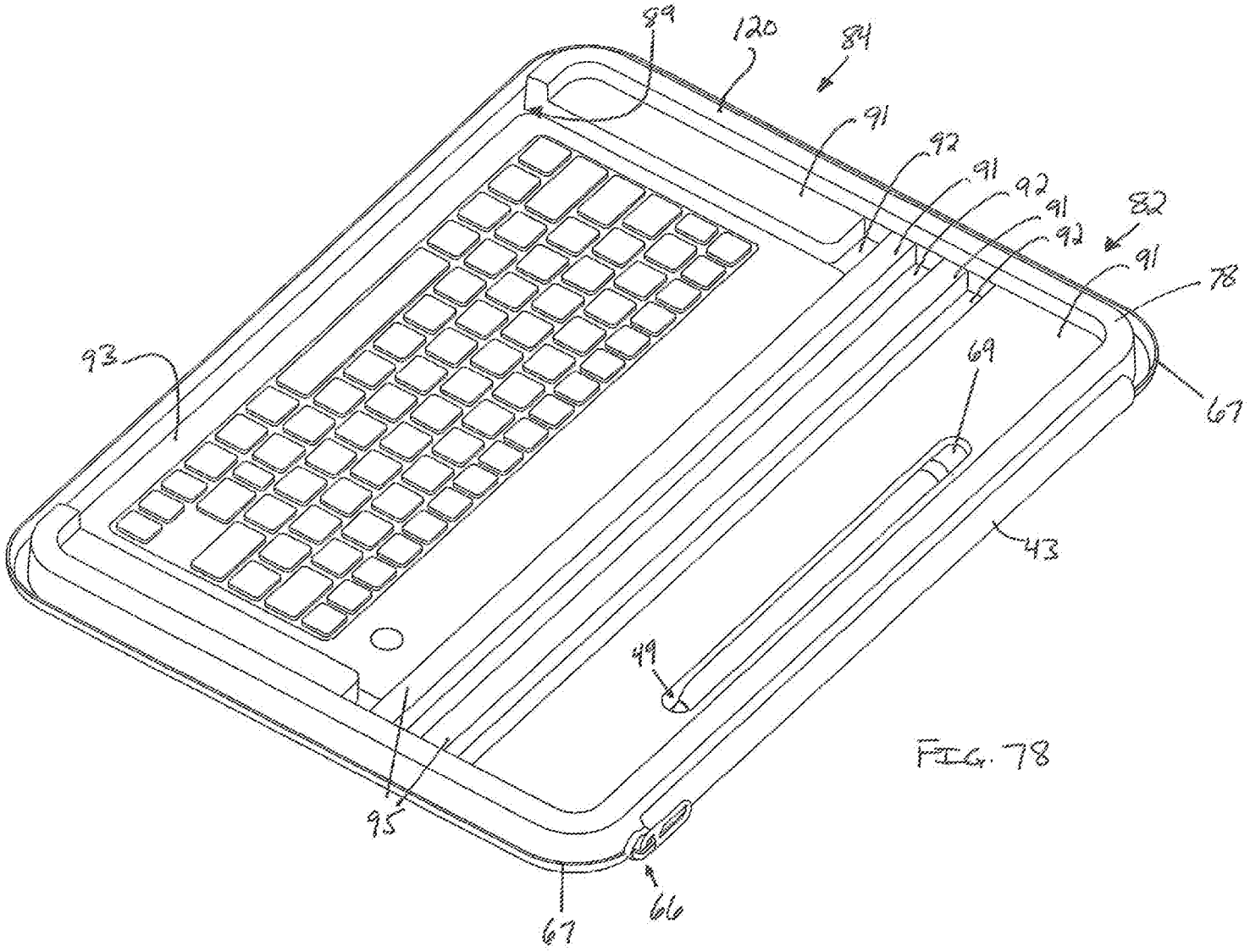
FIG. 78 is an anterior, dorsal perspective view of a third alternative basal cover ensemble of the third alternative case assembly according to the present invention.
Figures 79, 80, 81:
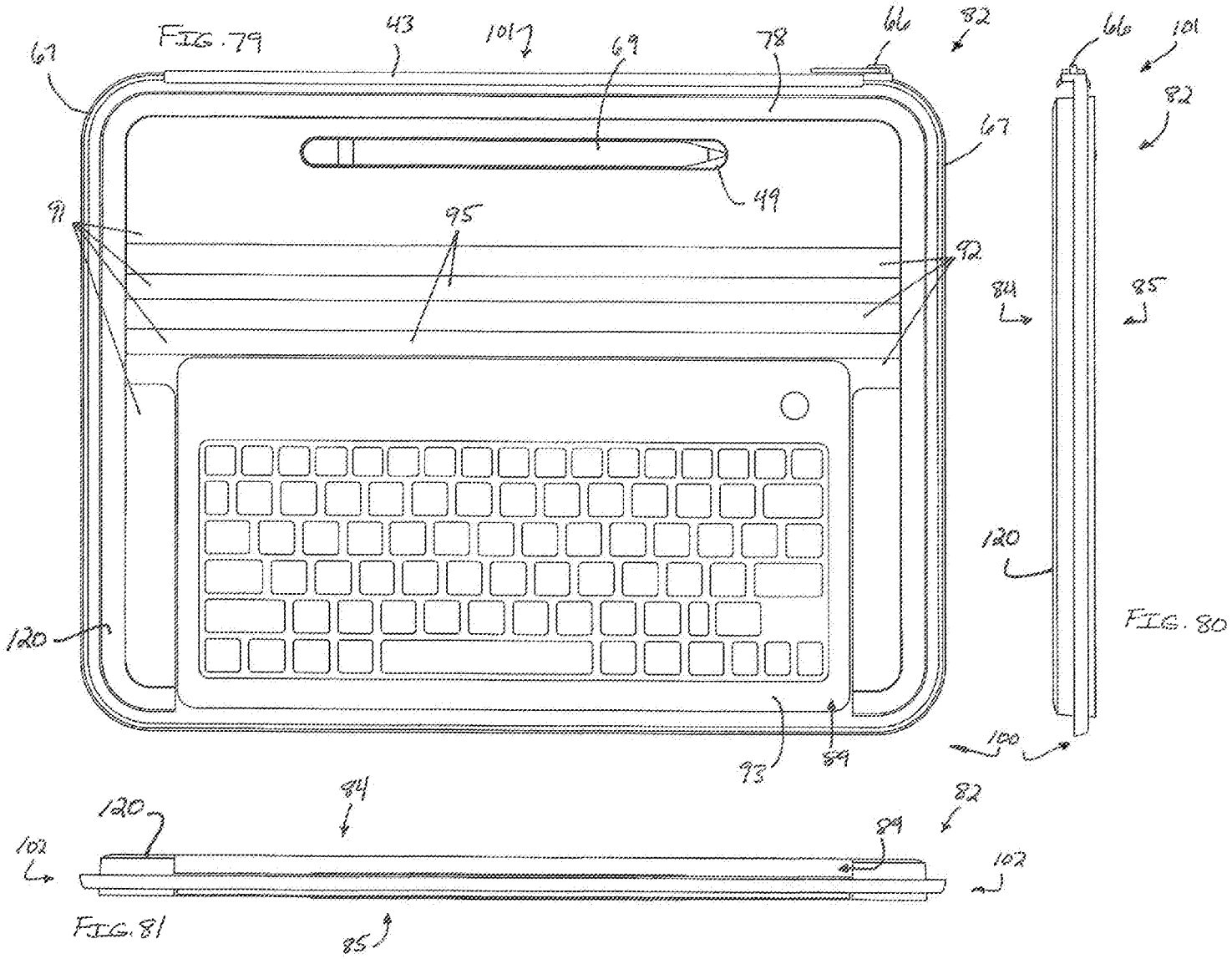
FIG. 79 is an anterior plan view of the third alternative basal cover ensemble of the third alternative case assembly according to the present invention.
FIG. 80 is a lateral edge view of the third alternative basal cover ensemble of the third alternative case assembly according to the present invention.
FIG. 81 is a ventral edge view of the third alternative basal cover ensemble of the third alternative case assembly according to the present invention.
Figures 82, 83, 84:
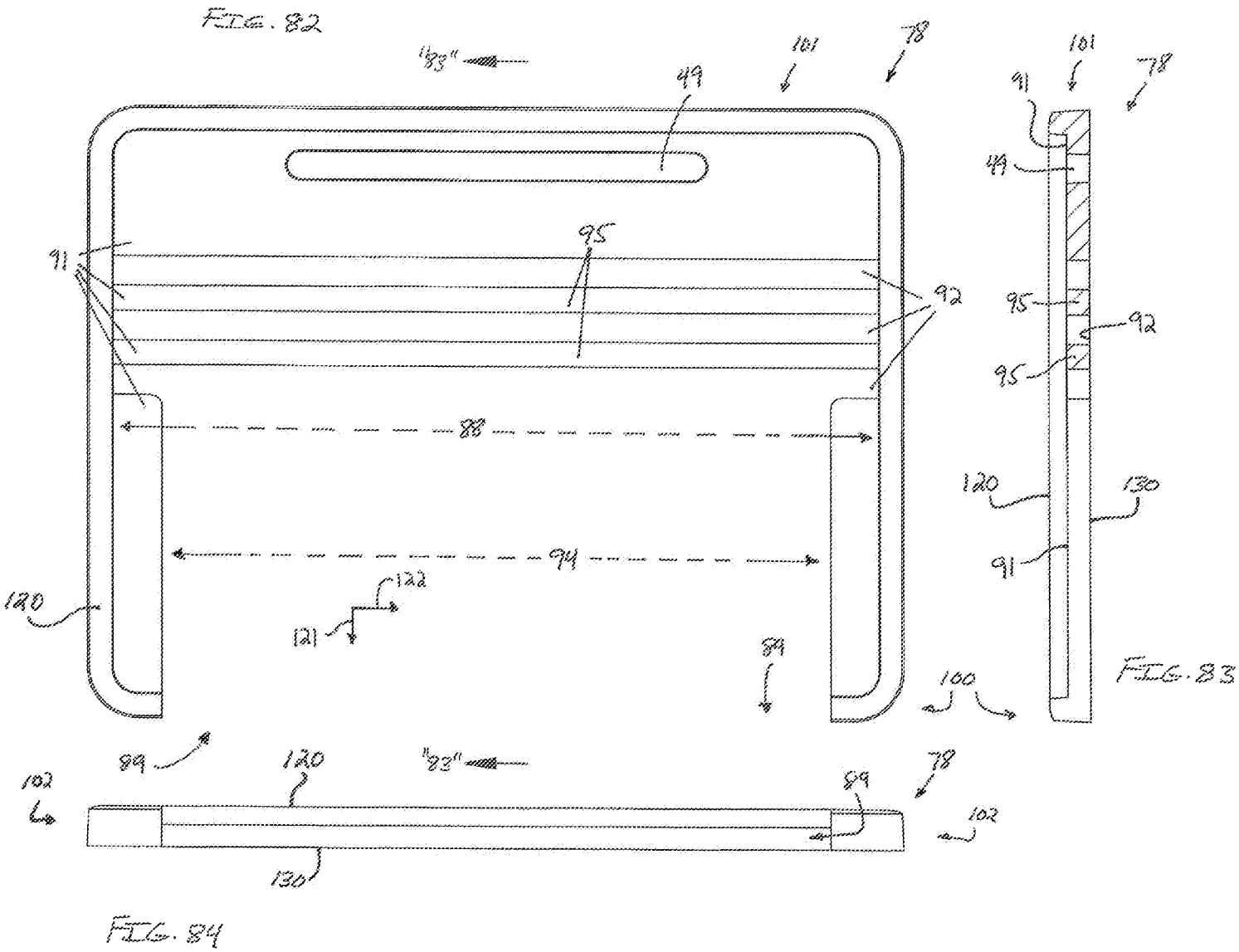
FIG. 82 is an anterior plan view of a third alternative raised peripheral boundary portion of the third alternative basal cover ensemble of the third alternative case assembly according to the present invention.
FIG. 83 is a first, medial cross-sectional view of the third alternative raised peripheral boundary portion of the third alternative basal cover ensemble of the third alternative case assembly according to the present invention as sectioned from FIG. 82 to show medial cross-sectional details of the third alternative raised peripheral boundary portion.
FIG. 84 is a ventral edge view of the third alternative raised peripheral boundary portion of the third alternative basal cover ensemble of the third alternative case assembly according to the present invention.
Figure 85:
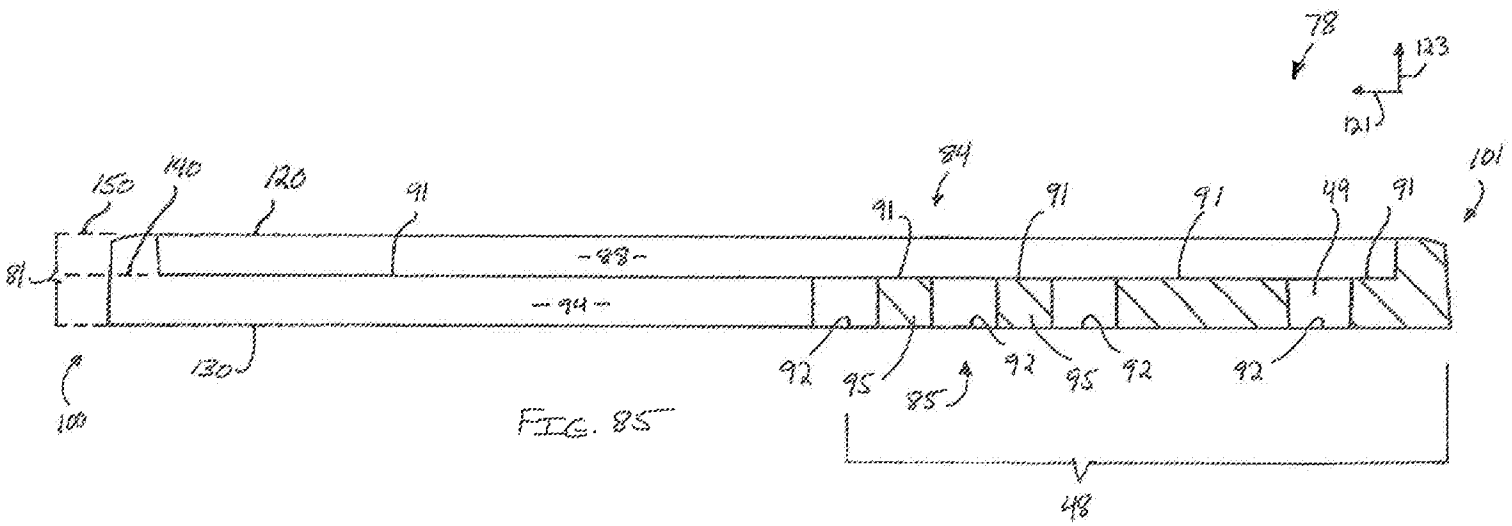
FIG. 85 is a second, enlarged, medial cross-sectional view of the third alternative raised peripheral boundary portion of the third alternative basal cover ensemble of the third alternative case assembly according to the present invention as enlarged from FIG. 83 to show in greater detail the medial cross-sectional details of the third alternative raised peripheral boundary portion.
Figures 86A, 86B, 87:
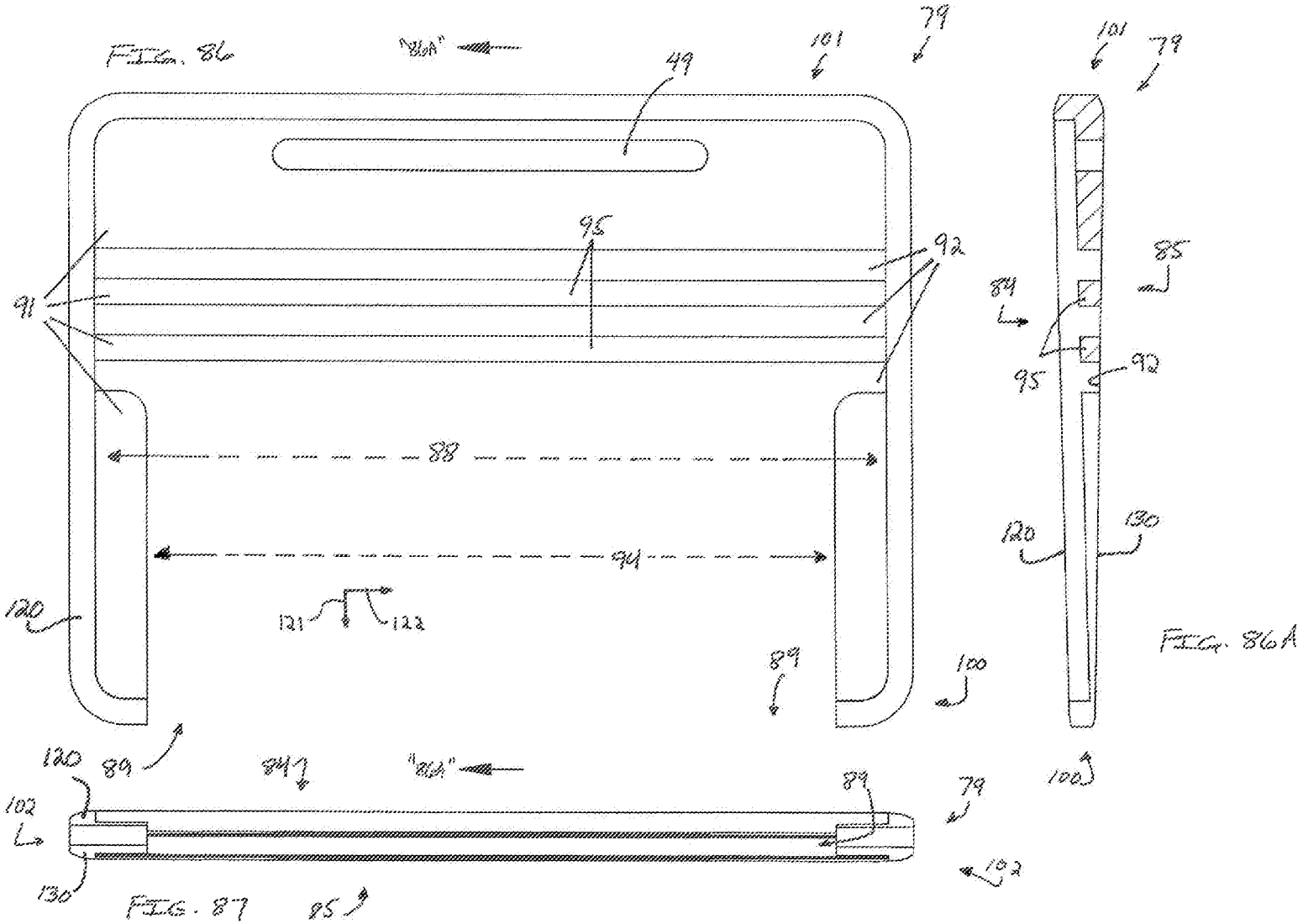
FIG. 86A is a first, medial, cross-sectional view of the fourth alternative raised peripheral boundary portion of the third alternative basal cover ensemble of the third alternative case assembly according to the present invention as sectioned from FIG. 86 to show medial cross-sectional details of the fourth alternative raised peripheral boundary portion.
FIG. 87 is a ventral edge view of the fourth alternative raised peripheral boundary portion of the third alternative basal cover ensemble of the third alternative case assembly according to the present invention.

Turning now to FIGS. 73-88, an alternative case assembly 80 and various components thereof are there variously illustrated. The alternative case assembly 80 is believed to be structurally on par with or similar to case assembly 60. In this regard, alternative case assembly 80 is generally depicted and referenced in its entirety in FIGS. 73-77. FIGS. 78-88 depict various separate parts or sub-assemblies of the case assembly 80 for ease of understanding and conciseness of description. A case assembly 80' is depicted in FIG. 75, which depicts a portrait orientation device-display type embodiment or version whereas assembly 80 is a landscape orientation device-display type embodiment or version. FIGS. 73-74 show the case assembly 80 in the closed case configuration; FIG. 75-77 show the case assembly 80 (and 80') in select angled display configurations; FIGS. 78-82 depict a basal cover ensemble 82 according to the present invention; and FIGS. 83-88 depict certain alternative raised peripheral boundary portions as at 78 and 79.

Similar to case assembly 60, case assembly 80 also preferably comprises a cradle element 31 substantially as earlier described and a zipper closure mechanism substantially as earlier described. Briefly, the zipper closure mechanism, in combination with case assembly 80, zip-fastens portions of the cradle-to-cover connection mechanism 83 to the basal cover ensemble 82. The zipper closure mechanism enables the user of case assembly 80 to selectively zip-close the case assembly 80 into the closed case configuration or zip-open the case assembly 80 for selectively displaying the cradle element 31 in any number of display configurations including an open flat display configuration or any number of open angled display configurations.

Accordingly, case assembly 80 basically functions to selectively encase and display an electronic device 11 and to achieve these basic functions preferably comprises the cradle element 31, the basal cover ensemble 82, and the cradle-to-cover connection mechanism 83. Similar to the various features of case assembly 60, the cradle element 31 preferably has an open anterior cradle portion as at 34, a posterior cradle portion as at 35, and a cradle depth as at 36. The cradle element 31 is preferably sized and shaped for receiving, retaining, and covering posterior portions 57 of the electronic device 11 so as to selectively display anterior portions 37 of the electronic device 11.

The basal cover element or ensemble 82 preferably comprises an anterior cover portion as at 84, a posterior cover portion as at 85, and a raised peripheral boundary portion as at 78 or 79. The raised peripheral boundary portion 78 has a substantially uniform portion thickness 81 greater than portion thicknesses 41 and 41'. The raised peripheral boundary portion 79, by contrast, has a tapered thickness (between thickness 86 and thickness 87) whereby the anterior cover portion 84 is obliquely angled relative to the posterior over portion 85 such that when the basal cover ensemble 82 or raised peripheral boundary portion 79 is placed upon a support surface as at 115, the anterior cover portion 84 is angled relative the support surface 115 for generally enhancing the ergonomics of the case assembly 80.

Each of the raised peripheral boundary portions or formations 78 or 79 define a primary cradle-receiving cavity as at 88, but each are preferably and substantially C-shaped in plan-view having an open ventral side as at 89; a closed dorsal side as at 101; closed, opposed lateral sides as at 102; and upper boundary surfacing as at 120 extending in an upper boundary plane as at 150. In other words, the primary cradle-receiving cavity 88 of the basal cover element or ensemble 82, while similarly dimensioned for receiving the cradle element 31 when the anterior cover portion 84 and anterior cradle portion 34 face one another, has an open side or portion as at 89. Further, the anterior edging 90 of cradle element 31 rests upon upper cradle-support surfacing as at 91, which upper cradle-support surfacing 91 is at a different elevation relative to both the lower cradle-support surfacing 92 and upper boundary surfacing 120 of the raised peripheral boundary portions 78 and 79.

Thus, when case assembly 80 is positioned into the closed configuration, portions of the anterior edging 90 of the cradle element 31 engage or seat upon the upper cradle-support surfacing 91 that is centrally recessed relative to a boundary portion thickness and upper boundary surfacing 120 of the raised peripheral boundary portions 78 and 79 and further elevated relative to the lower cradle-support surfacing 92 such that the cradle depth 36 is still within the portion thicknesses 81 and/or 86 as the case may be. The basal cover ensemble 82 may thus be said to comprise cradle-support surfacing as at 91 for supporting the cradle element 31 in spaced relation relative to both the posterior cover portion 85 and the anterior cover portion 84 when in the closed case configuration.

It will thus be understood that the C-shaped, raised peripheral boundary formations 78 and 79 are respectively insertable intermediate the anterior cover portion 84 and the posterior cover portion 85. The C-shaped, raised peripheral boundary formations 78 and 79 each have an open ventral side 89; a closed dorsal side 101 opposite the open ventral side 89; closed, opposed lateral sides as at 102; upper boundary surfacing 120 extending in an upper boundary plane 150, and a boundary portion thickness (as at either 81 or 86) defining a centrally-recessed primary cradle-receiving cavity as at 88.

The centrally-recessed primary cradle-receiving cavity 88 is positioned anteriorly relative to upper cradle support surfacing 91 having a dorsal spine section 48 and an open ventral section opposite the dorsal spine section 48. The upper cradle support surfacing 91 of the dorsal spine section 48 extends in parallel relation the closed dorsal side 101 an entire length between the opposed closed lateral sides 102. The upper cradle support surfacing 91 of the open ventral section extends lengthwise in parallel relation to the closed, opposed lateral sides 102 as generally and most clearly depicted in FIGS. 82 and 86.

The centrally recessed primary cradle-receiving cavity 88 is dimensioned for receiving the cradle 31 and anterior portions of the electronic device. The upper cradle-support surfacing 91 extends in an upper cavity surfacing plane 140. The upper cavity surfacing plane 140 is parallel to the upper boundary plane 150, and the boundary portion thickness (as at either 81 or 86) is at least equal to the cradle depth.

The case assembly 80 according to the present invention may thus be said to comprise or provide a C-shaped raised peripheral boundary element or portion as at 78 or 79, which portions or elements 78 and 79 extend in first dimension as at 121 and a second dimension as at 122. The C-shaped raised peripheral boundary elements 78 and 79 comprise a dorsal spine section as at 48 and an open ventral section opposite the dorsal spine section 48 defined by cavities 88 and 94 and open side 89. As earlier described, the open ventral section may be said to enable greater access to the secondary cavities.

Further, the reader will note that the anterior cover portion 84 is obliquely angled relative to the posterior cover portion 85 in a third dimension as at 123 such that upper boundary surfacing 120 of the peripheral boundary portion 79 is obliquely and uniformly angled relative to lower boundary surfacing 130 of the peripheral boundary portion 79 from the open ventral side 89 to the closed dorsal spine section 48. The dorsal spine section 48 may thus be preferably defined as being raised in elevation (as at thickness 87) relative to ventral portions (as at thickness 86) of the peripheral boundary element 79. The obliquely angled anterior cover portion 84 supports the cradle element 31 in a non-horizontal orientation relative to a horizontal support surface 115 when in the closed case configuration. The upper cradle-support surfacing 120 extends in parallel relation to upper boundary surfacing 120 of the C-shaped, raised peripheral boundary portions 78 and 79 as at respective planes 140 and 150.

The cradle-receiving cavity 88 or space of the case assembly 80 may further comprise additional cavity compartments for receiving the dorsal edge 46 of the cradle element 31 as generally and comparatively depicted in FIGS. 75 and 76, for example, and/or for receiving a keyboard type apparatus 93. In this last regard, the open side 89 enables enhanced access to the forward (and lower) cavity compartment generally depicted and referenced at 94. Further, the cavity compartments provided by the case assembly 80 provides edge prop portions as at 95, which prop portions 95 are structurally analogous to prop portion 45 for prop supporting the dorsal edge 46 of the cradle element 31.

Thus, the peripheral boundary elements 78 and 79 each preferably comprise or provide at least one prop portion as at 95 each of which prop portion(s) prop or support the dorsal edge 46 of the cradle element 31 when the cradle element is in a select angled display configuration relative to the basal cover ensemble 82. The peripheral boundary elements 78 and 79 may thus be said to preferably comprise or provide at least one secondary cavity, certain of which secondary cavities are formed in the otherwise cradle-support surfacing 91 for enabling enhanced functionality of the case assembly 80.

The cradle-to-cover connection mechanism 83 preferably comprises a cover attachment portion 43, a cradle attachment portion 44, and a support panel portion 52. The cover attachment portion 43 is preferably connected or attached to the basal cover ensemble 82 and the cradle attachment portion 44 is preferably connected or attached to the cradle element 31. The cover and cradle attachment portions 43 and 44 are pivotally attachable to one another (via the support panel portion 52) for enabling the user to selectively position the cradle element 31 and basal cover element or ensemble 82 in either a select open case configuration or a closed case configuration. As in case assemblies 30 and 60, the posterior cradle and cover portions 35 and 85, and the anterior cradle and cover portions face 34 and 84 face in opposite directions when in the closed case configuration. The raised peripheral boundary portions 78 and 79 are preferably constructed from or comprise Ethylene Vinyl Acetate or EVA for enhancing impact resistivity or toughness of the case assembly 80.

While the above descriptions contain much specificity, this specificity should not be construed as limitations on the scope of the invention, but rather as an exemplification of the invention. The basic invention may be said to essentially teach or disclose a sleeve assembly and/or a case assembly for selectively covering and protecting an electronic device. The sleeve assembly according to the present invention is believed to essentially and preferably comprise a first sleeve half shell and a second sleeve half shell. The first sleeve half shell comprises a first dorsal section, a first ventral section, a first internal sleeve contour, and a first external sleeve contour.

The first ventral section is pivotally attached to the first dorsal section. The first internal sleeve contour is shaped to receive an outer first half (e.g. an anterior portion 37 or a posterior portion 57) of the electronic device. The first external sleeve contour comprises a first exterior surface plane. The second sleeve half shell similarly comprises a second dorsal section, a second ventral section, a second internal sleeve contour, and a second external sleeve contour. The second ventral section is pivotally attached to the second dorsal section. The second internal sleeve contour is shaped to receive an outer second half (e.g. an anterior portion 37 or a posterior portion 57) of the electronic device. The second external sleeve contour comprises a second exterior surface plane.

The first dorsal section is preferably fixedly or permanently attached to the second dorsal section while the first ventral section is separably attachable to the second ventral section. The first and second exterior surface planes are preferably and substantially parallel to one another when the first and second ventral sections are separably attached to one another. The first and second internal sleeve contours together define a fixed device-receiving dorsal volume within the first and second dorsal sections, and the first and second internal sleeve contours together define a device-receiving ventral volume within the first and second ventral sections when the first and second ventral sections are separably attached to one another.

A dorsal portion of the electronic device is thus receivable in the device-receiving dorsal volume by way of the first and second ventral sections when the first and the second ventral sections are separated from one another. The ventral portion of the electronic device is receivable in the device-receiving ventral volume when the first and the second ventral sections are separably attached to one another. Received in a device-receiving volume summed by the dorsal and ventral volumes, the electronic device as exemplified by a tablet computer or smart phone, is thus selectively covered and protected by the sleeve assembly according to the present invention.

The first and second dorsal sections may each preferably further comprise an outer dorsal section flange and the first and second ventral sections may each further preferably comprise an outer ventral section flange. The outer dorsal section flanges are preferably fixedly (e.g. adhesively) attached to one another and the outer ventral section flanges are preferably separably attachable to one another via certain section retention means. In other words, certain section retention means (e.g. magnetic section retention means) cooperably associated with the outer ventral section flanges cooperably retain the first and second ventral sections separably attached to one another. The outer dorsal and ventral flange sections are coplanar and extend in an outer flange plane (extending intermediate the first and second outer surface planes) when the outer ventral section flanges are separably attached to one another.

The first and second ventral sections of the sleeve assembly are preferably pivotally attached to the first and second dorsal sections at opposed flange junctions, which opposed flange junctions extend in opposed junction planes parallel to and intermediate the first and second exterior surface planes when the outer ventral section flanges are separably attached to one another. The opposed flange junctions extend in the opposed junction planes for resiliently contacting opposite sides (e.g. anterior portions 37 and posterior portions 57) of the electronic device as received in the device-receiving dorsal and ventral volumes. The opposed flange junctions thus further function to prevent movement of the electronic device within the device-receiving dorsal and ventral volumes.

Noting that the opposed flange junctions of the sleeve assembly may preferably extend in a first bi-direction, it may be further noted that each of the first and second sleeve half shells preferably comprise at least one secondary device support flange that extends in a second bi-direction orthogonal to the first bi-direction. Each secondary device support flange is preferably coplanar with a respective junction plane when the outer ventral section flanges are separably attached to one another for resiliently further contacting opposite sides of the electronic device as received in the device-receiving dorsal and ventral volumes. The secondary device support flanges may thus further prevent movement of the electronic device within the device-receiving dorsal and ventral volumes.

Another optional, but preferred feature of the sleeve assembly according to the present invention provides that the first and second dorsal sections and the first and second ventral sections each preferably comprise a substantially uniform maximum section width while the opposed flange junctions each comprise a substantially uniform junction length. The junction length is lesser than the maximum section length for forming laterally opposed sleeve vents intermediate the dorsal sections and the ventral sections. The vents enable the case assembly to breath and/or expose the electronic device as otherwise received in the device-receiving volume defined by the inner surfacing of the sleeve assembly.

Certain case assemblies according to the present invention may be said to basically function to selectively encase and display an electronic device. To achieve these basic objectives, certain case assemblies may be said to preferably and essentially comprise a cradle or cradle element, a basal cover ensemble, and a cradle-to-cover connection panel assembly or mechanism. The cradle elements according to the present invention all have an open anterior cradle portion, a posterior cradle portion, and a cradle depth. The cradles are all preferably sized and shaped for receiving and retaining posterior portions of the electronic device so as to selectively display anterior portions of the electronic device.

The basal cover ensembles according to the present invention may all be said to preferably and essentially comprise an open anterior cover portion, a posterior cover portion, and a raised peripheral boundary portion or element. The raised peripheral boundary portion has a portion thickness and defines a primary cradle-receiving cavity. The primary cradle-receiving cavity is preferably sized and shaped for receiving the cradle when the anterior cover portion and anterior cradle portion face one another, the portion thickness being at least equal to the cradle depth.

The cradle-to-cover connection panel assembly or mechanism according to the present invention preferably and essentially comprises a dorsal panel portion and a ventral panel portion. The ventral panel portion is preferably connected to the posterior cradle portion and the dorsal panel portion is preferably connected to the posterior cover portion. The ventral panel portion is pivotally connected to the dorsal panel portion for enabling the user to selectively position the cradle and basal cover ensemble in either a select open case configuration or a closed case configuration such that the posterior cradle and cover portions face in opposite directions when in the closed case configuration.

The peripheral boundary portion may preferably comprise at least one ventral prop portion and the cradle preferably comprises a dorsal edge. Each ventral prop portion basically function to prop or support the dorsal edge when the cradle is in one or more primary angled display configuration(s) relative to the basal cover ensemble. Conceivably, a dorsal device edge of the electronic device itself could be prop-supported by the ventral prop portion an alternative embodiment. The basal cover ensemble may further comprise certain cradle-support surfacing for supporting the dorsal cradle edge when the cradle is in a series of secondary angled display configurations relative to the basal cover ensemble.

The cradle-to-cover connection panel assembly or mechanism may preferably comprise a support panel portion. The support panel portion is preferably pivotally connected to both the ventral panel portion and the dorsal panel portion and basically functions to support the cradle in any of the angled display configurations. The peripheral boundary portion may preferably comprise an outer peripheral edge and at least one secondary cavity. The primary cradle-receiving cavity and each secondary cavity are preferably off-centered relative to select portions of the outer peripheral edge.

The dorsal panel portion may preferably comprise certain posterior panel surfacing and anterior panel surfacing such that the anterior panel surfacing provides the cradle-support surfacing for supporting the cradle in the secondary angled display configurations. The basal cover ensemble, in certain embodiments, may be said to further preferably comprise raised cradle-support surfacing, which raised cradle-support surfacing may well function to support the cradle in spaced relation relative to the posterior cover portion when in the closed case configuration.

The peripheral boundary portion may preferably comprise at least one secondary cavity formed in the raised cradle-support surfacing. Further, the outer peripheral edge of the peripheral boundary portion may preferably comprise a dorsal panel-receiving portion and laterally opposed panel-guide portions. The dorsal panel-receiving portion is preferably recessed relative to the laterally opposed panel-guide portions for structurally accommodating a panel thickness of the cradle-to-cover connection panel assembly when in the closed case configuration such that an outer dorsal edging of the closed case configuration is substantially flush at the laterally opposed guide portions.

Certain case assemblies according to the present invention may be said to further provide a C-shaped raised peripheral boundary portion wherein the C-shaped is extended in first and second dimensions. The C-shaped raised peripheral boundary portion may preferably comprise a dorsal spine section and an open ventral section such that the open ventral section enables greater access to the secondary cavities. The anterior cover portion may be obliquely angled relative to the posterior cover portion in a third dimension such that the dorsal spine section is raised in elevation relative to ventral portions of the raised peripheral boundary portion. The obliquely angled anterior cover portion basically functions to support the cradle in a non-horizontal orientation relative to a horizontal support surface when in the closed case configuration.

Accordingly, although the inventive various sleeve assemblies and case assemblies have been described by reference to a number of embodiments, it is not intended that the novel sleeve and case assemblies heretofore described be limited thereby, but that modifications thereof are intended to be included as falling within the broad scope and spirit of the foregoing disclosure, the following claims, and the appended drawings.

What is claimed is:

1. A case assembly for selectively encasing and displaying an electronic device, the case assembly comprising:

a cradle, the cradle having an open anterior cradle portion, a posterior cradle portion, and a cradle depth, the cradle being dimensioned for receiving and retaining posterior portions of the electronic device so as to selectively display anterior portions of the electronic device;

a basal cover ensemble, the basal cover ensemble comprising an anterior cover portion, a posterior cover portion, and an insertable, C-shaped, raised peripheral boundary formation insertable intermediate the anterior cover portion and the posterior cover portion, the C-shaped, raised peripheral boundary formation having an open ventral side, a closed dorsal side opposite the open ventral side, closed, opposed lateral sides, upper boundary surfacing extending in an upper boundary plane, and a boundary portion thickness defining a centrally-recessed primary cradle-receiving cavity, the centrally-recessed primary cradle-receiving cavity being positioned anteriorly relative to upper cradle support surfacing having a dorsal spine section and an open ventral section, the upper cradle support surfacing of the dorsal spine section extending in parallel relation the closed dorsal side an entire length between the opposed, closed lateral sides, the upper cradle support surfacing of the open ventral section extending lengthwise in parallel relation to the closed, opposed lateral sides, the centrally-recessed primary cradle-receiving cavity being dimensioned for receiving the cradle and anterior portions of the electronic device, the upper cradle-support surfacing extending in an upper cavity surfacing plane, the upper cavity surfacing plane being parallel to the upper boundary plane, the boundary portion thickness being at least equal to the cradle depth; and a cradle-to-cover connection mechanism, the cradle-to-cover connection mechanism comprising a dorsal panel portion and a ventral panel portion, the ventral panel portion being connected to the posterior cradle portion and the dorsal panel portion being connected to the posterior cover portion, the ventral panel portion being pivotally connected to the dorsal panel portion for enabling the user to selectively position the cradle and basal cover ensemble in either a select open case configuration or a closed case configuration, the posterior cradle and cover portions facing in opposite directions when in the closed case configuration.

2. The case assembly of claim 1 wherein the C-shaped, raised peripheral boundary portion comprises at least one ventral prop portion extending in parallel relation to the closed dorsal side, the at least one ventral prop portion for propping the cradle when the cradle is in a primary angled display configuration relative to the basal cover ensemble.

3. The case assembly of claim 2 wherein the posterior cover portion provides a lower cradle-support surfacing exposed in adjacency to the at least one ventral prop portion, the lower cradle-support surfacing for supporting the cradle when the cradle is in a series of secondary angled display configurations relative to the basal cover ensemble.

4. The case assembly of claim 1 wherein the C-shaped, raised peripheral boundary portion comprises an outer peripheral edge and at least one secondary cavity, the at least one secondary cavity being off-centered relative to select portions of the outer peripheral edge intermediate upper cradle support surfacing of the open ventral section.

5. The case assembly of claim 3 wherein the cradle-to-cover connection mechanism comprises a support panel portion, the support panel portion being pivotally connected to both the ventral panel portion and the dorsal panel portion, the support panel portion for supporting the cradle in any of the angled display configurations.

6. A case assembly for selectively encasing and displaying an electronic device, the case assembly comprising:

a cradle, the cradle having an open anterior cradle portion, a posterior cradle portion, and a cradle depth, the cradle being sized and shaped for retaining the electronic device so as to selectively display the electronic device;

a basal cover ensemble, the basal cover ensemble comprising an anterior cover portion, a posterior cover portion, and a C-shaped, raised peripheral boundary formation, the C-shaped, raised peripheral boundary formation having an open ventral side, a closed dorsal side opposite the open ventral side, closed, opposed lateral sides, upper boundary surfacing extending in an upper boundary plane, and a boundary portion thickness defining a recessed, central primary cradle-receiving cavity, the recessed, central primary cradle-receiving cavity being positioned anteriorly relative to upper cradle support surfacing having a dorsal spine section and an open ventral section, the upper cradle support surfacing of the dorsal spine section extending in parallel relation the closed dorsal side an entire length between the opposed, closed lateral sides, the upper cradle support surfacing of the open ventral section extending lengthwise in parallel relation to the closed, opposed lateral sides, the recessed, central primary cradle-receiving cavity being dimensioned for anteriorly receiving the cradle and the electronic device the upper cradle-support surfacing extending in an upper cavity surfacing plane, the upper cavity surfacing plane being parallel to the upper boundary plane; and a cradle-to-cover connection mechanism, the cradle-to-cover connection mechanism comprising a cover attachment portion and a cradle attachment portion, the cover attachment portion being connected to the basal cover ensemble and the cradle attachment portion being connected to the cradle, the cover and cradle attachment portions being pivotally attachable to one another for enabling the user to selectively position the cradle and basal cover ensemble in a select open case configuration or a closed case configuration, the posterior cradle and cover portions facing in opposite directions when in the closed case configuration.

7. The case assembly of claim 6 wherein the C-shaped, raised peripheral boundary portion comprises at least one prop portion extending in parallel relation to the closed dorsal side, the at least one prop portion for propping the cradle in a select angled display configuration relative to the basal cover ensemble.

8. The case assembly of claim 6 wherein the upper cradle-support surfacing supports the cradle and electronic device in spaced relation relative to both the posterior cover portion and the anterior cover portion when in the closed case configuration.

9. The case assembly of claim 8 wherein the C-shaped, raised peripheral boundary portion comprises at least one secondary cavity, the at least one secondary cavity being formed in the upper cradle-support surfacing of the open ventral section.

10. The case assembly of claim 6 wherein the cradle-to-cover connection mechanism comprises a support panel portion, the support panel portion being pivotally attachable to both the cover and cradle attachment portions for supporting the cradle in the select open case configuration.

11. The case assembly of claim 6 wherein the C-shaped, raised peripheral boundary portion comprises a tapered thickness such that the upper boundary surfacing of the C-shaped, raised peripheral boundary portion is obliquely and uniformly angled relative to lower boundary surfacing of the C-shaped, raised peripheral boundary portion from the open ventral side to the closed dorsal side in a third dimension for obliquely and uniformly angling the upper boundary surfacing of the C-shaped, raised peripheral boundary portion relative to a support surface for enhancing ergonomic use of the case assembly.

* * * * *